US010966900B2

(12) United States Patent
Inada et al.

(10) Patent No.: US 10,966,900 B2
(45) Date of Patent: Apr. 6, 2021

(54) MASSAGE MACHINE

(71) Applicant: FAMILY INADA CO., LTD., Osaka (JP)

(72) Inventors: Nichimu Inada, Osaka (JP); Nagatoshi Harada, Osaka (JP); Yoshiyuki Hamada, Osaka (JP); Tomoki Nagamitsu, Tottori (JP); Keisuke Takatsuka, Tottori (JP); Tomoharu Fukuda, Tottori (JP)

(73) Assignee: FAMILY INADA CO., LTD., Osaka (JP)

( * ) Notice: Subject to any disclaimer, the term of this patent is extended or adjusted under 35 U.S.C. 154(b) by 721 days.

(21) Appl. No.: 15/494,281

(22) Filed: Apr. 21, 2017

(65) Prior Publication Data

US 2017/0258673 A1 Sep. 14, 2017

Related U.S. Application Data

(63) Continuation of application No. PCT/JP2015/068037, filed on Jun. 23, 2015.

(30) Foreign Application Priority Data

Oct. 24, 2014 (JP) ..... 2014-217286
Oct. 24, 2014 (JP) ..... 2014-217311
(Continued)

(51) Int. Cl.
*A61H 7/00* (2006.01)
*A61H 15/00* (2006.01)
*A61H 9/00* (2006.01)

(52) U.S. Cl.
CPC ..... *A61H 9/0078* (2013.01); *A61H 7/002* (2013.01); *A61H 7/004* (2013.01); *A61H 7/007* (2013.01);
(Continued)

(58) Field of Classification Search
CPC .... A61H 2201/0149; A61H 2201/1623; A61H 2201/1669; A61H 2201/0138;
(Continued)

(56) References Cited

U.S. PATENT DOCUMENTS 6,224,563 B1 * 5/2001 Nonoue ..... A61H 15/0078 601/99
6,443,917 B1 * 9/2002 Canto ..... A61H 15/0078 601/101
(Continued)

FOREIGN PATENT DOCUMENTS

JP 2013-153969 A 8/2013
JP 2014-008289 A 1/2014

OTHER PUBLICATIONS

Machine English translation of Foreign Patent document JP-2014-008289-A (Year: 2014).*
International Search Report issued in Application No. PCT/JP2015/068037, dated Sep. 15, 2015.

*Primary Examiner* — Samchuan C Yao
*Assistant Examiner* — Nathan M Le
(74) *Attorney, Agent, or Firm* — Michael Best & Friedrich LLP

(57) ABSTRACT

Massage mechanisms of a massage machine individually include a pair of left and right treatment members provided along a height direction of the massage machine. A first massage mechanism is disposed on a relatively upper side, and a second massage mechanism is disposed on a relatively lower side. A control means that controls operations of the first and second massage mechanisms. The control means controls advancing/retreating drive portions such that the treatment members of the first massage mechanism and the treatment members of the second massage mechanism advance or retreat at speeds different from each other such as with a time lag.

4 Claims, 50 Drawing Sheets

(30) Foreign Application Priority Data

Oct. 24, 2014 (JP) ..... 2014-217325
Jan. 31, 2015 (JP) ..... 2015-018015

(52) U.S. Cl.
CPC . *A61H 15/0078* (2013.01); *A61H 2015/0028* (2013.01); *A61H 2201/0103* (2013.01); *A61H 2201/0149* (2013.01); *A61H 2201/0192* (2013.01); *A61H 2201/1215* (2013.01); *A61H 2201/1664* (2013.01); *A61H 2201/5007* (2013.01); *A61H 2201/5035* (2013.01); *A61H 2201/5038* (2013.01); *A61H 2201/5058* (2013.01); *A61H 2201/5064* (2013.01); *A61H 2203/0425* (2013.01); *A61H 2203/0431* (2013.01); *A61H 2203/0437* (2013.01); *A61H 2205/04* (2013.01); *A61H 2205/06* (2013.01); *A61H 2205/062* (2013.01); *A61H 2205/081* (2013.01); *A61H 2205/086* (2013.01); *A61H 2205/106* (2013.01)

(58) Field of Classification Search
CPC ..... A61H 2203/0425; A61H 2205/062; A61H 2205/082
See application file for complete search history.

(56) References Cited

U.S. PATENT DOCUMENTS 7,429,251 B2 * 9/2008 Tanizawa ..... A61H 7/00 601/100
2004/0171972 A1 * 9/2004 Shimizu ..... A61H 15/00 601/99
2005/0245851 A1 * 11/2005 Ferber ..... A61H 23/0263 601/86
2006/0195052 A1 * 8/2006 Kim ..... A61H 15/0078 601/99
2007/0185421 A1 * 8/2007 Wu ..... 601/102
2009/0124940 A1 * 5/2009 Nishio ..... A61H 15/0078 601/49
2009/0177128 A1 * 7/2009 Fukuyama ..... A61H 15/0078 601/98
2010/0198120 A1 * 8/2010 Tago ..... A61H 1/0292 601/134
2010/0198121 A1 * 8/2010 Tago ..... A61H 9/0078 601/150
2010/0286577 A1 * 11/2010 Tsai ..... A61H 15/0078 601/112
2011/0087139 A1 * 4/2011 Ferber ..... A61H 7/007 601/134
2012/0215143 A1 * 8/2012 Inada ..... A61H 1/003 601/112
2014/0343467 A1 * 11/2014 Fukuyama ..... A61H 23/006 601/98

* cited by examiner

MASSAGE MACHINE

BACKGROUND OF THE INVENTION

Field of the Invention

The present invention relates to a massage machine.

Background Art

In the related art, there is a known massage apparatus in which an upper unit disposed on a relatively upper side and a lower unit disposed on a relatively lower side are provided in a backrest portion. The upper unit includes a shoulder unit and a scapular unit. The lower unit includes a back unit and a waist unit. In addition, in the shoulder unit, treatment members massage the shoulders so as to press down the shoulders due to expansion of air bags. In the scapular unit, treatment members massage the scapulas so as to press up the scapulas due to expansion of air bags. Therefore, it is possible to apply a massaging effect of clamping the shoulders and the scapulas with the treatment members of the shoulder unit and the treatment members of the scapular unit.

In addition, as another technology in the related art, there is a known massage apparatus in which an upper unit disposed on a relatively upper side and a lower unit disposed on a relatively lower side are provided in a backrest portion. The upper unit includes a shoulder unit and a scapular unit. The lower unit includes a back unit and a waist unit. In each of the shoulder unit and the waist unit, a pair of treatment members can operate in a lateral direction so as to interpose a treatment target portion therebetween and to massage the treatment target portion.

In addition, as further another technology in the related art, there is a known massage machine in which a plurality of roller portions and mechanical units are provided along a height direction. The plurality of roller portions and mechanical units are independently movable between a backrest portion and a leg mounting portion. Each of the roller portions and the mechanical units are controlled by a control unit which is configured with a substrate in which microcomputer elements are disposed, so as not to collide with each other.

SUMMARY OF THE INVENTION

A massage machine in which a plurality of massage mechanisms individually having a pair of right and left treatment members are provided along a height direction. The massage machine includes a first massage mechanism that is disposed on a relatively upper side and a second massage mechanism that is disposed on a relatively lower side, as the massage mechanisms, and control means that controls operations of the first and second massage mechanisms. The first and second massage mechanisms individually have a massage drive portion that causes the pair of treatment members to perform at least one of a massaging operation in which the pair of treatment members approaches each other or is separated from each other and a patting operation in which the pair of treatment members alternately advances and retreats, and an advancing/retreating drive portion that causes the treatment members to advance and retreat in a forward/backward direction with respect to a user. The control means controls the advancing/retreating drive portion such that the treatment members of the first massage mechanism and the treatment members of the second massage mechanism advance or retreat with a time lag, and optionally at speeds different from each other.

According to such a configuration, the treatment members of the first and second massage mechanisms each of which can perform the massaging operation or the patting operation can advance or retreat with a time lag, and optionally at speeds different from each other.

The first and second massage mechanisms individually may have a massage drive portion that causes the pair of treatment members to perform at least one of a massaging operation in which the pair of treatment members approaches each other or is separated from each other and a patting operation in which the pair of treatment members alternately advances and retreats, and an advancing/retreating drive portion that causes the treatment members to advance and retreat in a forward/backward direction with respect to a user. The control means controls the advancing/retreating drive portion such that the treatment members of the first massage mechanism and the treatment members of the second massage mechanism advance or retreat at speeds different from each other.

In addition, it is preferable that the control means controls the advancing/retreating drive portion such that after the treatment members of one massage mechanism of the first and second massage mechanisms advance, the treatment members of the other massage mechanism advance.

BRIEF DESCRIPTION OF THE DRAWINGS

FIG. 41 is a view describing an operation a.

DETAILED DESCRIPTION OF THE INVENTION

Overall Configuration

Figure 1:
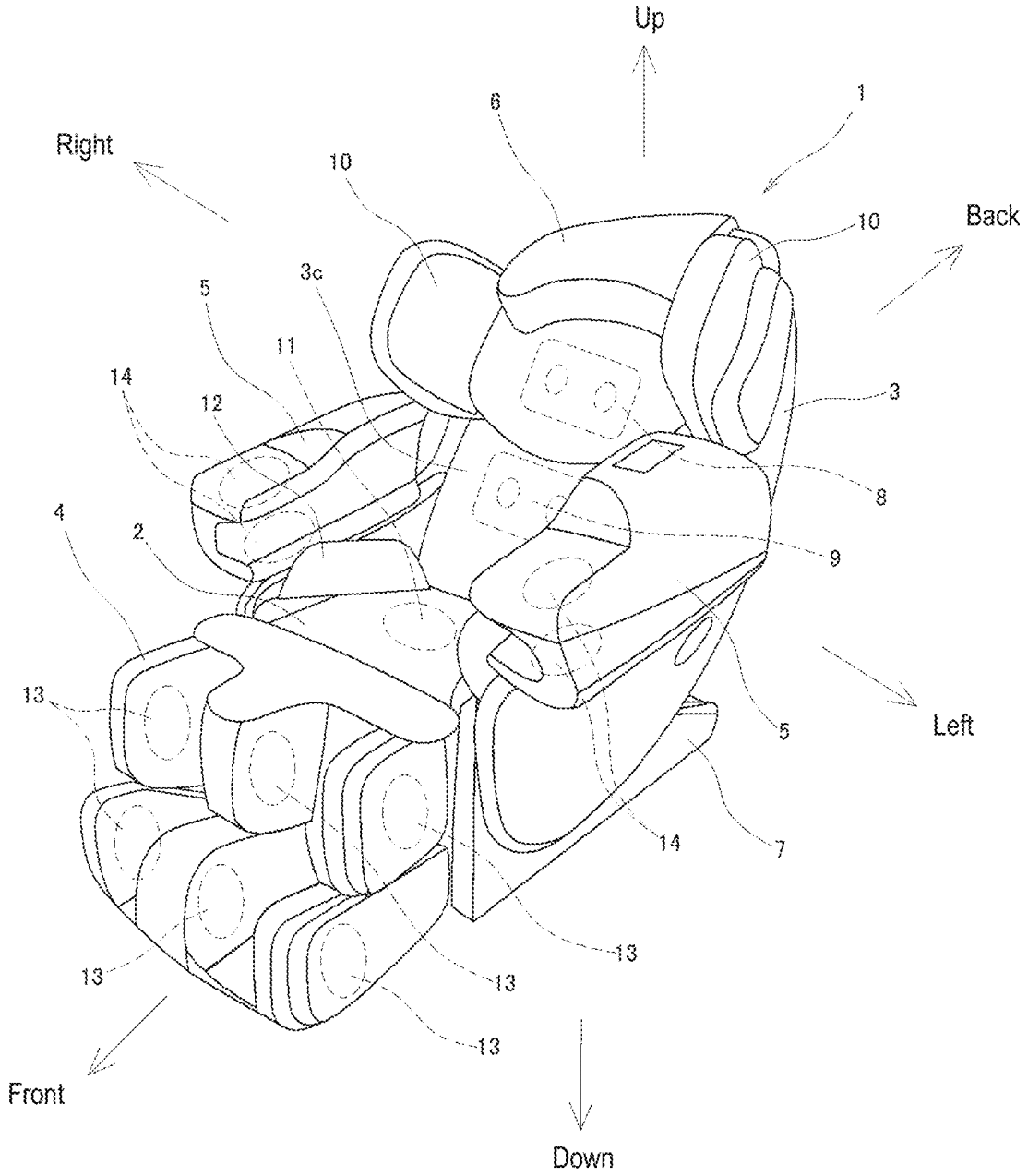
FIG. 1 is a perspective view of a massage machine according to an embodiment of the present invention.
Figure 2:
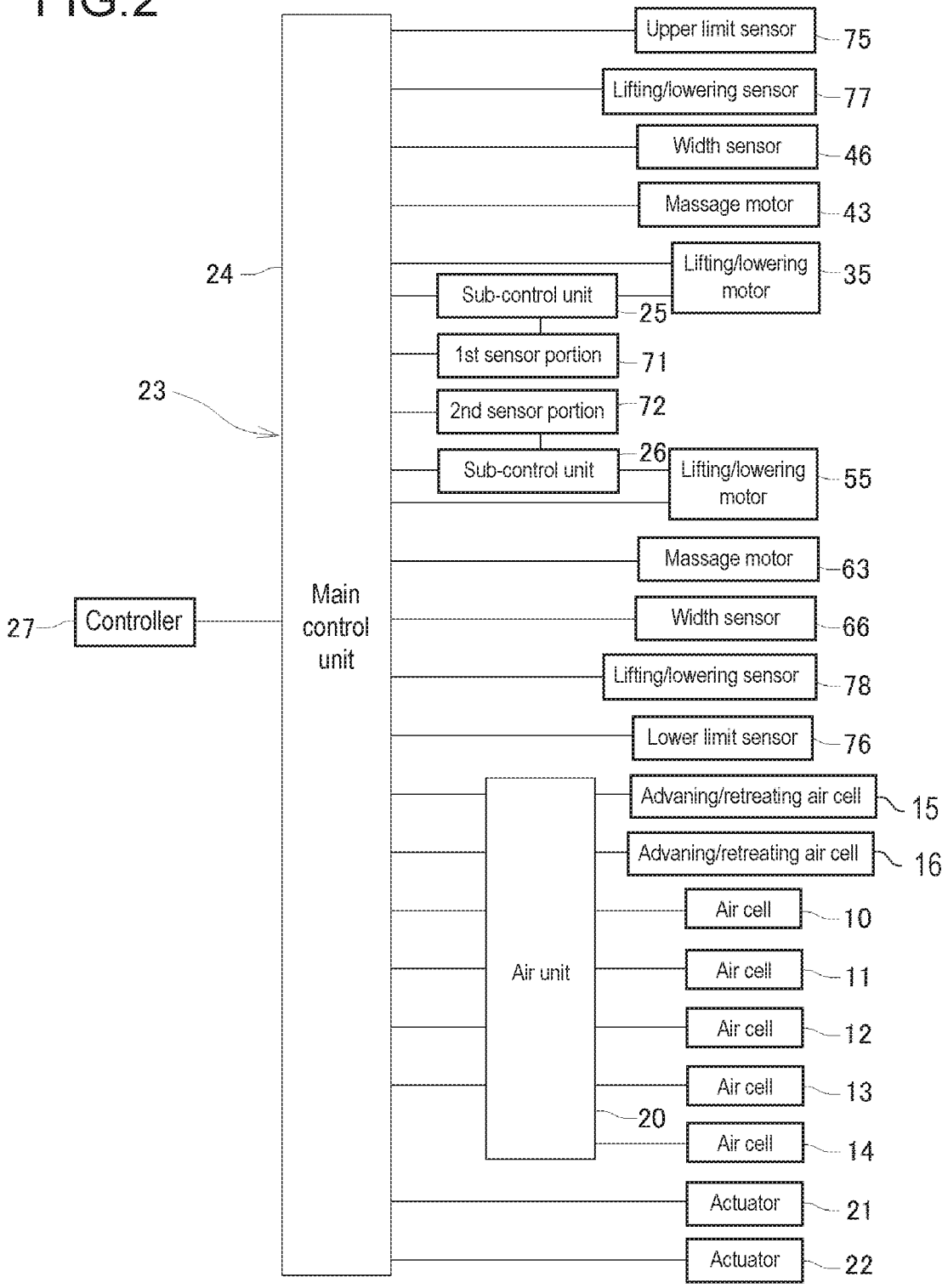
FIG. 2 is a functional block diagram of the massage machine.
Figure 3:
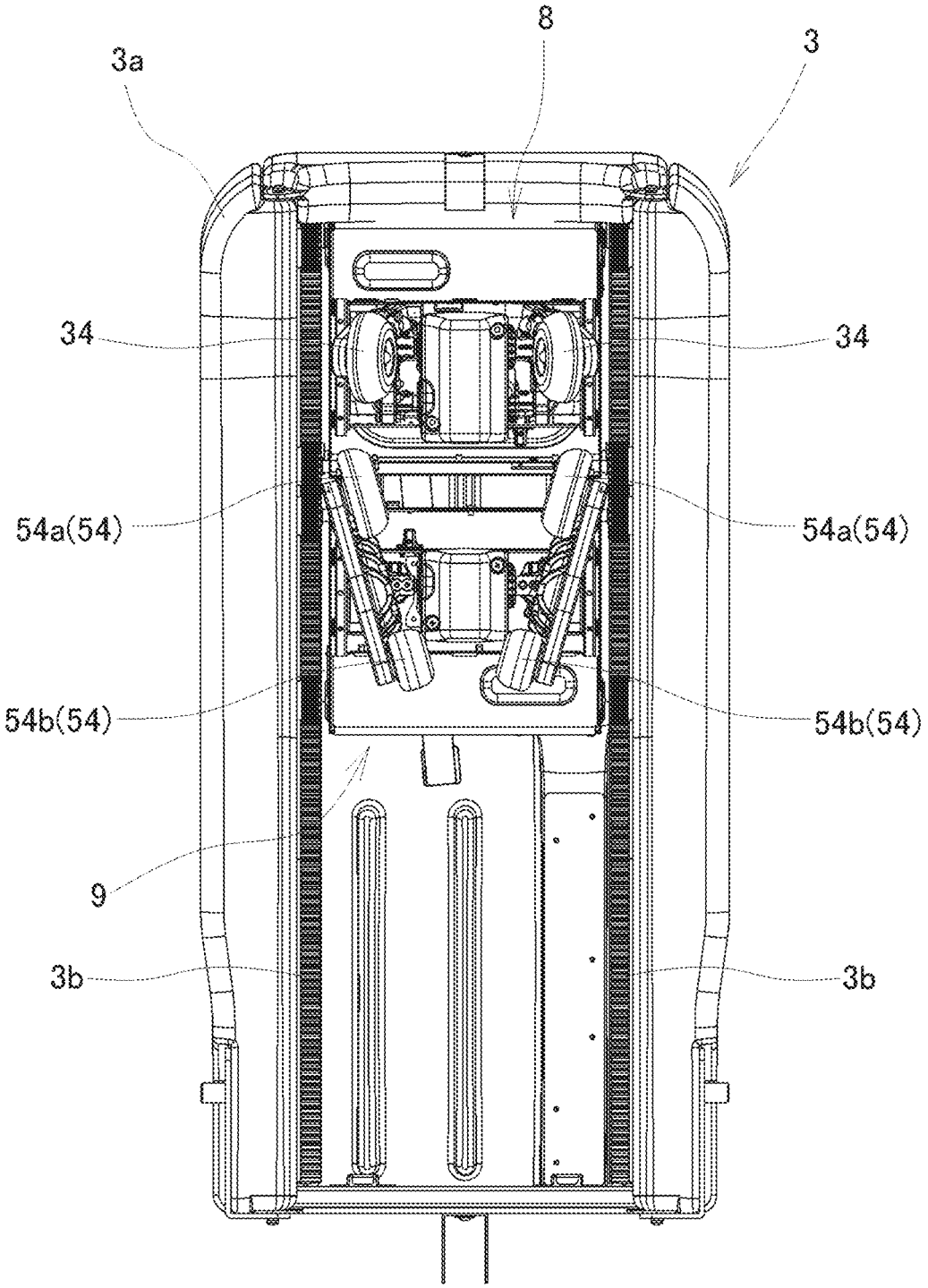
FIG. 3 is a front view of a backrest portion.

Hereinafter, the overall configuration of a massage machine 1 according to the present invention will be described. FIG. 1 is a perspective view of the massage machine 1 according to an embodiment of the present invention. FIG. 2 is a functional block diagram of the massage machine 1. FIG. 3 is a front view of a backrest portion 3. The concept of directions applied in the following description coincides with the concept of directions viewed from a user that takes a seat in the massage machine 1 in a standing posture as illustrated in FIG. 1, and cases other than that will be suitably described.

As illustrated in FIG. 1, the massage machine 1 of the present invention mainly includes a seat portion 2 in which the user takes a seat, a backrest portion 3 which is reclinably provided at a back portion of the seat portion 2 and on which the user leans, a footrest 4 which is provided at a front portion of the seat portion 2 so as to be able to vertically oscillate and supports the legs and the feet of the user, armrest portions 5 which are respectively provided on both the right and left sides of the seat portion 2 and on which the user places the arms, a pillow portion 6 which is provided at an upper portion of the backrest portion 3 and supports the head of the user, and a leg frame 7 which supports the seat portion 2 and is installed on a floor surface. The backrest portion 3 includes a plurality of massage units 8 and 9 which are provided along a height direction and massage the upper half of the body of the user from behind.

In addition, side portions of the backrest portion 3 are respectively provided with air cells 10 which press or hold the upper arms or the shoulders in a lateral direction. The seat portion 2 is provided with an air cell 11 which presses the buttocks or the femur of the user from below, and air cells 12 which press or hold the buttocks or the femur in the lateral direction. The footrest 4 is provided with air cells 13 which press or hold the legs and the feet of the user in the lateral direction. The armrest portions 5 are respectively provided with air cells 14 which press or hold the forearms from above and below. Each of the air cells 10 to 14 expands and contracts due to air supplied from and discharged to an air unit 20 which is provided below the seat portion and includes a pump, valves, and the like (refer to FIG. 2).

As illustrated in FIGS. 1 and 2, the backrest portion 3 is configured so as to be reclinable in a forward/backward direction with respect to the seat portion 2 by an actuator 21 provided below the seat portion 2. The backrest portion 3 can stop at an arbitrary position within a range from the standing posture illustrated in FIG. 1 to a reclining posture at which a backrest surface becomes substantially horizontal with respect to the floor surface. The armrest portions 5 are configured to move backward in association with reclining of the backrest portion 3 and to move forward in association with standing of the backrest portion 3. The footrest 4 is configured so as to be able to oscillate in a vertical direction with respect to the seat portion 2 by an actuator 22 provided below the seat portion 2. The footrest 4 can stop at an arbitrary position within a range from a hanging posture illustrated in FIG. 1 to a lifted posture at which the legs and the feet are supported in a state where the knees are straightened.

As illustrated in FIG. 2, below the seat portion 2, there is provided the air unit 20 which supplies and discharges air with respect to each of the air cells 10 to 14 and advancing/retreating air cells 15 and 16 (will be described later) and includes the pump, the valves, and the like. It is preferable that the air unit 20 is configured so as to be able to maintain each of the air cells 10 to 14 and the advancing/retreating air cells 15 and 16 under an arbitrary expansion amount. In this case, the expansion amount of each of the air cells 10 to 14 and the advancing/retreating air cells 15 and 16 can be adjusted. In addition, the massage machine 1 is provided with control means 23 which includes a programmable microcomputer and the like and is configured to individually control operations of the massage units 8 and 9, the air unit 20, and the actuators 21 and 22 in accordance with an instruction of the user given through an operation device 27, or a predetermined program.

The control means 23 includes a main control unit 24 which are provided below the seat portion 2 and individually controls operations of the massage units 8 and 9, the air unit 20, and the actuators 21 and 22; and sub-control units 25 and 26 which are respectively provided in the massage units 8 and 9 and control lifting/lowering of the massage units 8 and 9. In addition, the control means 23 stores a plurality of massage courses for automatically operating at least any one of the massage units 8 and 9, the air unit 20, and the actuators 21 and 22 in accordance with the predetermined program. When the user selects a desired massage course, various types of operations are automatically performed until a set time for the course elapses.

Configuration of Backrest Portion

As illustrated in FIGS. 1 and 3, the backrest portion 3 is configured to include a back frame 3*a* which is formed of a resin or the like having a gate shape in a front view, guide mechanisms 3*b* which respectively guide lifting/lowering of the massage units 8 and 9 assembled in the back frame 3*a*, and a back pad 3*c* which is disposed on a front surface side of the back frame 3*a* and has cushioning characteristics. The guide mechanisms 3*b* extend along the height direction and are curved such that each of an upper portion and a lower portion is positioned so as to protrude forward beyond an intermediate portion (refer to FIGS. 21A and 21B). In addition, racks are formed on the front side, and rails are formed on the back side. The plurality of massage units 8 and 9 are respectively supported by the guide mechanisms 3*b* so as to be able to be lifted and lowered.

Configuration of Massage Unit

Figure 4:
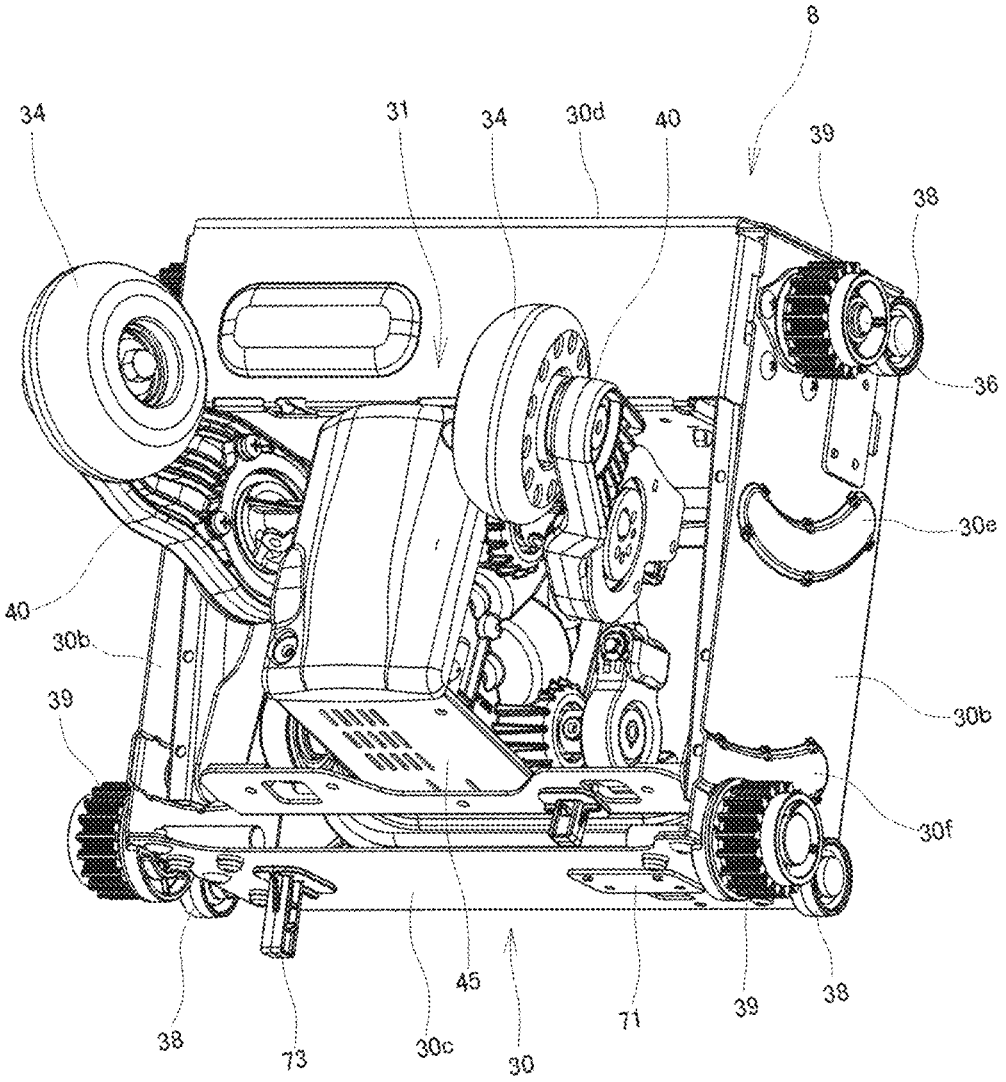
FIG. 4 is a perspective view of a first massage unit.
Figure 5:
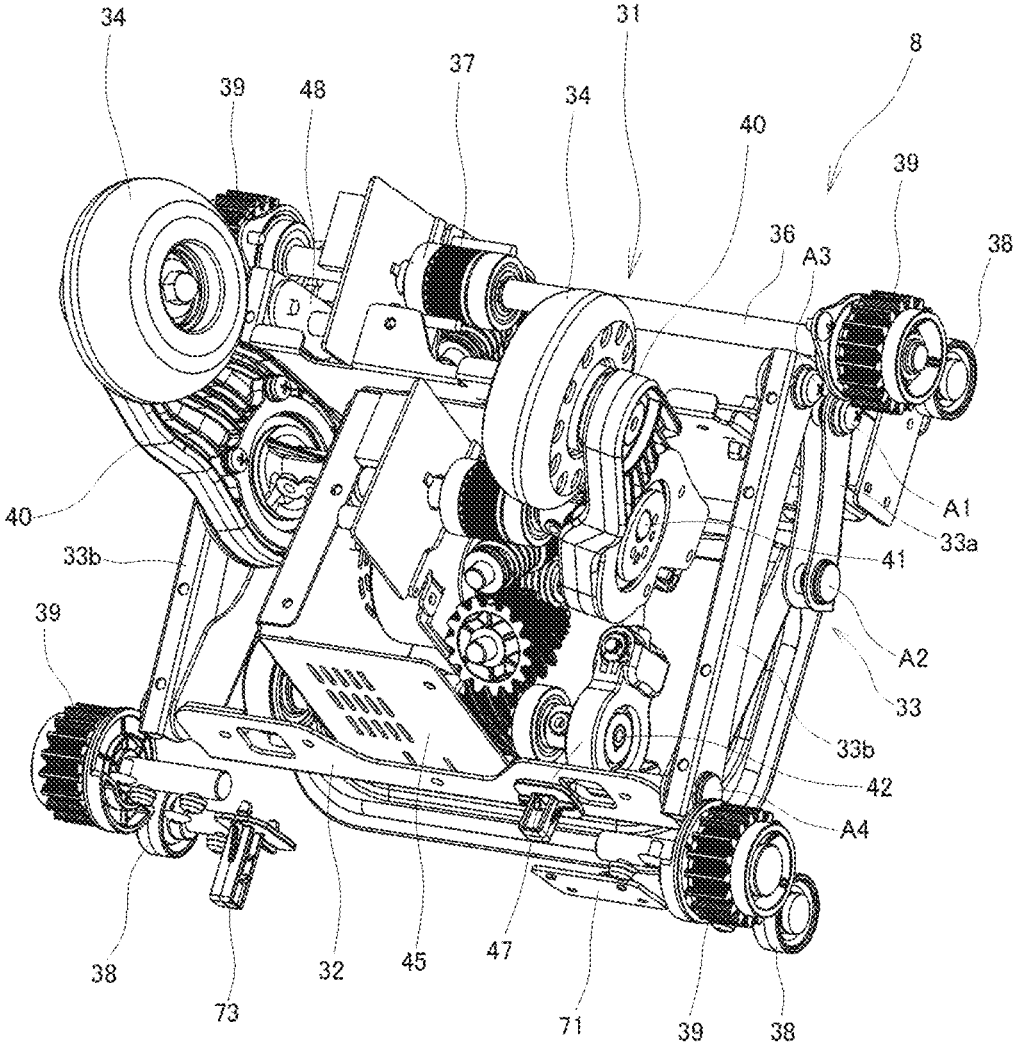
FIG. 5 is a perspective view of the first massage unit in which a part of members is omitted.
Figure 6:
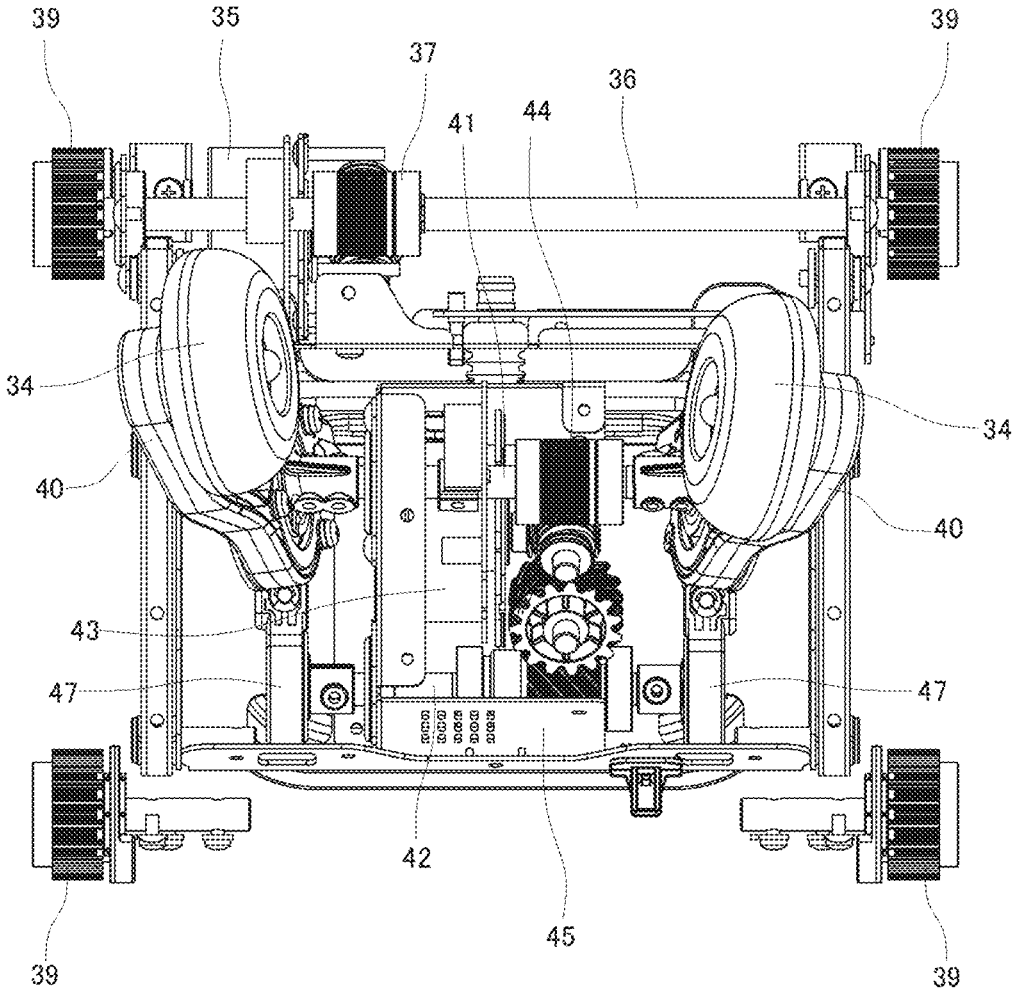
FIG. 6 is a front view of the first massage unit.
Figure 7:
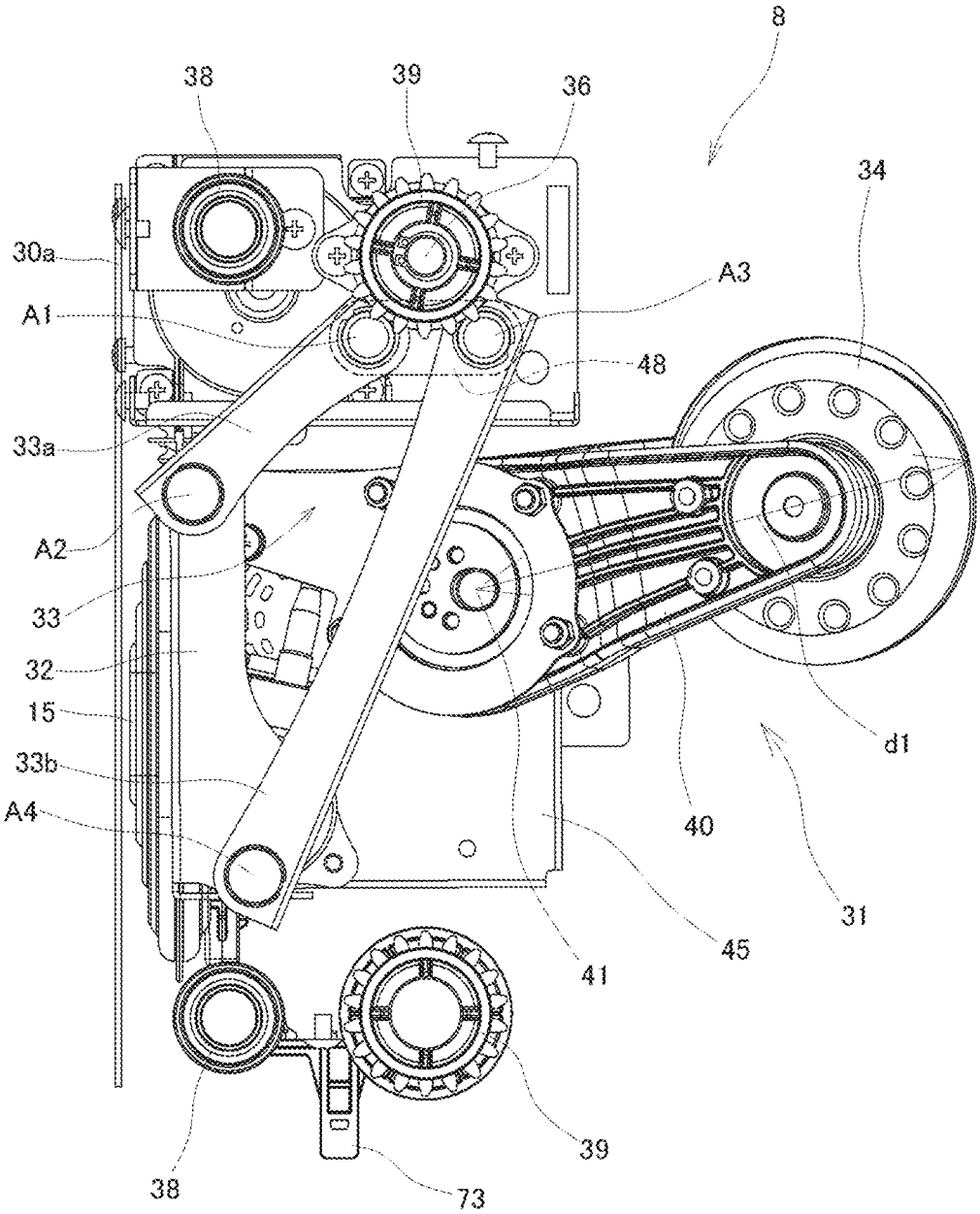
FIG. 7 is a side view of the first massage unit and illustrates a state where a first massage mechanism retreats.
Figure 8:
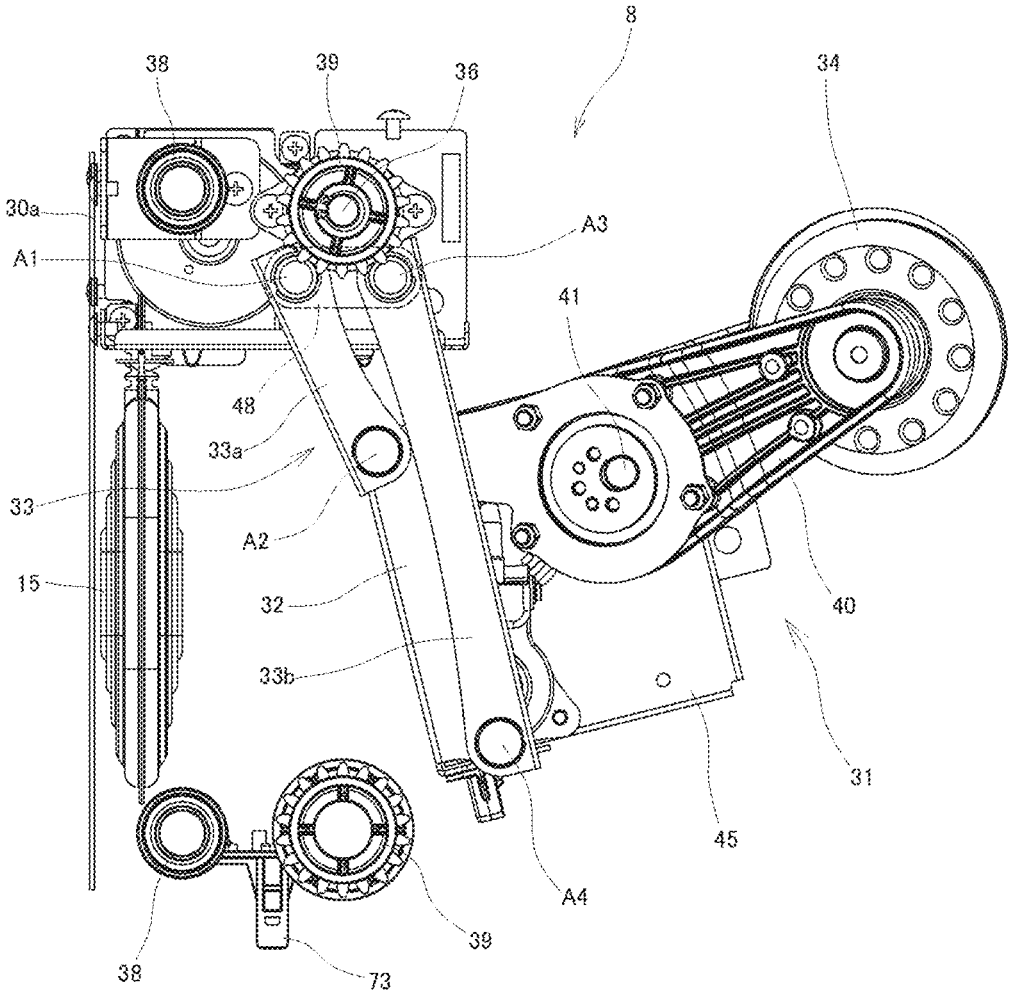
FIG. 8 is a side view of the first massage unit and illustrates a state where the first massage mechanism advances.
Figure 9A:
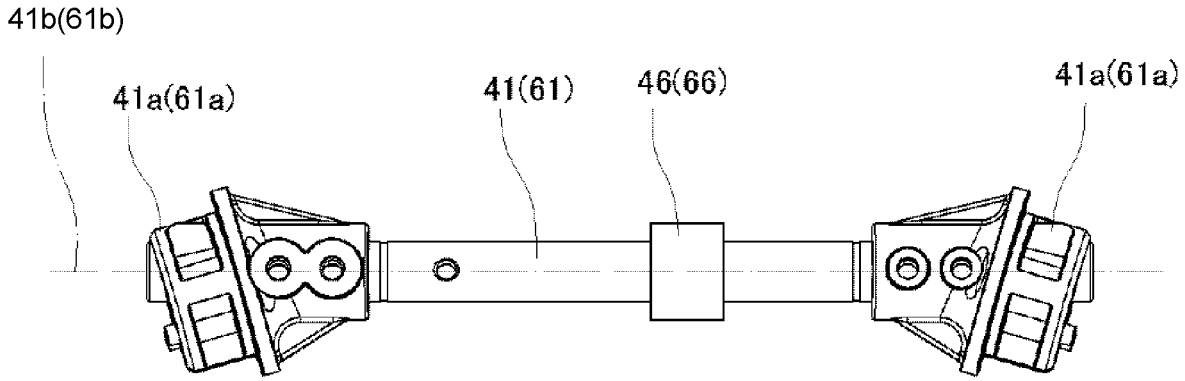
FIGS. 9A and 9B are front views respectively illustrating a kneading shaft and a patting shaft.
Figure 9B:
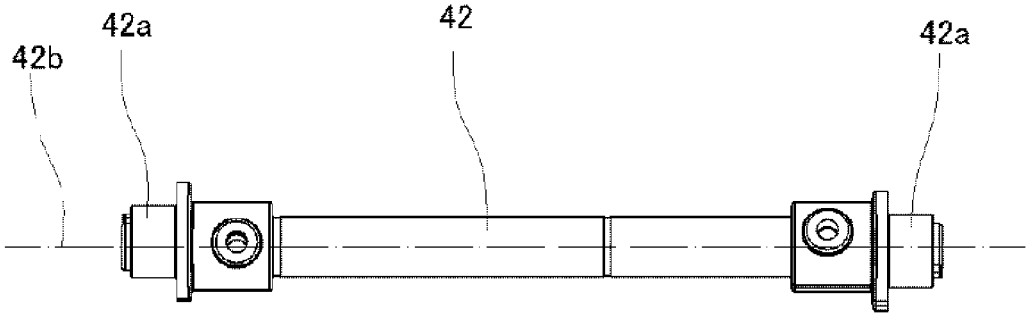
Figure 10:
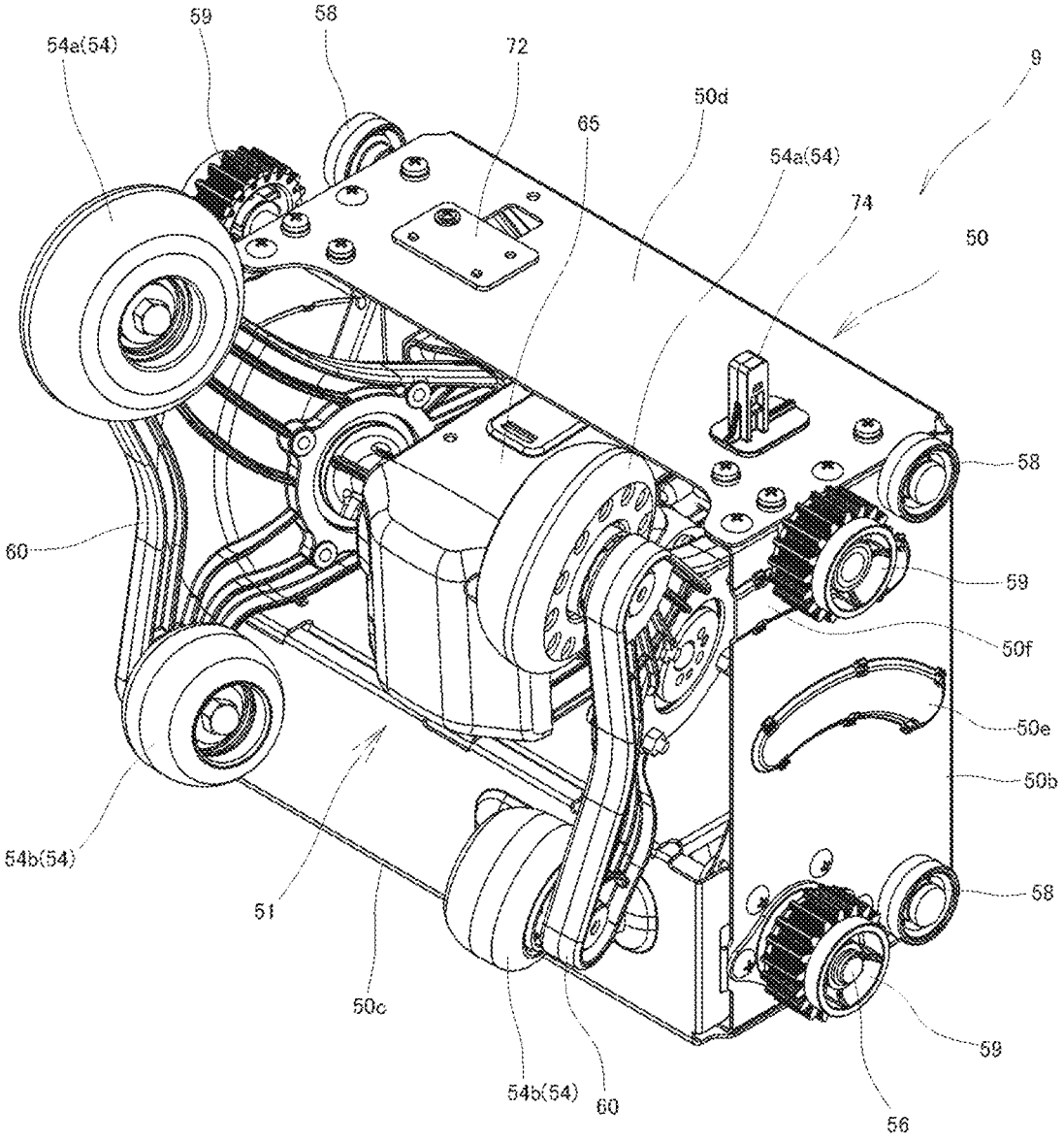
FIG. 10 is a perspective view of a second massage unit.
Figure 11:
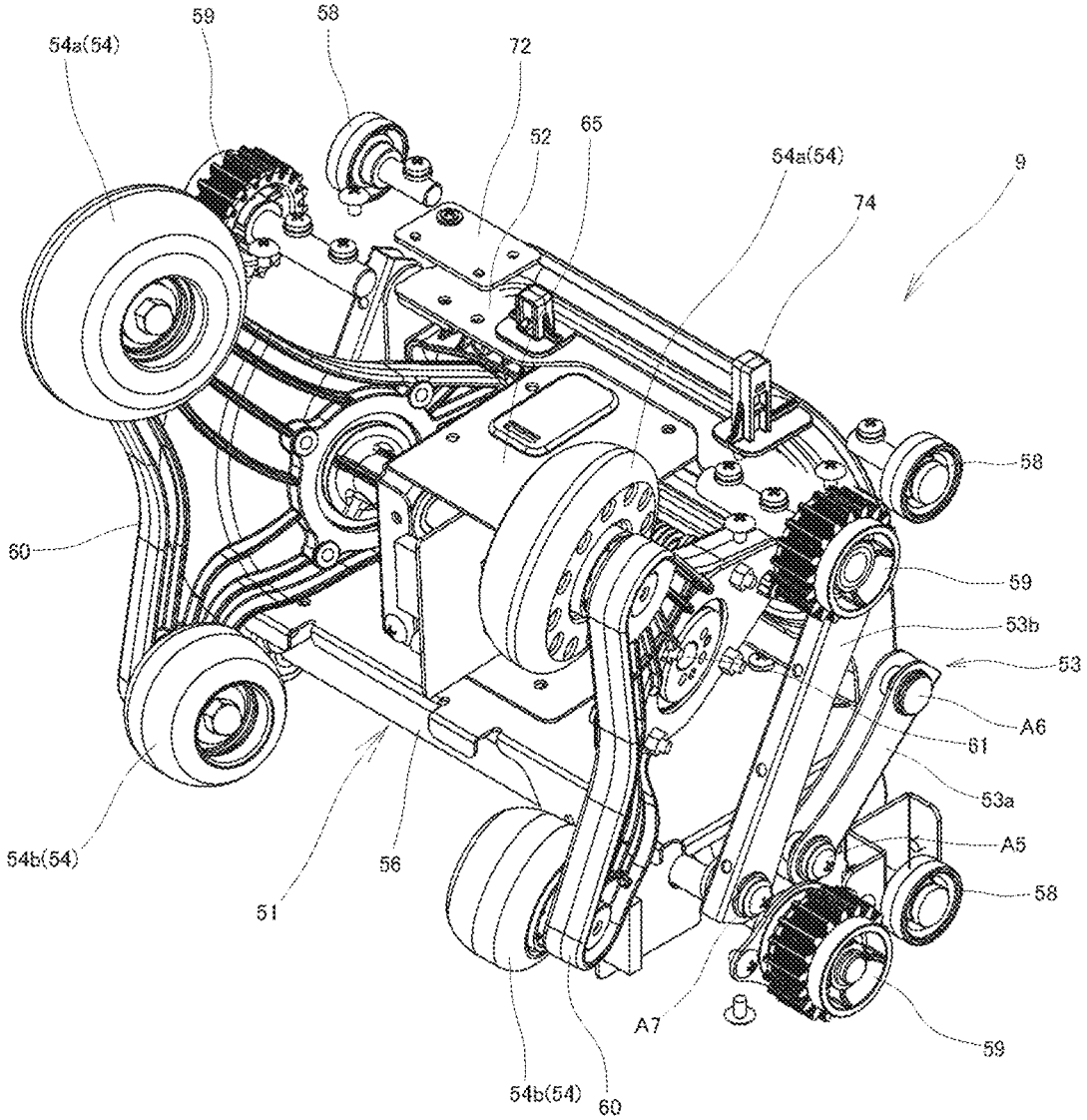
FIG. 11 is a perspective view of the second massage unit in which a part of members is omitted.
Figure 12:
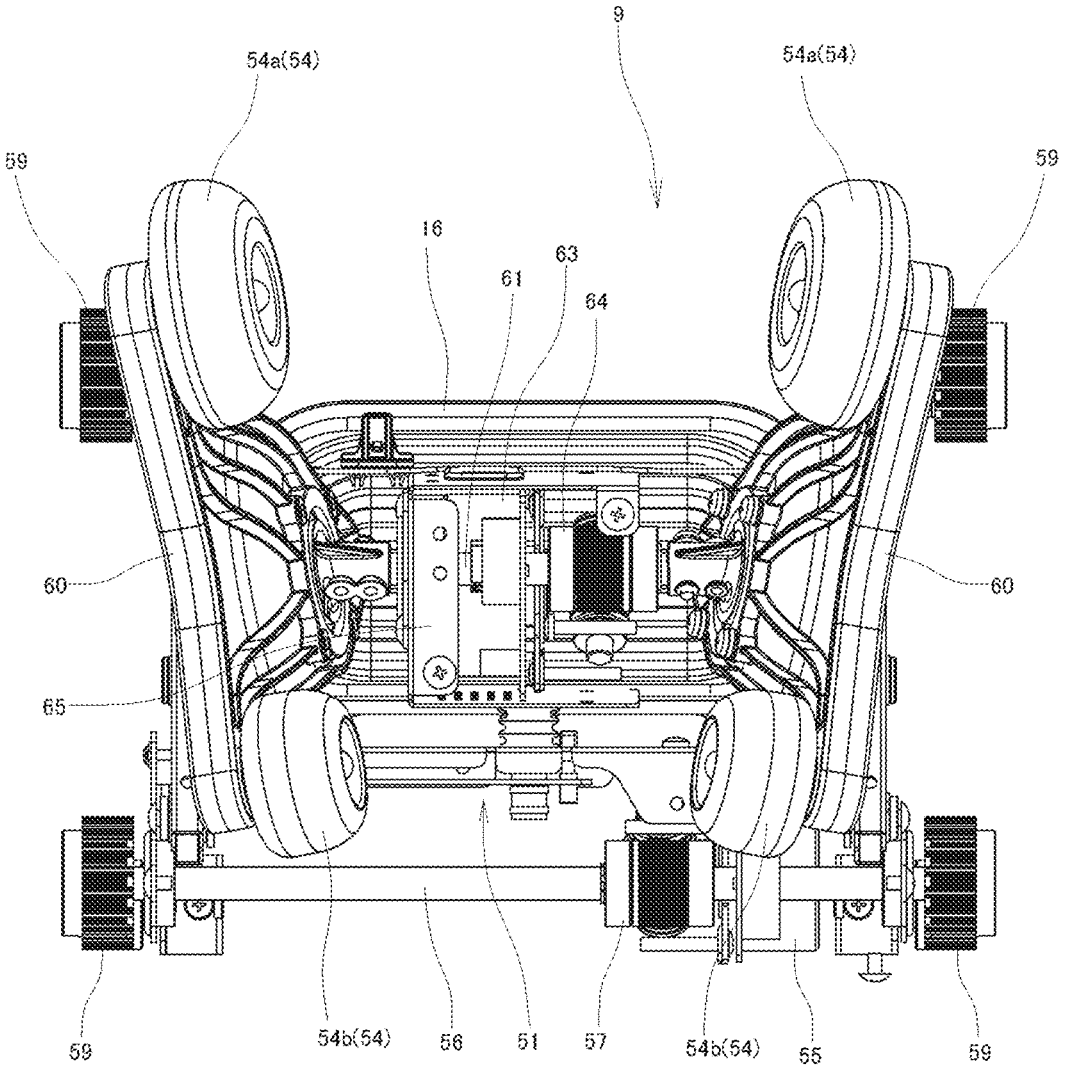
FIG. 12 is a front view of the second massage unit.
Figure 13:
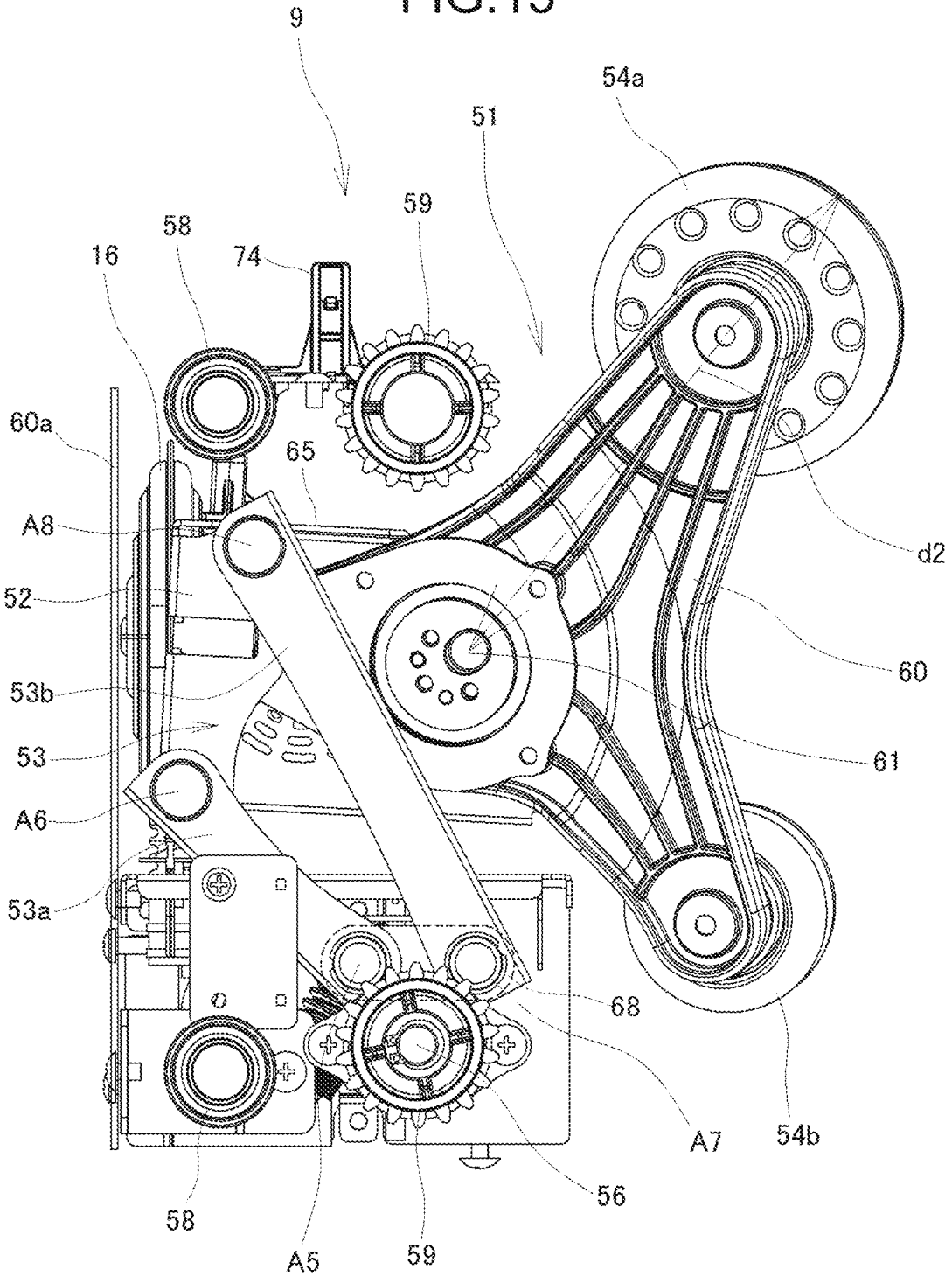
FIG. 13 is a side surface of the second massage unit and illustrates a state where a second massage mechanism retreats.
Figure 14:
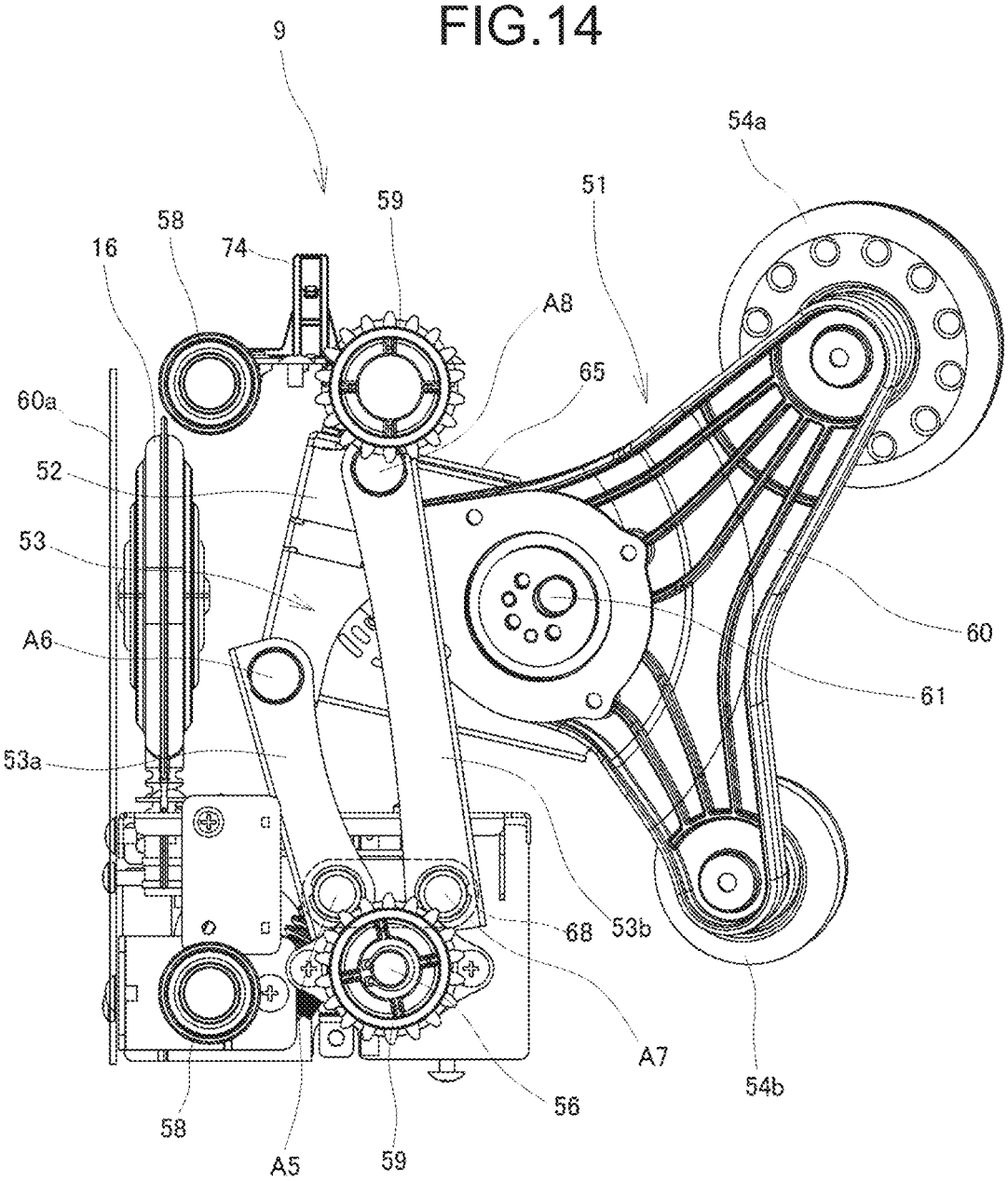
FIG. 14 is the side surface of the second massage unit and illustrates a state where the second massage mechanism advances.
Figure 15:
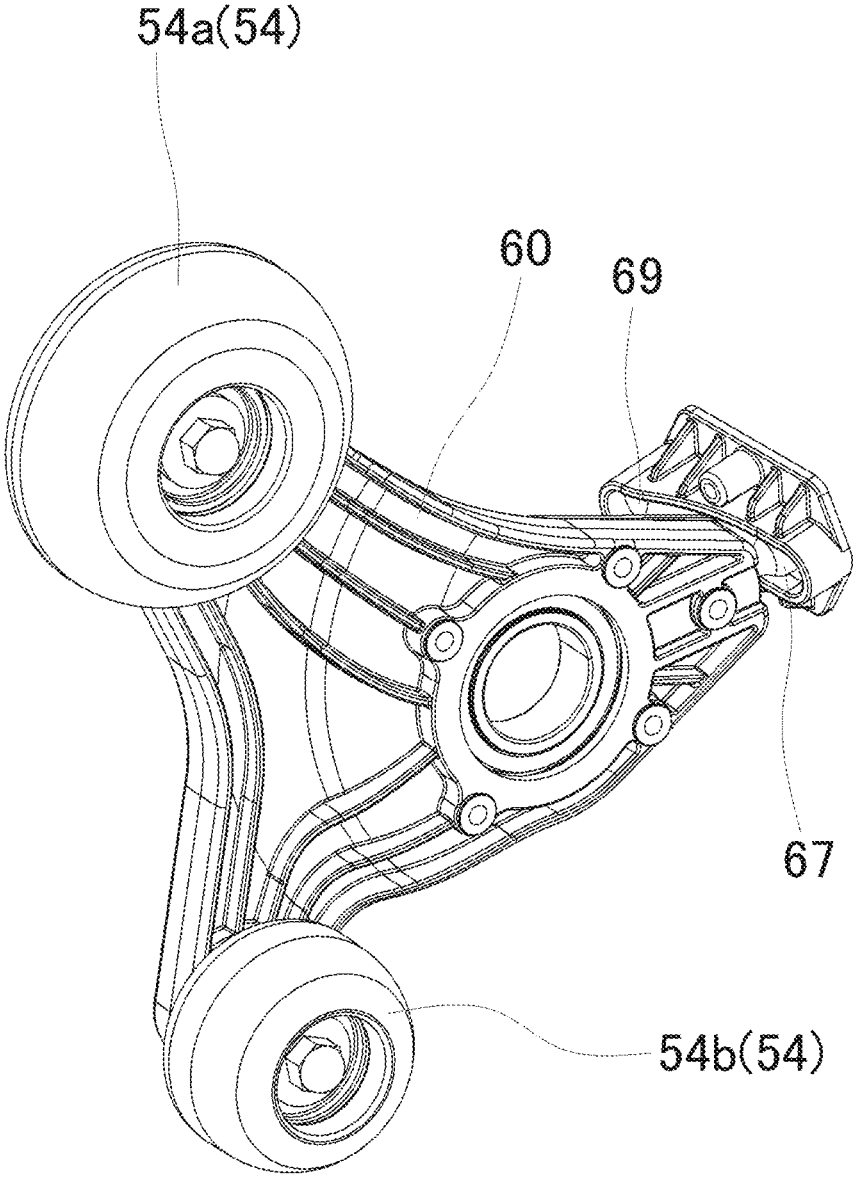
FIG. 15 is a perspective view of an arm of the second massage unit.

Hereinafter, the configurations of the massage units 8 and 9 will be described. FIG. 4 is a perspective view of a first massage unit 8. FIG. 5 is a perspective view of the first massage unit 8 in which a part of members is omitted. FIG. 6 is a front view of the first massage unit 8. FIG. 7 is a side view of the first massage unit 8 and illustrates a state where a first massage mechanism 31 retreats. FIG. 8 is a side view of the first massage unit 8 and illustrates a state where the first massage mechanism 31 advances. FIG. 9A illustrates a front view of a kneading shaft 41, and FIG. 9B illustrates a front view of a patting shaft 42. FIG. 10 is a perspective view of a second massage unit 9. FIG. 11 is a perspective view of the second massage unit 9 in which a part of members is omitted. FIG. 12 is a front view of the second massage unit 9. FIG. 13 is a side surface of the second massage unit 9 and illustrates a state where a second massage mechanism 51 retreats. FIG. 14 is the side surface of the second massage unit 9 illustrates a state where the second massage mechanism 51 advances. FIG. 15 is a perspective view of an arm 60 of the second massage unit 9.

As illustrated in FIGS. 3 to 15, the plurality of massage units 8 and 9 are provided in the height direction. In the present embodiment, the first massage unit 8 disposed on a relatively upper side and the second massage unit 9 disposed on a relatively lower side are provided in the backrest portion 3. Mainly, the massage units 8 and 9 are configured to respectively include main body frames 30 and 50 which are supported by the guide mechanisms 3*b* so as to be able to be lifted and lowered, massage mechanisms 31 and 51 which have treatment members 34 and 54, support frames 32 and 52 which support the massage mechanisms 31 and 51, advancing/retreating drive portions 15 and 16 which cause the massage mechanisms 31 and 51 to advance and retreat with respect to a treatment target portion, and links 33 and 53 which interlock the main body frames 30 and 50 and the support frames 32 and 52 with each other and oscillate in the forward/backward direction.

Hereinafter, the configuration of the first massage unit 8 on the upper side will be described in detail.

As illustrated in FIGS. 4 to 8, the main body frame 30 includes a back wall 30*a*, side walls 30*b* which are erected from both the right and left sides of the back wall 30*a*, a bottom wall 30*c* which is erected from the lower portion of the back wall 30*a*, and a top wall 30*d* which is erected from the upper portion of the back wall 30*a*, thereby configuring a box shape having the open front. In addition, in an upper part, the main body frame 30 internally accommodates a lifting/lowering mechanism configured to include a lifting/lowering motor 35 for lifting and lowering the first massage unit 8, a lifting/lowering shaft 36 which extends in the lateral direction, a speed reducer 37 which reduces the speed of rotations of the lifting/lowering motor 35 and transmits the rotations to the lifting/lowering shaft 36. The lifting/lowering shaft 36 is rotatably supported by both the side walls 30*b*. In each of the side walls 30*b*, a guide roller 38 and a pinion 39 which is attached to the lifting/lowering shaft 36 are provided in the upper portion, and a guide roller 38 and a pinion 39 are provided in the lower portion. The pinion 39 and the guide roller 38 sandwich the guide mechanism 3*b*. When the lifting/lowering motor 35 is driven, the first massage unit 8 can be lifted and lowered along the height direction. Since the lifting/lowering mechanism is disposed in the upper portion of the first massage unit 8, the treatment members 34 can approach the treatment members 54 (upper treatment members 54*a*) of the second massage mechanism 51.

The first massage mechanism 31 has arms 40 which make a pair on the right and the left and respectively support the treatment members 34 at the tips, and a drive mechanism which drives the arms 40 so as to cause the arms 40 to perform a massage. The drive mechanism has the kneading shaft 41 which supports the arms 40 and causes the pair of treatment members 34 to perform a massaging operation by approaching each other and being separated from each other in the lateral direction, the patting shaft 42 which causes the pair of treatment members 34 to perform a patting operation by alternately advancing and retreating, a massage motor 43 as a massage drive portion which drives the kneading shaft 41 and the patting shaft 42, and a speed reducer 44 which reduces the speed of rotations of the massage motor 43 and transmits the rotations to the kneading shaft 41 and the patting shaft 42. The drive mechanism is supported by a box-type frame 45. In the present embodiment, the first massage unit 8 has one treatment member 34 in the vertical direction.

As illustrated in FIG. 9A, the kneading shaft 41 extends in the lateral direction, and inclined shafts 41*a* which are inclined with respect to a shaft center 41*b* are provided at both the right and left sides of the kneading shaft 41. The arms 40 are turnably attached to the inclined shafts 41*a* via bearings. The inclined shafts 41*a* on the right and the left are not parallel to each other and are inclined so as to have a substantially inverted V-shape in a front view. In addition, the kneading shaft 41 is provided with a width sensor 46 which detects a gap between the pair of treatment members 34. As illustrated in FIG. 9B, the patting shaft 42 extends in the lateral direction, and eccentric shafts 42*a* which are eccentric with respect to a shaft center 42*b* are provided at both the right and left sides of the patting shaft 42. In addition, as illustrated in FIG. 5, interlocking members 47 which interlock the patting shaft 42 with the back portions of the arms 40 are respectively and turnably provided in the eccentric shafts 42*a* via bearings. The eccentric shafts 42*a* on the right and the left have phases around the shaft center 42*b* of the patting shaft 42 different from each other.

Figure 16:
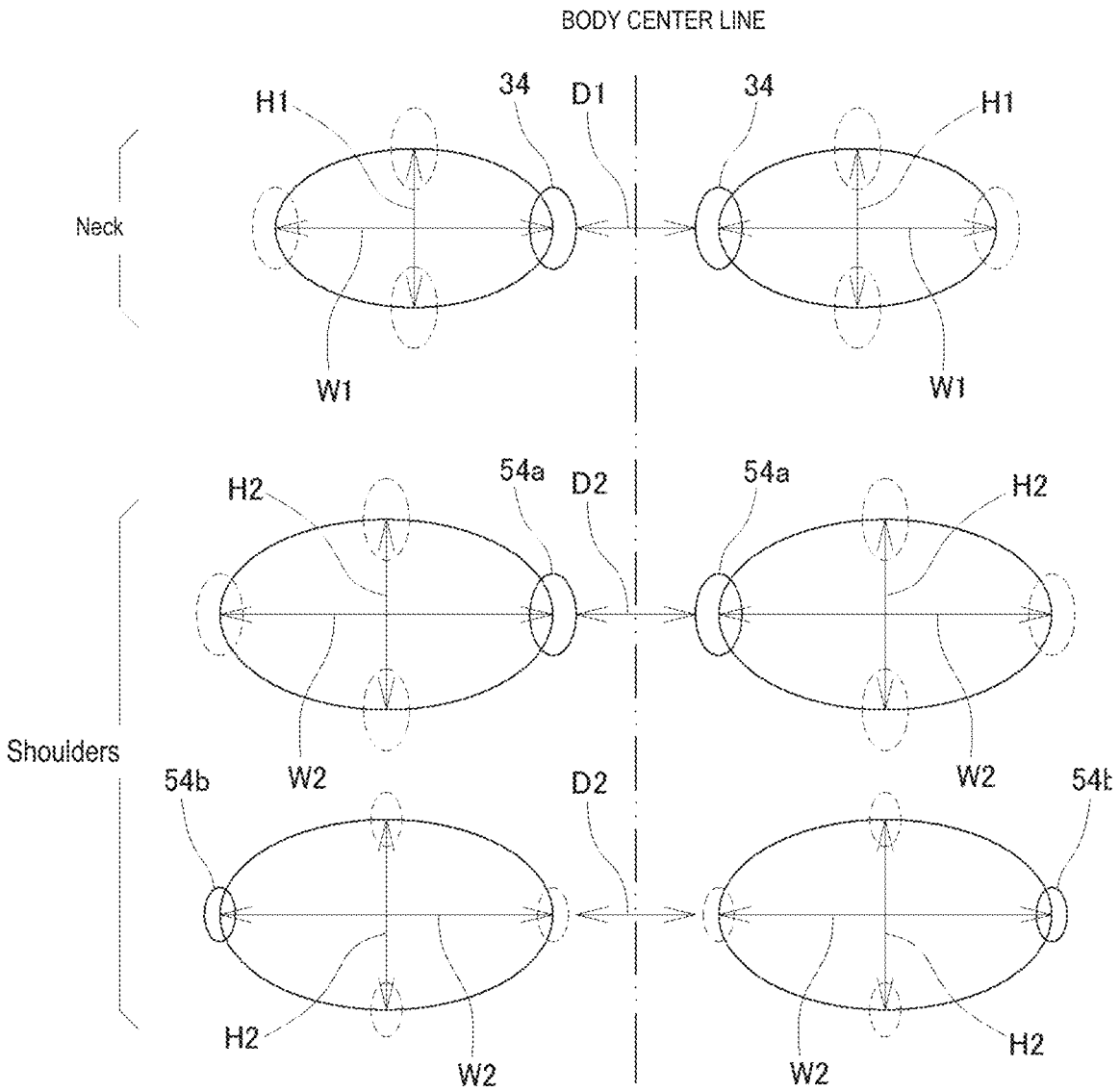
FIG. 16 is a view describing a massaging operation.

When the kneading shaft 41 rotates, the arms 40 three-dimensionally turn while rotations around the kneading shaft 41 are restricted by the interlocking members 47. That is, as illustrated in FIG. 16, when the kneading shaft 41 is continuously rotated in one direction, each of the treatment members 34 operates while drawing a loop-like trajectory having at least lateral and vertical directional components, the pair of treatment members 34 on the right and the left operates in the lateral direction so as to approach each other and be separated from each other. In this manner, the massaging operation is performed. Meanwhile, when the patting shaft 42 rotates, due to vertical motions of the interlocking members 47, the pair of arms 40 alternately advances and retreats while having the kneading shaft 41 as a fulcrum. In this manner, the patting operation is performed. In the present embodiment, a clutch is provided in the patting shaft 42 and one massage motor 43 rotates normally and inversely such that the massaging operation and the massaging and patting operation are switchable. However, the massaging operation and the patting operation may be independently performed by individually providing the massage motors 43.

The support frame 32 has a plate surface in the forward/backward direction, and the frame 45 is fixed on the front surface side so as to support the first massage mechanism 31. Between the main body frame 30 and the support frame 32, there is provided the advancing/retreating air cell 15 as an advancing/retreating drive portion which expands and contracts due to air supplied from and discharged to the air unit 20 and causes the first massage mechanism 31 to advance and retreat with respect to the treatment target portion. In addition, on the sides of the support frame 32, there are provided links 33 which interlock the main body frame 30 and the support frame 32 with each other and oscillate in the forward/backward direction. The links 33 are disposed on the sides of the support frame 32 because the thickness of the massage unit 8 in the forward/backward direction can be restrained compared to a case where the links 33 are disposed behind the support frame 32. The links 33 are provided so as to be parallel to each other in the forward/backward direction. Each of the links 33 includes a first link portion 33*a* disposed on a relatively back side and a second link portion 33*b* disposed on a relatively front side. That is, each of the links 33 configures a four-joint link mechanism.

As illustrated in FIGS. 7 and 8, the lengths of the first link portion 33*a* and the second link portion 33*b* are different from each other. Specifically, the length of the first link portion 33*a* is set so as to be shorter than the length of the second link portion 33*b*. The upper portion of the first link portion 33*a* is pivotally supported by the side wall 30*b* of the main body frame 30 via an oscillation axis A1 in the vicinity of the lifting/lowering shaft 36, and the lower portion of the first link portion 33*a* is pivotally supported by the upper portion of the support frame 32 via a pivot axis A2. The upper portion of the second link portion 33*b* is pivotally supported by the side wall 30*b* of the main body frame 30 via an oscillation axis A3 in the vicinity of the lifting/lowering shaft 36, and the lower portion of the second link portion 33*b* is pivotally supported by the lower portion of the support frame 32 via a pivot axis A4. The oscillation axis A1 of the first link portion 33*a* is positioned slightly behind the oscillation axis A3 of the second link portion 33*b*. The operations of the first link portion 33*a* and the second link portion 33*b* are respectively guided due to the pivot axes A2 and A4 fitted in downward-convex arc-like guide portions 30*e* and 30*f* (refer to FIG. 4) provided in the side wall 30*b*. In addition, as illustrated in FIGS. 7 and 8, there is provided a reinforcement portion 48 which interlocks the first link portion 33*a* and the second link portion 33*b* with each other through an interlocking portion with respect to the main body frame 30, thereby reinforcing the first link portion 33*a* and the second link portion 33*b*. In this manner, the vicinities of the oscillation axes A1 and A3 of the link 33 bearing a load can be reinforced by the lifting/lowering shaft 36 and the reinforcement portion 48.

In the link 33, in a state where the first massage mechanism 31 retreats to the backmost side, the interlocking portion with respect to the main body frame 30 is positioned in front of the interlocking portion with respect to the support frame 32. That is, in the first link portion 33*a*, the oscillation axis A1 is positioned in front of the pivot axis A2, and in the second link portion 33*b*, the oscillation axis A3 is positioned in front of the pivot axis A4. Therefore, when the advancing/retreating air cell 15 expands, the links 33 oscillate while drawing downward-convex arc-like trajectories. Accordingly, the first massage mechanism 31 can advance and retreat through a trajectory nearly parallel to a direction facing the treatment target portion. In addition, since the four joint link mechanism is employed, when the advancing/retreating air cell 15 expands from a state where the first massage mechanism 31 retreats to the backmost side, the first link portion 33*a* oscillates forward while having the oscillation axis A1 as the center. However, since the support frame 32 is pivotally supported by the second link portion 33*b* longer than the first link portion 33*a* in front and below the pivot axis A2 of the first link portion 33*a*, the first massage mechanism 31 is restrained from oscillating and can advance and retreat in a trajectory more nearly parallel to a direction facing the treatment target portion.

In addition, since the lengths of the first link portion 33*a* and the second link portion 33*b* are different from each other, even if the first link portion 33*a* and the second link portion 33*b* are provided so as to approach each other in the forward/backward direction, a sufficient advancing amount of the first massage mechanism 31 can be ensured, and the thickness of the first massage unit 8 in the forward/backward direction can be restrained. In addition, the first link portion 33*a* disposed on the back side is relatively short in length. Accordingly, while having a state where the first massage mechanism 31 retreats to the backmost side as a starting point, it is possible to acquire a sufficient moving amount of a forward/backward directional component from immediately after advancing starts. In addition, in a process in which the first massage mechanism 31 advances, the first link portion 33*a* comes into contact with the second link portion 33*b* from behind. Thus, advancing of the first massage mechanism 31 is restricted at a predetermined forward/backward position. That is, since the second link portion 33*b* functions as a stopper, there is no need to separately provide the stopper. Thus, the number of components can be reduced.

Hereinafter, the configuration of the second massage unit 9 on the lower side will be described in detail.

As illustrated in FIGS. 9A and 9B to 15, the main body frame 50 includes a back wall 50*a*, side walls 50*b* which are erected from both the right and left sides of the back wall 50*a*, a bottom wall 50*c* which is erected from the lower portion of the back wall 50*a*, and a top wall 50*d* which is erected from the upper portion of the back wall 50*a*, thereby configuring a box shape having the open front. In addition, in a lower part, the main body frame 50 internally accommodates a lifting/lowering mechanism configured to include a lifting/lowering motor 55 for lifting and lowering the second massage unit 9, a lifting/lowering shaft 56 which extends in the lateral direction, a speed reducer 57 which reduces the speed of rotations of the lifting/lowering motor 55 and transmits the rotations to the lifting/lowering shaft 56. The lifting/lowering shaft 56 is rotatably supported by both the side walls 50*b*. In each of the side walls 50*b*, a guide roller 58 and a pinion 59 which is attached to the lifting/lowering shaft 56 are provided in the upper portion, and a guide roller 58 and a pinion 59 are provided in the lower portion. The pinion 59 and the guide roller 58 sandwich the guide mechanism 3*b*. When the lifting/lowering motor 55 is driven, the second massage unit 9 can be lifted and lowered along the height direction. Since the lifting/lowering mechanism is disposed in the lower portion of the second massage unit 9, the treatment members 54 (upper treatment members 54*a*) can approach the treatment members 34 of the first massage mechanism 31.

The second massage mechanism 51 has arms 60 which make a pair on the right and the left and respectively support the treatment members 54 at the tips, and a drive mechanism which drives the arms 60 so as to cause the arms 60 to perform a massage. The drive mechanism has a kneading shaft 61 which supports the arms 60 and causes the pair of treatment members 54 to perform a massaging operation by approaching each other and being separated from each other in the lateral direction, a massage motor 63 as a massage drive portion which drives the kneading shaft 61, and a speed reducer 64 which reduces the speed of rotations of the massage motor 63 and transmits the rotations to the kneading shaft 61. The drive mechanism is supported by a box-type frame 65. Each of the arms 60 is formed so as to have a chevron shape in a side view. An upper treatment member 54*a* having a relatively large diameter is provided at the upper end of the arm 60, and a lower treatment member 54*b* having a relatively small diameter is provided at the lower end of the arm 60. That is, being different from the first massage unit 8, there are provided two treatment members 54 in the vertical direction.

As illustrated in FIG. 9A, the kneading shaft 61 has the same configuration as the kneading shaft 41 of the first massage mechanism 31. The kneading shaft 61 extends in the lateral direction, and inclined shaft 61*a* which are inclined with respect to a shaft center 61*b* are provided at both the right and left sides of the kneading shaft 61. The arms 60 are turnably attached to the inclined shafts 61*a* via bearings. The inclined shafts 61*a* on the right and the left are not parallel to each other and are inclined so as to have a substantially inverted V-shape in a front view. As illustrated in FIG. 15, behind the arm 60, there is provided an interlocking member 67 having a ball joint at the back end so as to interlock the arm 60 and the support frame 52 with each other. On the front surface side of the support frame 52, a groove 69 is provided along the lateral direction, and the ball joint of the interlocking member 67 is fitted in the groove 69. In addition, the kneading shaft 61 is provided with a width sensor 66 which detects a gap between the pair of treatment members 54.

When the kneading shaft 61 rotates, the arms 60 three-dimensionally turn while rotations around the kneading shaft 61 are restricted by the interlocking members 67. That is, as illustrated in FIG. 16, when the kneading shaft 61 is continuously rotated in one direction, each of the treatment members 54 operates while drawing a loop-like trajectory having at least lateral and vertical directional components. In addition, the pair of treatment members 54 on the right and the left operate in the lateral direction. When the upper treatment members 54*a* approach each other, the lower treatment members 54*b* are separated from each other, and when the upper treatment members 54*a* are separated from each other, the lower treatment members 54*b* approach each other. In this manner, the massaging operation is performed. In the present embodiment, the second massage mechanism 51 is configured to perform only the massaging operation. However, similar to the first massage mechanism 31, the second massage mechanism 51 may be configured to be able to perform the patting operation as well.

The support frame 52 has a plate surface in the forward/backward direction, and the frame 65 is fixed on the front surface side so as to support the second massage mechanism 51. Between the main body frame 50 and the support frame 52, there is provided the advancing/retreating air cell 16 as an advancing/retreating drive portion which expands and contracts due to air supplied from and discharged to the air unit 20 and causes the second massage mechanism 51 to advance and retreat with respect to the treatment target portion. In addition, on the sides of the support frame 52, there are provided links 53 which interlock the main body frame 50 and the support frame 52 with each other and oscillate in the forward/backward direction. The links 53 are provided so as to be parallel to each other in the forward/backward direction. Each of the links 53 includes a first link portion 53*a* disposed on a relatively back side and a second link portion 53*b* disposed on a relatively front side. That is, each of the links configures a four-joint link mechanism.

The lengths of the first link portion 53*a* and the second link portion 53*b* are different from each other. Specifically, the length of the first link portion 53*a* is set so as to be shorter than the length of the second link portion 53*b*. The lower portion of the first link portion 53*a* is pivotally supported by the side wall 50*b* of the main body frame 50 via an oscillation axis A5 in the vicinity of the lifting/lowering shaft 56, and the upper portion of the first link portion 53*a* is pivotally supported by the lower portion of the support frame 52 via a pivot axis A6. The lower portion of the second link portion 53*b* is pivotally supported by the side wall 50*b* of the main body frame 50 via an oscillation axis A7 in the vicinity of the lifting/lowering shaft 56, and the upper portion of the second link portion 53*b* is pivotally supported by the upper portion of the support frame 52 via a pivot axis A8. The oscillation axis A5 of the first link portion 53*a* is positioned slightly behind the oscillation axis A7 of the second link portion 53*b*. The operations of the first link portion 53*a* and the second link portion 53*b* are respectively guided due to the pivot axes A6 and A8 fitted in upward-convex arc-like guide portions 50*e* and 50*f* (refer to FIG. 10) provided in the side wall 50*b*. In addition, as illustrated in FIGS. 13 and 14, there is provided a reinforcement portion 68 which interlocks the first link portion 53*a* and the second link portion 53*b* with each other through an interlocking portion with respect to the main body frame 50, thereby reinforcing the first link portion 53*a* and the second link portion 53*b*. In this manner, the vicinities of the oscillation axes A5 and A7 of the link 53 bearing a load can be reinforced by the lifting/lowering shaft 56 and the reinforcement portion 68.

In the link 53, in a state where the second massage mechanism 51 retreats to the backmost side, the interlocking portion with respect to the main body frame 50 is positioned in front of the interlocking portion with respect to the support frame 52. That is, in the first link portion 53*a*, the oscillation axis A5 is positioned in front of the pivot axis A6, and in the second link portion 53*b*, the oscillation axis A7 is positioned in front of the pivot axis A8. Therefore, when the advancing/retreating air cell 16 expands, the links 53 oscillate while drawing upward-convex arc-like trajectories. Accordingly, the second massage mechanism 51 can advance and retreat through a trajectory nearly parallel to a direction facing the treatment target portion. In addition, since the four joint link mechanism is employed, when the advancing/retreating air cell 16 expands from a state where the second massage mechanism 51 retreats to the backmost side, the first link portion 53*a* oscillates forward while having the oscillation axis A5 as the center. However, since the support frame 52 is pivotally supported by the second link portion 53*b* longer than the first link portion 53*a* in front and above the pivot axis A6 of the first link portion 53*a*, the second massage mechanism 51 is restrained from oscillating and can advance and retreat in a trajectory more nearly parallel to a direction facing the treatment target portion.

In addition, since the lengths of the first link portion 53*a* and the second link portion 53*b* are different from each other, even if the first link portion 53*a* and the second link portion 53*b* are provided so as to approach each other in the forward/backward direction, a sufficient advancing amount of the second massage mechanism 51 can be ensured, and the thickness of the second massage unit 9 in the forward/backward direction can be restrained. In addition, the first link portion 53*a* disposed on the back side is relatively short in length. Accordingly, while having a state where the second massage mechanism 51 retreats to the backmost side as a starting point, it is possible to acquire a sufficient moving amount of a forward/backward directional component from immediately after advancing starts. In addition, in a process in which the second massage mechanism 51 advances, the first link portion 53*a* comes into contact with the second link portion 53*b* from behind. Thus, advancing of the second massage mechanism 51 is restricted at a predetermined forward/backward position. That is, since the second link portion 53*b* functions as the stopper, there is no need to separately provide the stopper. Thus, the number of components can be reduced.

Configuration of Sensor

As illustrated in FIG. 2, the massage machine 1 includes a sensor 70 which detects relative positions of the first massage unit 8 and the second massage unit 9. Hereinafter, the sensor 70 will be described in detail.

As illustrated in FIG. 4, in the bottom wall 30*c* which is the lower portion of the first massage unit 8, there is provided a magnet holder 73 to which a magnet is attached on one side in the lateral direction, and there are provided a first sensor portion 71 which detects approaching of the magnet, and the sub-control unit 25 (refer to FIG. 2) which is electrically connected to the first sensor portion 71, on the other side in the lateral direction. Meanwhile, as illustrated in FIG. 10, in the top wall 50*d* which is the upper portion of the second massage unit 9, there are provided a second sensor portion 72 which detects approaching of a magnet, and the sub-control unit 26 (refer to FIG. 2) which is electrically connected to the second sensor portion 72, on one side in the lateral direction. There is provided a magnet holder 74 to which the magnet is attached on the other side in the lateral direction. The sub-control units 25 and 26 are respectively and electrically connected to the lifting/lowering motors 35 and 55 such that lifting/lowering of each of the massage units 8 and 9 can be controlled. In addition, the sub-control units 25 and 26 are electrically connected to the main control unit 24 as well.

The position of the first sensor portion 71 substantially coincides with the position of the magnet holder 74 provided in the second massage unit 9 orthogonal to the vertical direction. The first sensor portion 71 can detect approaching of the second massage unit 9 with respect to the first massage unit 8. Meanwhile, the second sensor portion 72 substantially coincides with the position of the magnet holder 73 provided in the first massage unit 8 orthogonal to the vertical direction. The second sensor portion 72 can detect approaching of the first massage unit 8 with respect to the second massage unit 9. That is, the sensor 70 is a noncontact-type sensor configured to include the first sensor portion 71 and the second sensor portion 72. As described above, the massage units 8 and 9 respectively detect approaching of the massage units 9 and 8 on the other side. Since the sub-control units 25 and 26 controls the lifting/lowering motors 35 and 55, the accuracy of preventing collision is enhanced.

It is preferable that the sensor 70 can detect a gap between both the massage units 8 and 9 through a plurality of stages, as the relative positions of the first massage unit 8 and the second massage unit 9. For example, the sensor 70 may detect states of two stages such as "approach state" in which the gap between both the massage units 8 and 9 becomes close to a predetermined distance, and "pre-approach state" in which the massage units 8 and 9 are more slightly separated from each other than the approach state. Therefore, a detection range for the relative positions of the first massage unit 8 and the second massage unit 9 is widened. In addition, both the massage units 8 and 9 can be integrally lifted and lowered in a state where the relative positions are maintained as predetermined relative positions (for example, the approach state or the pre-approach state).

As illustrated in FIG. 2, the backrest portion 3 is provided with an upper limit sensor 75 which detects an upper limit position for a lifting/lowering range of the first massage unit 8, and a lower limit sensor 76 which detects a lower limit position for a lifting/lowering range of the second massage unit 9. The first and second massage units 8 and 9 are prevented from being separated from the backrest portion 3. In addition, the first and second massage units 8 and 9 respectively include lifting/lowering sensors 77 and 78 which detect vertical positions by detecting rotational frequencies of the lifting/lowering shafts 36 and 56. When the lifting/lowering sensor 77 detects how many rotations the lifting/lowering shaft 36 makes from the upper limit position, the vertical position of first massage unit 8 is detected. When the lifting/lowering sensor 78 detects how many rotations the lifting/lowering shaft 56 makes from the lower limit position, the vertical position of the second massage unit 9 is detected.

Operation Control for Avoiding Collision

When both the massage units 8 and 9 move in a direction of approaching each other, in a case where it is detected that both the massage units 8 and 9 are at the predetermined relative positions (for example, the approach state or the pre-approach state), the sub-control unit 25 performs controlling so as to stop or inverse driving of the lifting/lowering motor 35, and the sub-control unit 26 performs controlling so as to stop or inverse driving of the lifting/lowering motor 55. In addition, each of the sub-control units 25 and 26 forwards the main control unit 24 the performed controlling. In this manner, collision of both the massage units 8 and 9 is avoided.

In a state where one massage unit (for example, the first massage unit 8) stops being lifted and lowered, when the other massage unit (for example, the second massage unit 9) moves in a direction of approaching the one massage unit, in a case where it is detected that both the massage units 8 and 9 are at the predetermined relative positions (for example, the approach state or the pre-approach state), the sub-control unit 26 performs controlling so as to stop or inverse driving of the lifting/lowering motor 55. In addition, each of the sub-control units 25 and 26 forwards the main control unit 24 the performed controlling. In instead of or addition to the controlling, the sub-control unit 25 may drive the lifting/lowering motor 35 and may perform controlling such that the first massage unit 8 moves in a direction of being separated from the second massage unit 9. In this manner, collision of both the massage units 8 and 9 is avoided.

Detection of Shoulder Position

The massage machine 1 is configured such that a shoulder position can be detected as a particular site of the user. Hereinafter, the configuration of detecting the shoulder position will be described.

The first massage unit 8 is provided with a particular-site detecting sensor (not illustrated) which detects that the first massage mechanism 31 advances with respect to the main body frame 30 as much as a predetermined amount. The shoulder position is detected through a process in which the first massage unit 8 is lifted along the height direction from the position of the waist or the back in a state where air is supplied or in a state where air is continuously supplied to the advancing/retreating air cell 15 as much as a predetermined amount. In this detection process, it is preferable that the air cells 10 provided in the backrest portion 3 is caused to expand and the upper half of the body of the user is held in the backrest portion 3.

In a lifting process of the first massage unit 8, when the treatment members 34 reach the shoulder position, a load from the user is released and the advancing amount of the first massage mechanism 31 reaches a predetermined amount. The shoulder position of the user is detected based on the vertical position of the first massage unit 8 when the particular-site detecting sensor detects a predetermined amount of advancing of the first massage mechanism 31. In addition, based on the detected shoulder position, other sites such as the neck, the scapula, the back, the waist, and the hips are calculated as well. The particular site to be detected may not be the shoulder position and may be other sites such as the waist.

While the massage course is executed, the first massage unit 8 can perform a massage suited for the height of the user, based on positional information of the shoulders and/or other sites detected by the particular-site detecting sensor. In addition, while the massage course is executed, the second massage unit 9 can perform a massage suited for the height, based on positional information detected by the particular-site detecting sensor included in the first massage unit 8. The particular-site detecting sensor may also be provided in the second massage unit 9 such that the second massage unit 9 can perform a massage suited for the height of the user, based on the positional information of the shoulders and/or other sites detected by the particular-site detecting sensor. Otherwise, the second massage unit 9 may operate based on preset positional information of each site. In this case, the positional information of each site based on the average height may be stored in the control means 23.

When both the massage units 8 and 9 are lifted or lowered in the same direction, controlling is performed such that a lifting/lowering speed of the massage unit on a front side in an advancing direction is higher than a lifting/lowering speed of the massage unit on a back side in the advancing direction or controlling is performed such that the massage unit on the front side in the advancing direction starts moving prior to the massage unit on the back side in the advancing direction. Consequently, the accuracy of preventing collision is further enhanced. In addition, when the lifting/lowering speed of the massage unit on the front side in the advancing direction is relatively a little higher than the massage unit on the back side, or the massage unit on the front side in the advancing direction starts moving relatively a little prior to the massage unit on the back side, both the massage units 8 and 9 can smoothly move in the same direction in a state of approaching each other. That is, the sensor 70 frequently detects the approach state, and thus, the massage unit on the back side in the advancing direction is prevented from minutely stopping or being separated.

Massage Operation

Figure 17A:
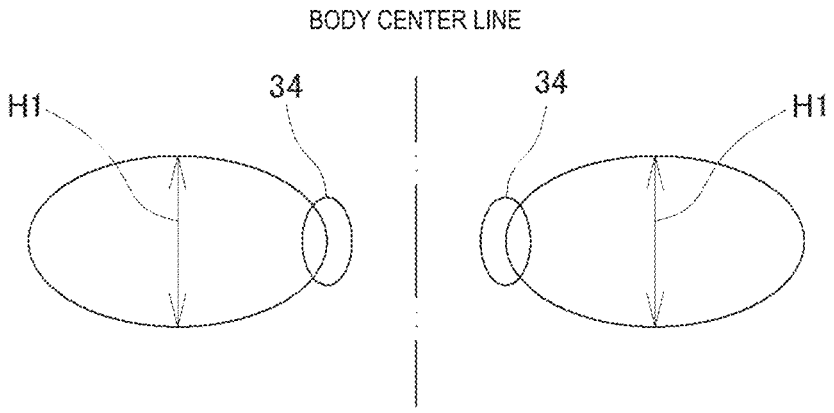
FIGS. 17A to 17C are views describing massaging operations.
Figure 17B:
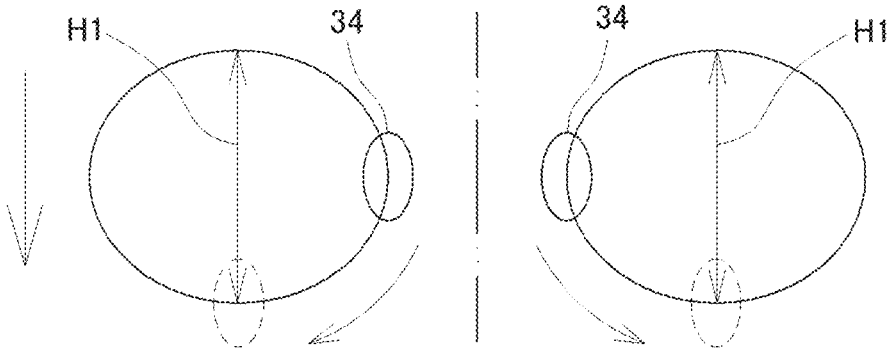
Figure 17C:
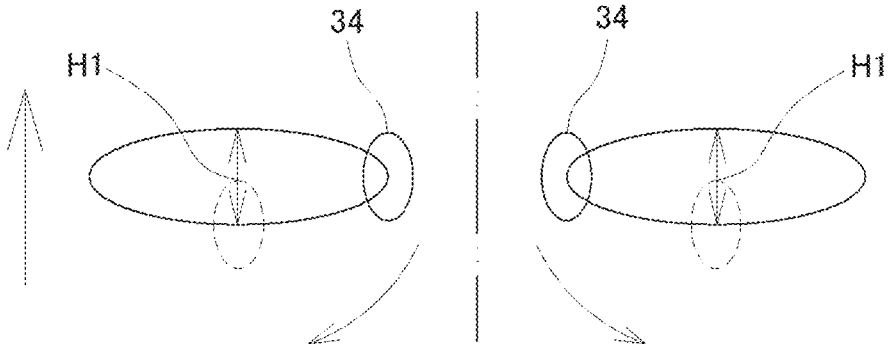
Figure 18A:
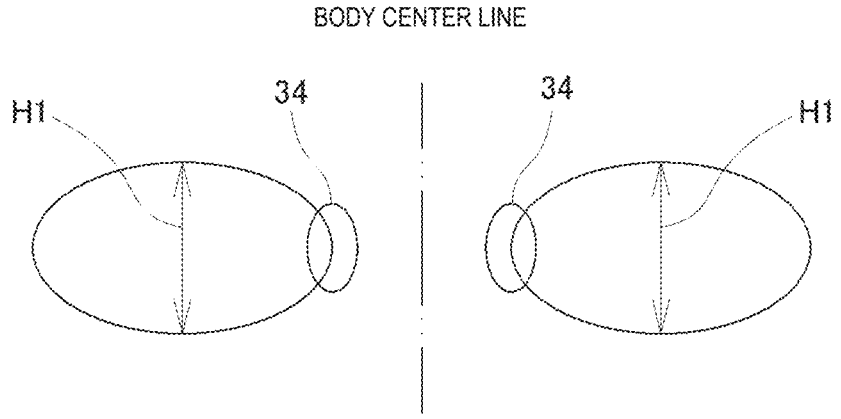
FIGS. 18A to 18C are views describing massaging operations.
Figure 18B:
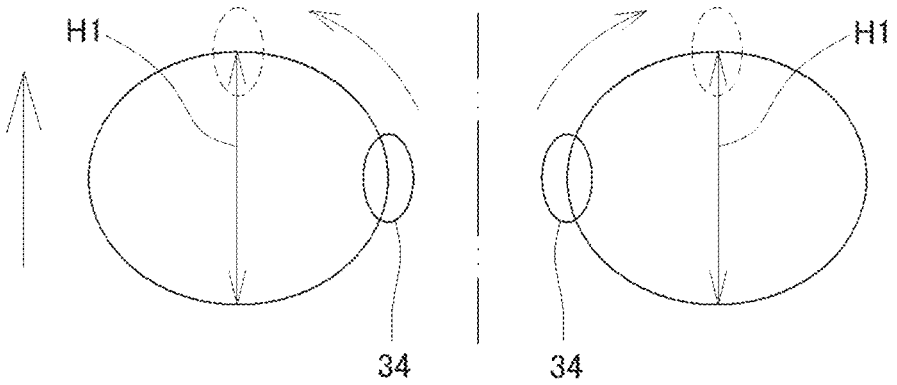
Figure 18C:
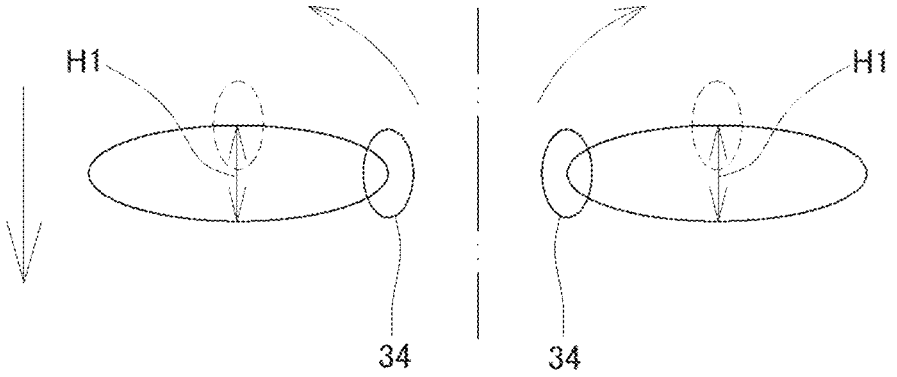
Figure 19:
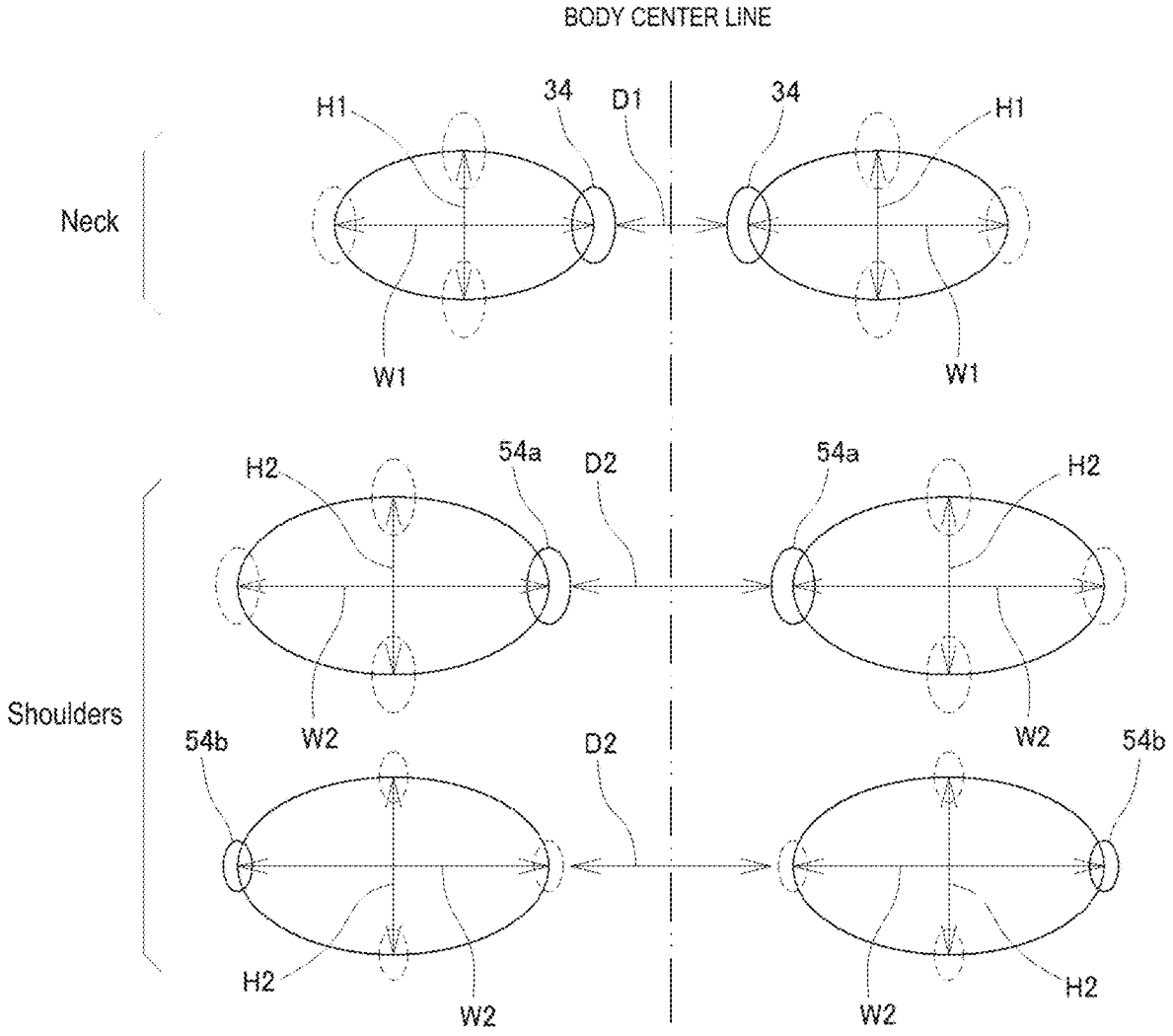
FIG. 19 is a view describing a massaging operation.

Hereinafter, the massaging operation will be described in detail. FIG. 16 is a view describing the massaging operation. FIGS. 17A to 17C are views describing the massaging operation. FIG. 17A illustrates the massaging operation in a state where the massage unit 8 stops being lifted and lowered, FIG. 17B illustrates the massaging operation while the massage unit 8 is lowered, and FIG. 17C illustrates the massaging operation while the massage unit 8 is lifted. FIGS. 18A to 18C are views describing the massaging operation. FIG. 18A illustrates the massaging operation in a state where the massage unit 8 stops being lifted and lowered, FIG. 18B illustrates the massaging operation while the massage unit 8 is lifted, and FIG. 18C illustrates the massaging operation while the massage unit 8 is lowered. FIG. 19 is a view describing the massaging operation. FIGS. 16 and 19 illustrate a state where the first massage unit 8 is disposed at a neck position and the second massage unit 9 is disposed at the shoulder position.

As illustrated in FIG. 16, in a case where the massage motors 43 and 63 are driven and the kneading shafts 41 and 61 continuously rotate in one direction, each of the treatment members 34 and 54 operates while drawing a loop-like trajectory having the lateral and vertical directional components in a front view. Meanwhile, a case where the kneading shafts 41 and 61 are inversed before making one rotation, each of the treatment members 34 and 54 operates while drawing an arc-like trajectory having the lateral and vertical directional components in a front view. Even in any of the cases, the pairs of treatment members 34 and 54 on the right and the left operate in the lateral direction so as to approach each other and be separated from each other. In this manner, the massaging operation is performed.

As illustrated in FIGS. 7 and 13, in the massage machine 1 according to the present embodiment, a distance d1 between the treatment members 34 of the first massage mechanism 31 and the kneading shaft 41 is set so as to be shorter than a distance d2 between the treatment members 54 of the second massage mechanism 51 (upper treatment member 54*a*) and the kneading shaft 61. Therefore, as illustrated in FIG. 16, an operation range of the treatment members 34 of the first massage mechanism 31 in the lateral direction in the massaging operation is different from an operation range of the treatment members 54 of the second massage mechanism 51. Specifically, an operation range W1 of the treatment members 34 is narrower than an operation range W2 of the treatment members 54. In addition, a vertical dimension of a trajectory of the treatment members 34 of the first massage mechanism 31 in the massaging operation is different from a vertical dimension of a trajectory of the treatment members 54 of the second massage mechanism 51. Specifically, a vertical dimension H1 of the trajectory of the treatment members 34 is smaller than a vertical dimension H2 of the trajectory of the treatment members 54. The vertical dimensions of the operation ranges and the trajectories can be different from each other by also causing inclination angles of the inclined shafts 41*a* and 61*a* with respect to the shaft centers 41*b* and 61*b* of the kneading shafts 41 and 61 to be different from each other. Specifically, as the inclination angles of the inclined shafts 41*a* and 61*a* with respect to the shaft centers 41*b* and 61*b* of the kneading shafts 41 and 61 increases, the vertical dimensions of the operation ranges and the trajectories can be increased.

According to such a configuration, the first massage mechanism 31 can perform a comparatively delicate massaging operation with respect to the neck of which the treatment range is narrow, and the second massage mechanism 51 can perform a dynamic massaging operation with respect to a treatment target portion below the neck (for example, the shoulders, the back, and the waist) of which the treatment range is wide. That is, it is possible to perform an effective massaging operation depending on a treatment site. In addition, since both the massage units 8 and 9 can be lifted and lowered, massaging operations different from each other can be performed with respect to the same treatment target portion by switching between the first massage unit 8 and the second massage unit 9.

In addition, when each of the massage units 8 and 9 is lifted and lowered along the height direction while being synchronized with the massaging operation, the vertical dimension of the trajectory of the massaging operation can be changed. Description will be given by exemplifying the treatment members 34. As illustrated in FIG. 17B, when the first massage unit 8 is lowered while being synchronized with a downward operation accompanying the massaging operation of the treatment members 34, the vertical dimension H1 of the trajectory of the massaging operation increases. As illustrated in FIG. 17C, when the first massage unit 8 is lifted while being synchronized with a downward operation accompanying the massaging operation of the treatment members 34, the vertical dimension H1 of the massaging operation decreases. Otherwise, as illustrated in FIG. 18B, when the first massage unit 8 is lifted while being synchronized with an upward operation accompanying the massaging operation of the treatment members 34, the vertical dimension H1 of the trajectory of the massaging operation increases. As illustrated in FIG. 18C, when the first massage unit 8 is lowered while being synchronized with an upward operation accompanying the massaging operation of the treatment member 34, the vertical dimension H1 of the massaging operation decreases.

According to such a configuration, it is possible to variously change a bodily feeling of the massaging operation. For example, the operation range in the lateral direction in the massaging operation may be changed by switching between the massage units 8 and 9 massaging the treatment target portion, and the vertical dimension of the trajectory of the massaging operation may be changed by applying lifting/lowering of the massage units 8 and 9. In FIGS. 17A to 17C and 18A to 18C, the treatment members 34 of the first massage mechanism 31 are exemplified. However, a similar massaging operation can also be performed by the treatment members 54 of the second massage mechanism 51. In addition, in a configuration in which the massaging operation is performed by a massage motor such that a pair of treatment members on the right and the left approaches each other and is separated from each other while having only the lateral directional component, the operation can be varied to an operation in which the treatment members draw arc-like or loop-like trajectories having the vertical directional component, by applying lifting/lowering of the massage units.

As another embodiment, as illustrated in FIG. 19, the first massage mechanism 31 and the second massage mechanism 51 may be set such that separation distances between the pairs of treatment members 34 and 54 on the right and the left when being closest to each other in the massaging operation are different from each other. Specifically, it is preferable that a separation distance D1 in the first massage mechanism 31 is set so as to be shorter than a separation distance D2 of the second massage mechanism 51. The separation distance depends on a gap between the arms 40 and 60 making pairs and attachment positions of the arms 40 and 60 with respect to the kneading shafts 41 and 61, or the inclination angles of the inclined shafts 41*a* and 61*a* with respect to the shaft centers 41*b* and 61*b* of the kneading shafts 41 and 61. According to such a configuration, it is possible to perform a proper massaging operation with the first massage mechanism 31 with respect to the neck and to perform the massaging operation with the second massage mechanism 51 while avoiding the vicinity of the centerline of the body (for example, the spine) with respect to the treatment target portion below the neck (for example, the shoulders, the back, and the waist) of which the treatment range is wide. That is, it is possible to perform an effective massaging operation depending on a treatment site.

Hereinafter, cooperation of the first massage mechanism 31 and the second massage mechanism 51 will be described.

Operation 1

Figure 20:
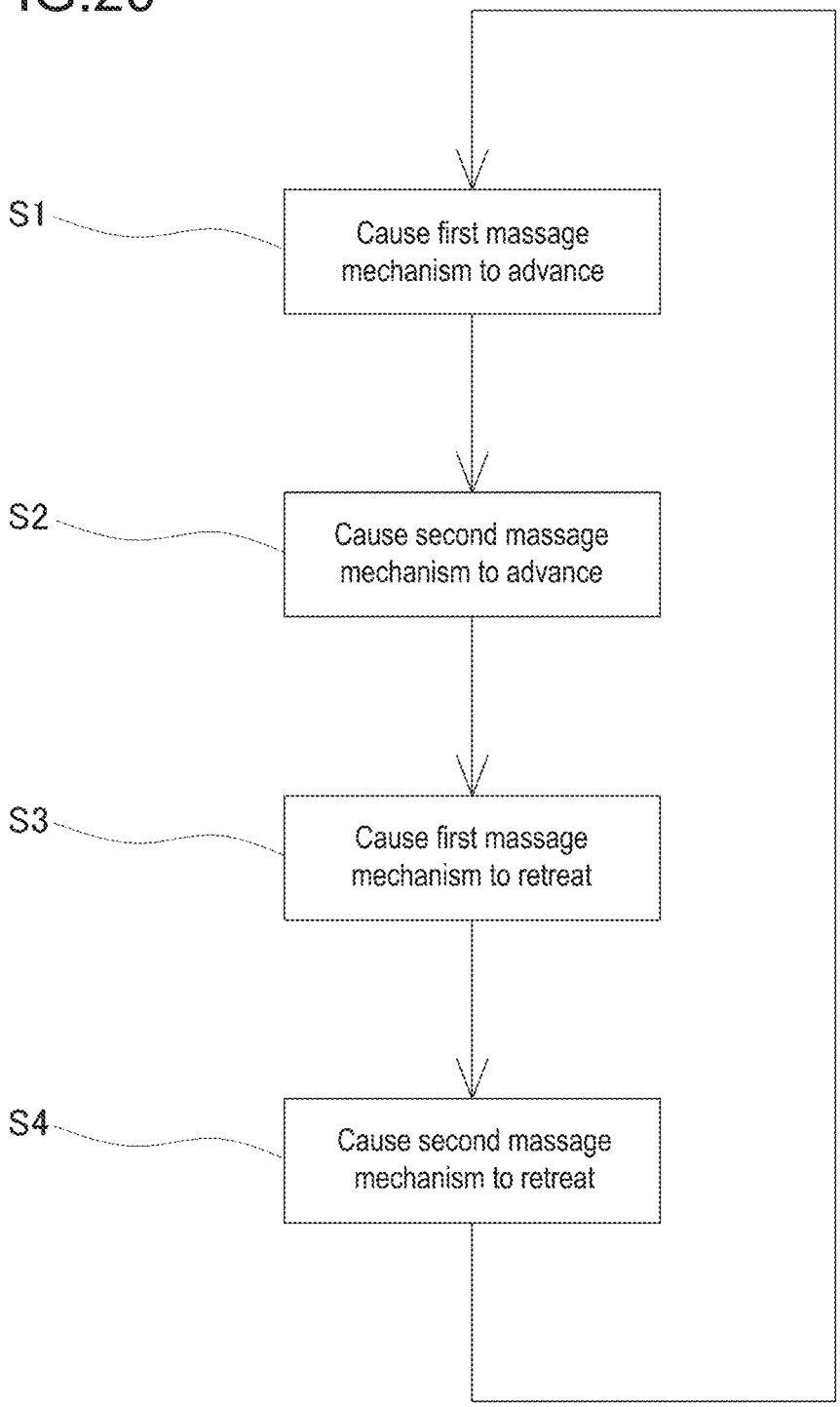
FIG. 20 is a flow chart of an operation 1.
Figure 21A:
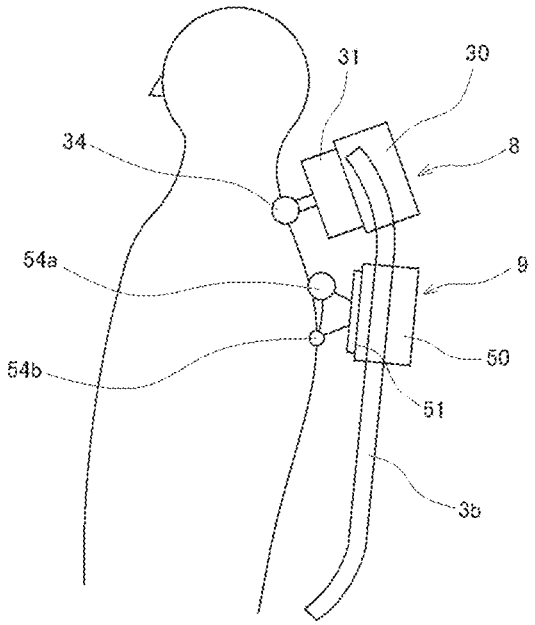
FIGS. 21A and 21B are views describing the operation 1.
Figure 21B:
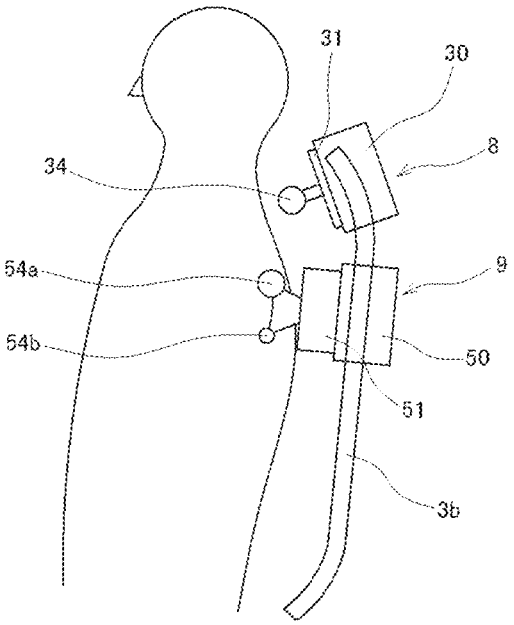

FIG. 20 is a flow chart of an operation 1. FIGS. 21A and 21B are views describing the operation 1. FIG. 21A illustrates a state where the first massage mechanism 31 advances and the second massage mechanism 51 retreats. FIG. 21B illustrates a state where the first massage mechanism 31 retreats and the second massage mechanism 51 advances.

It is preferable that the operation 1 includes an operation in which the first massage mechanism 31 and the second massage mechanism 51 advance and retreat with a time lag, that is, an operation of the treatment members 34 and 54 driven by the massage motors 43 and 63. Hereinafter, as illustrated in FIGS. 21A and 21B, a case where the operation 1 is performed in a state where the first massage unit 8 is disposed at the neck position and the second massage unit 9 is disposed at a back surface position of the shoulders will be exemplified.

As illustrated in FIG. 20, first, the first massage mechanism 31 relatively advances with respect to the second massage mechanism 51 (Step S1). Subsequently, in a state where the forward/backward position of the first massage mechanism 31 is maintained, the second massage mechanism 51 advances (Step S2). Subsequently, in a state where the forward/backward position of the second massage mechanism 51 is maintained, the first massage mechanism 31 relatively retreats with respect to the second massage mechanism 51 (Step S3). Subsequently, in a state where the forward/backward position of the first massage mechanism 31 is maintained, the second massage mechanism 51 retreats (Step S4). This cycle of Steps S1 to S4 is repeated for a predetermined period of time. In Steps S1 to S4, the second massage mechanism 51 may advance prior to the first massage mechanism 31. In addition, the position at which each of the massage units 8 and 9 is disposed is not particularly limited. For example, the first massage unit 8 may be disposed at the neck position and the second massage unit 9 may be disposed at the waist position.

In Steps S1 to S4, it is preferable that the massage motors 43 and 63 are driven so as to cause the treatment members 34 and 54 to perform massages including the massaging operations and the patting operations. The massages may be performed at all times. Otherwise, the massages may be intermittently performed. For example, the massages may be performed when each of the massage mechanisms 31 and 51 advances, and the massages may stop when each of the massage mechanisms 31 and 51 retreats. In addition, advancing or retreating of the massage mechanisms 31 and 51 and the massages may be synchronized with each other. In this case, it is possible to acquire a bodily feeling as if a masseur performs the massaging operation or the patting operation while varying the strength of power. Otherwise, advancing or retreating of the massage mechanisms 31 and 51 and an operation in which the pairs of treatment members 34 and 54 on the right and the left approach each other may be synchronized with each other. In this case, it is possible to acquire a bodily feeling as if a masseur grasps and squeezes the treatment target portion or grasps and pulls the treatment target portion. The aforementioned "synchronized" state is acceptable as long as the advancing/retreating drive portions 15 and 16 performing advancing or retreating of the massage mechanisms 31 and 51 and the massage motors 43 and 63 performing the massaging operations, the patting operations, or the operations in which the pairs of treatment members approach each other are concurrently driven regardless of the order. Moreover, the state includes a case where the massage motors 43 and 63 are driven after advancing or retreating of the massage mechanisms 31 and 51 is completed.

In addition, each of the massage mechanisms 31 and 51 may alternately advance and retreat such that the other massage mechanism retreats while being synchronized with advancing of one massage mechanism. In this case, it is possible to acquire a bodily feeling as if a masseur performs a massage by alternately switching the left hand and the right hand. In addition, in a state where the one massage mechanism advances, the other massage mechanism may repetitively advance and retreat for a predetermined period of time. In this case, it is possible to acquire a bodily feeling as if a masseur places one hand on the treatment target portion and repetitively performs a finger pressure therapy with the other hand.

In addition, in Steps S1 to S4, the lifting/lowering motors 35 and 55 may be driven such that each of the massage units 8 and 9 is lifted and lowered. For example, advancing of the massage mechanisms 31 and 51 and lifting/lowering of the massage units 8 and 9 may be synchronized with each other. In this case, it is possible to acquire a bodily feeling as if a masseur presses up or presses down the treatment target portion. It is preferable that the operation in which the pair of treatment members on the right and the left approaches each other is also synchronized with this operation.

In this manner, in the operation 1, since each of the massage mechanisms 31 and 51 advances and retreats with a time lag and performs a massage, it is possible to acquire a bodily feeling with the sense of realism as if a masseur performs a massage by using both hands. Particularly, in a case where a massaging operation is performed as the aforementioned massage, the pair of treatment members on the right and the left in the one massage mechanism can simulate a massaging operation of a masseur performed by using the thumb and other fingers of the left hand, and the pair of treatment members on the right and the left in the other massage mechanism can simulate a massaging operation of the masseur performed by using the thumb and other fingers of the right hand. In addition, since the sense of realism stands out when the operation 1 is performed in a state where both the massage mechanisms 31 and 51 are close to each other in the vertical direction, it is preferable that the operation 1 is performed based on the sensor 70 in the approach state or the pre-approach state described above.

In addition, in the embodiment described above, a bodily feeling with the sense of realism is realized by causing each of the massage mechanisms 31 and 51 to advance or retreat with a time lag. However, even when the speeds of advancing or retreating of the massage mechanisms 31 and 51 are different from each other, it is possible to acquire a similar bodily feeling. For example, in a case where the advancing speed of the first massage mechanism 31 is relatively higher than the advancing speed of the second massage mechanism 51, even if the massage mechanisms 31 and 51 simultaneously start advancing, after the treatment target portion is squeezed by the treatment members 34 of the first massage mechanism 31, the treatment target portion is squeezed by the treatment members 54 of the second massage mechanism 51 a little later. Therefore, it is possible to acquire a bodily feeling as if a masseur successively squeezes the treatment target portion with the left hand the right hand.

Operation 2

Figure 22:
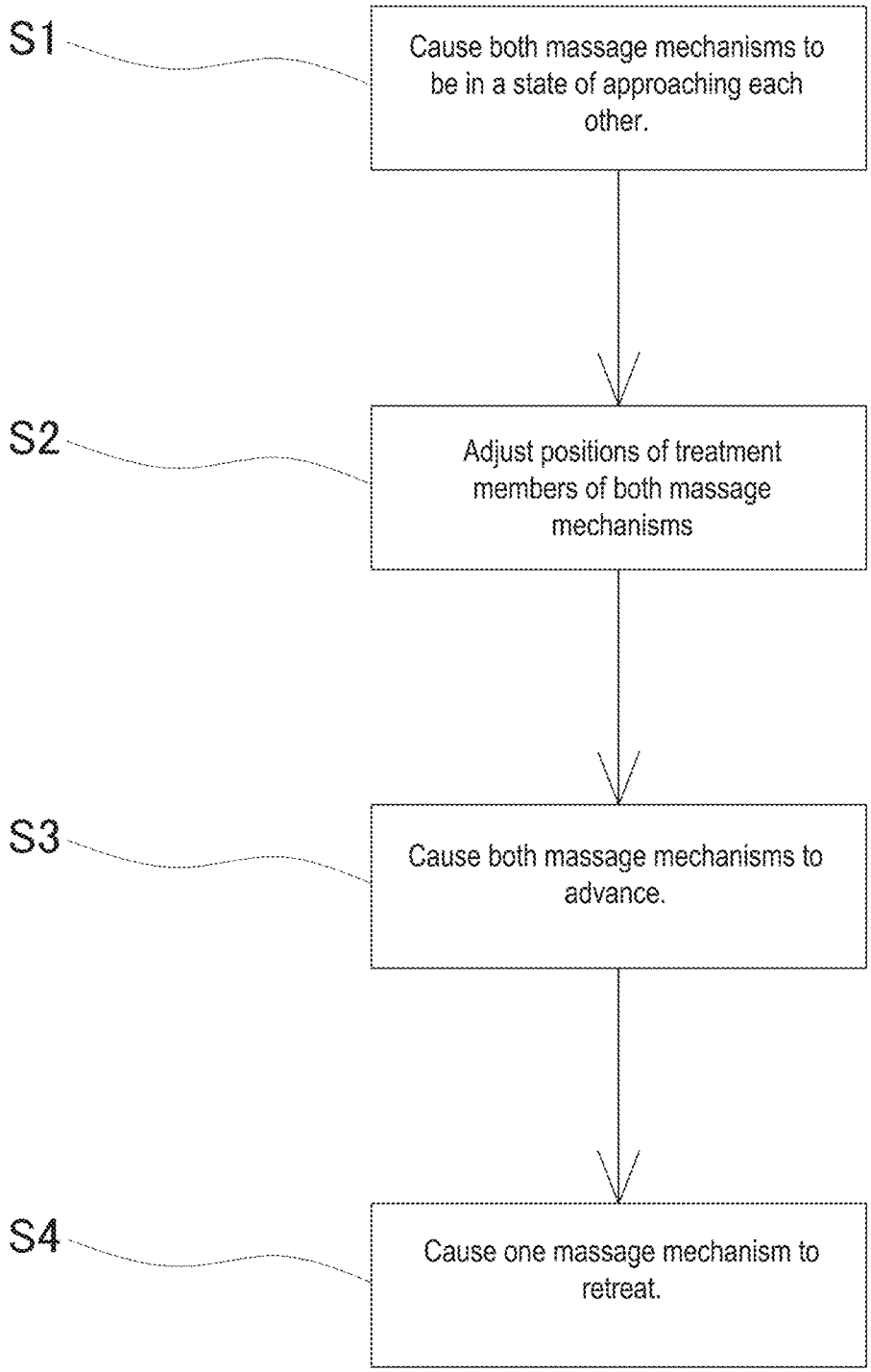
FIG. 22 is a flow chart of an operation 2 and an operation 3.
Figure 23:
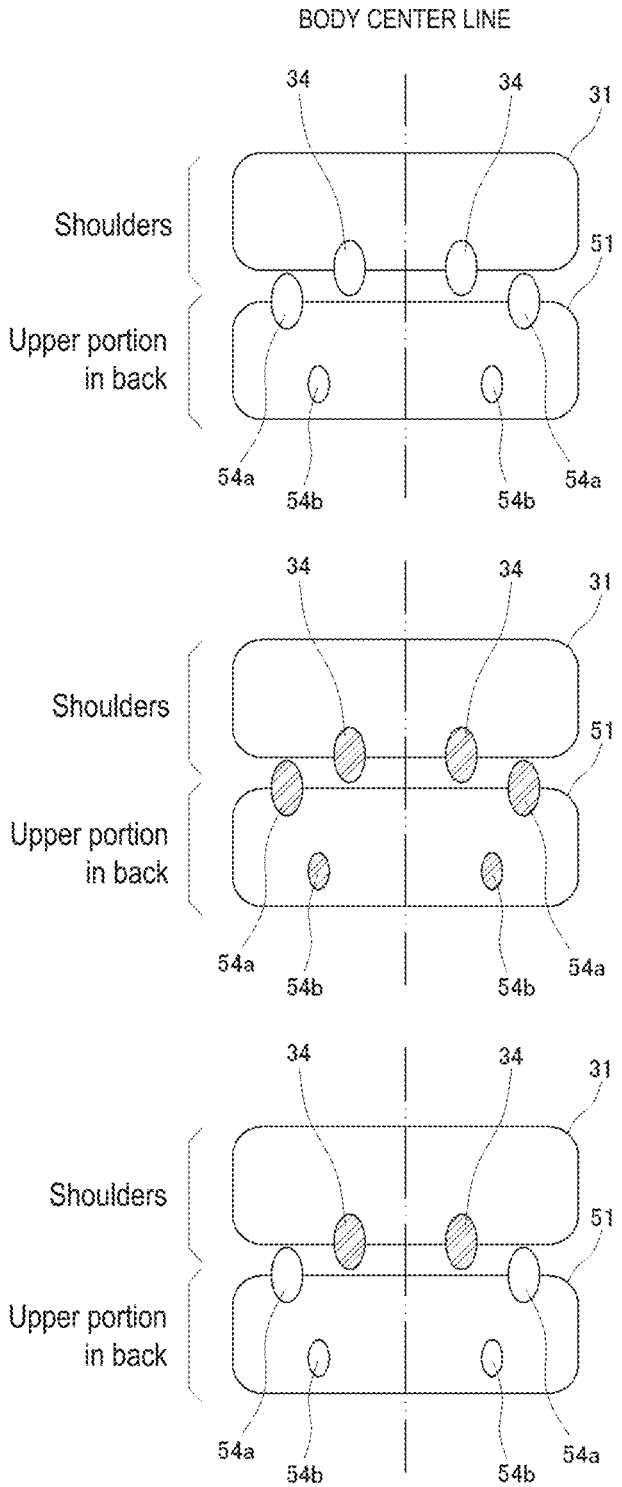
FIGS. 23A to 23C are views describing the operation 2 and the operation 3.

FIG. 22 is a flow chart of an operation 2 and an operation 3. FIGS. 23A to 23C are views describing the operation 2 and the operation 3. FIG. 23A illustrates a state where the first and second massage mechanisms 31 and 51 retreat, FIG. 23B illustrates a state where the first and second massage mechanisms 31 and 51 advance, and FIG. 23C illustrates a state where the first massage mechanism 31 advances and the second massage mechanism 51 retreats. In FIGS. 23A to 23C, treatment members 34, 54*a*, and 54*b* with diagonal lines indicate the advance states, and the treatment members 34, 54*a*, and 54*b* with no diagonal line indicate the retreat state.

The operation 2 is an operation in which the treatment members 34 of the first massage mechanism 31 and the treatment members 54 of the second massage mechanism 51 advance with respect to the treatment target portion. Hereinafter, as illustrated in FIGS. 23A to 23C, a case where the operation 2 is performed in a state where the first massage unit 8 is disposed at the back surface position of the shoulders and the second massage unit 9 is disposed at an upper portion in the back will be exemplified.

As illustrated in FIG. 22, first, each of the massage units 8 and 9 is lifted and lowered so as to be in a state of approaching each other in the height direction (Step S1). In this example, the first massage unit 8 is disposed at the back surface position of the shoulders, and the second massage unit 9 is disposed at the upper portion in the back. Therefore, as illustrated in FIGS. 23A to 23C, the treatment members 34 and the upper treatment members 54*a* are in a state of approaching in the height direction. Subsequently, the massage motors 43 and 63 are driven, and as illustrated in FIG. 23A, the positions of the treatment members 34 of the first massage mechanism 31 and the treatment members 54 of the second massage mechanism 51 in the lateral direction are caused to be different from each other (Step S2). Subsequently, the advancing/retreating drive portions 15 and 16 are driven, and as illustrated in FIG. 23B, the first massage mechanism 31 and the second massage mechanism 51 advance (Step S3).

In Step S1, the vertical gap between both the massage units 8 and 9 may be determined based on the sensor 70. For example, the approach state or the pre-approach state described above may be applied. In addition, in Step S2, the lateral positions of the treatment members 34 and 54 may be determined based on the width sensors 46 and 66. In addition, Steps S1 and S2 may be concurrently performed. In addition, in Step S3, the first massage mechanism 31 and the second massage mechanism 51 may simultaneously advance or may advance with a time lag.

In Step S3, the massaging operation or the patting operation may be performed by driving the massage motors 43 and 63. For example, in the backrest portion 3, it is preferable that one massage mechanism performs the massaging operation and the other massage mechanism concurrently performs an operation including the patting operation. In such an operation, it is possible to apply a bodily feeling as if the upper half of the body is subjected to different types of massage by two or more masseurs. Since a masseur can perform a massaging operation with one hand but cannot perform a patting operation with one hand, one masseur cannot concurrently perform the massaging operation and the patting operation.

In this manner, in the operation 2, the treatment members 34 of the first massage mechanism 31 and the treatment members 54 of the second massage mechanism 51 (upper treatment members 54*a*) are in a state of being arranged in the lateral direction. Accordingly, it is possible to acquire a bodily feeling with the sense of realism as if a masseur performs a massage (finger pressure therapy) by using both hands with the thumbs and other fingers. That is, in the states illustrated in FIGS. 23A to 23C, the treatment members 34 positioned on the laterally inner sides correspond to the thumbs, and the upper treatment members 54*a* and the lower treatment members 54*b* positioned on the laterally outer sides correspond to other fingers. In addition, in the embodiment described above, description is given regarding a case of performing the operation 2 in a state where the first massage mechanism 31 and the second massage mechanism 51 approach each other. However, the operation 2 may be performed in a state of being separated from each other. In this case, for example, the treatment members 54 (upper treatment members 54*a* or lower treatment members 54*b*) positioned on the lower side correspond to the thumbs, and the treatment members 34 positioned on the upper side correspond to other fingers.

Operation 3

The operation 3 is an operation in which the treatment members of one massage mechanism retreat from a state where the positions of the treatment members 34 of the first massage mechanism 31 and the treatment members 54 of the second massage mechanism 51 in the lateral direction are different from each other, and the treatment members 34 and the treatment members 54 advance. Hereinafter, as illustrated in FIG. 22, a case where the operation 3 is performed subsequently to the operation 2 will be exemplified.

Subsequently to Step S3 in the operation 2, the advancing/retreating drive portion is driven such that any one of the massage mechanisms retreats (Step S4). In the examples illustrated in FIGS. 23A to 23C, the advancing/retreating drive portion 16 is driven such that the second massage mechanism 51 retreats. Then, the treatment target portion strongly comes into contact with the advancing treatment members 34 of the first massage mechanism 31. Accordingly, it is possible to acquire a bodily feeling as if being subjected to a finger pressure therapy by the treatment members 34. Since a bodily feeling of a finger pressure therapy stands out when the operation 3 is performed in a state where both the massage mechanisms 31 and 51 approach each other, it is preferable that the operation 3 is performed based on the sensor 70 in the approach state or the pre-approach state described above. In addition, in the operation 2 and the operation 3, the position at which each of the massage units 8 and 9 is disposed is not particularly limited. For example, the first massage unit 8 may be disposed at the neck position or the back position and the second massage unit 9 may be disposed at the waist position.

Operation 4

Figure 24:
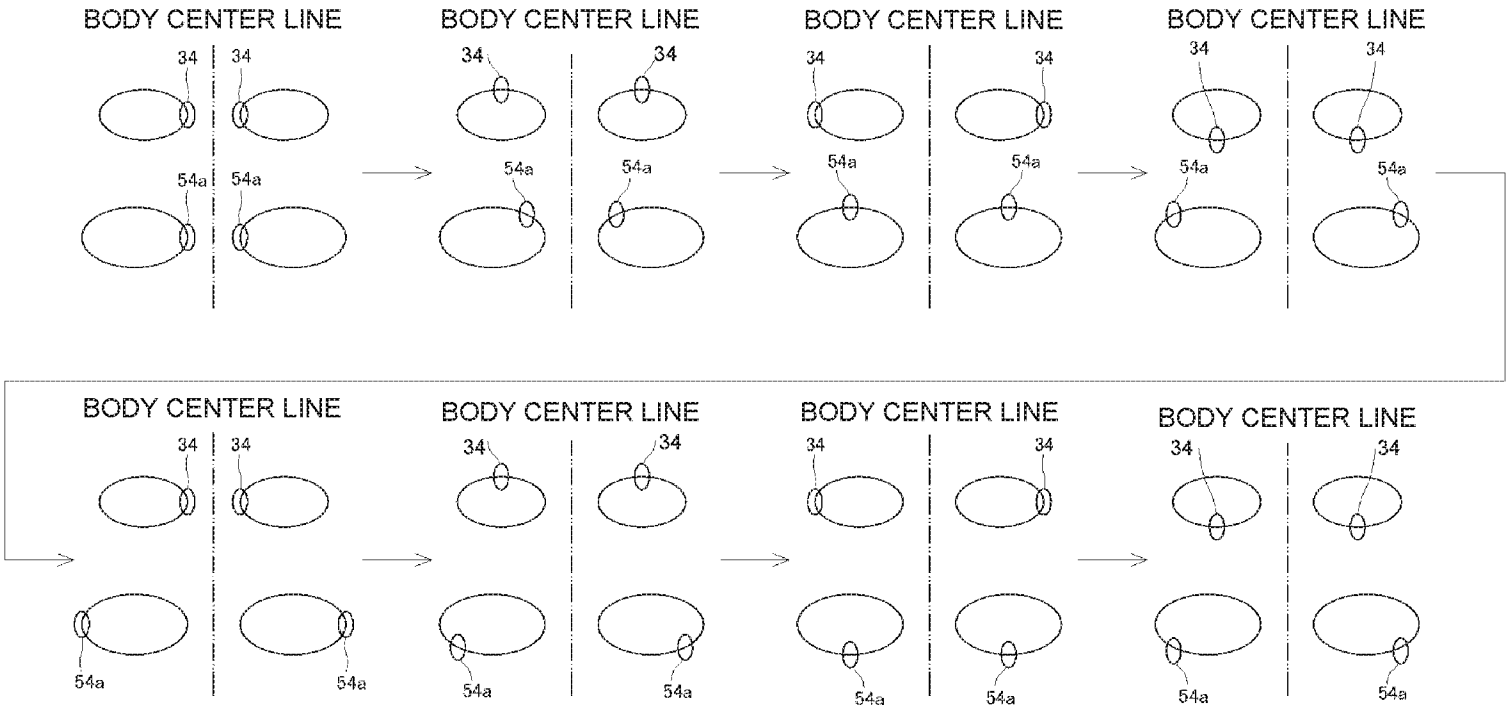
FIG. 24 is a view describing an operation 4.

FIG. 24 is a view describing an operation 4. In FIG. 24, in order to make the description easy to understand, illustration of the lower treatment members 54*b* is omitted.

The operation 4 is an operation in which the treatment members 34 of the first massage mechanism 31 and the treatment members 54 of the second massage mechanism 51 perform the massaging operations at speeds different from each other. It is preferable that the operation 4 is performed in a state where the massage mechanisms 31 and 51 approach each other in the height direction.

First, each of the massage units 8 and 9 is lifted and lowered so as to be in a state of approaching each other in the height direction. Subsequently, each of the massage motors 43 and 63 is continuously driven in one direction, and a massaging operation is performed by the treatment members 34 of the first massage mechanism 31 and the treatment members 54 of the second massage mechanism 51. This massaging operation is performed by driving the massage motors 43 and 63 at speeds different from each other so as to rotate the kneading shafts 41 and 61 at speeds different from each other rotate. In the example illustrated in FIG. 24, the kneading shaft 41 rotates relatively fast. The vertical gap between both the massage units 8 and 9 may be determined based on the sensor 70. For example, the approach state or the pre-approach state described above may be applied.

In this manner, in the operation 4, the treatment members 34 and 54 of the massage mechanisms 31 and 51 perform the massaging operations by repeating the cycle of making one round in a loop-like trajectory. However, from a view point of the treatment members of one massage mechanism, the positional relationship with respect to the treatment members of the other massage mechanism becomes different in each cycle. For example, from a view point of the treatment members 34 of the first massage mechanism 31, in a state where the pair of treatment members 34 is separated farthest from each other in a first cycle, the pair of treatment members 54 of the second massage mechanism 51 is positioned at the upper end on the trajectory of the massaging operation. However, in a state where the pair of treatment members 34 is separated farthest from each other in a second cycle, the pair of treatment members 54 of the second massage mechanism 51 is positioned at the lower end on the trajectory of the massaging operation. In this manner, in the operation 4, the massaging operations in the vertical direction performed by the treatment members 34 of the first massage mechanism 31 and the treatment members 54 of the second massage mechanism 51 can be changed with the lapse of time, and thus, the massaging effect is enhanced.

Operation 5

Figure 25A:
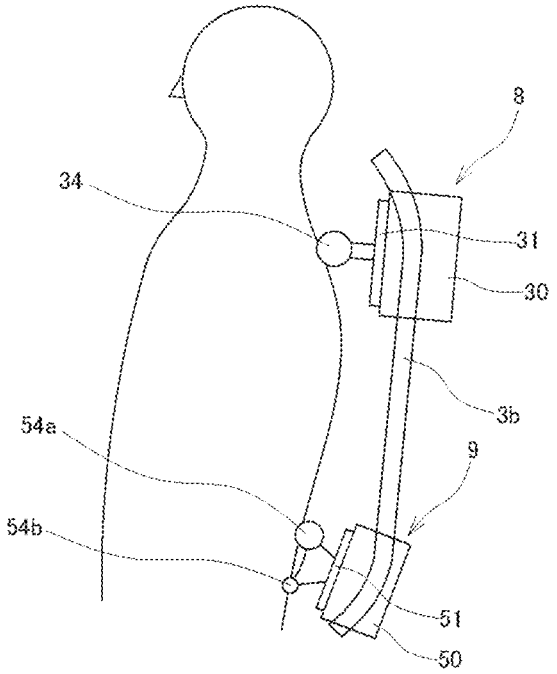
FIGS. 25A and 25B are views describing an operation 5.
Figure 25B:
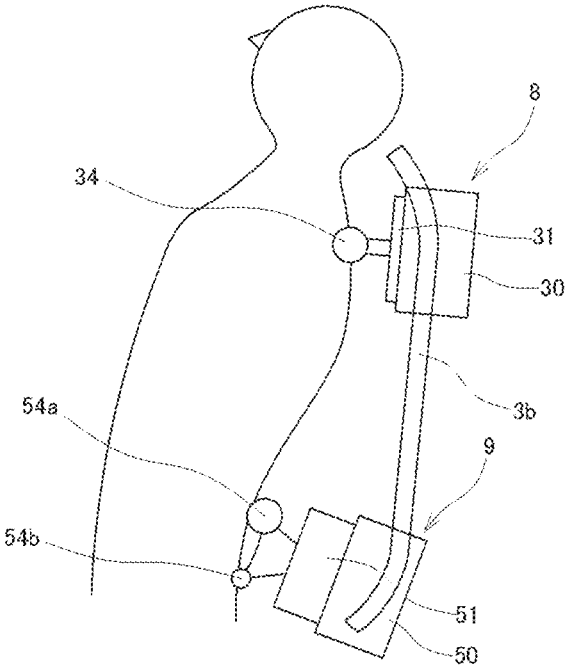

FIGS. 25A and 25B are views describing an operation 5. FIG. 25A illustrates a state where the first and second massage mechanisms 31 and 51 retreat, and FIG. 25B illustrates a state where the first massage mechanism 31 retreats and the second massage mechanism 51 advances.

As illustrated in FIGS. 25A and 25B, it is preferable that the operation 5 is an operation in which the second massage mechanism 51 advances in a state where the first massage unit 8 is disposed at the shoulder position and the second massage unit 9 disposed at the waist position and includes an operation of the treatment members 34 driven by the massage motor 43. When the second massage mechanism 51 advances the waist position, the waist is pushed forward, thereby being in a posture such that the upper half of the body is bent backward. Therefore, the shoulders strongly come into contact with the treatment members 34 of the first massage mechanism 31. In this case, when the treatment members 34 of the first massage mechanism 31 are performing the massaging operation or the patting operation, the massaging effect is enhanced.

Operation 6

Figure 26A:
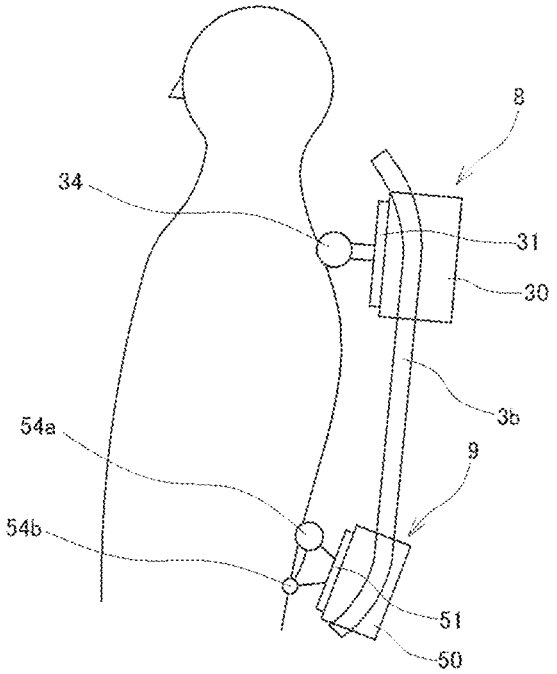
FIGS. 26A and 26B are views describing an operation 6.
Figure 26B:
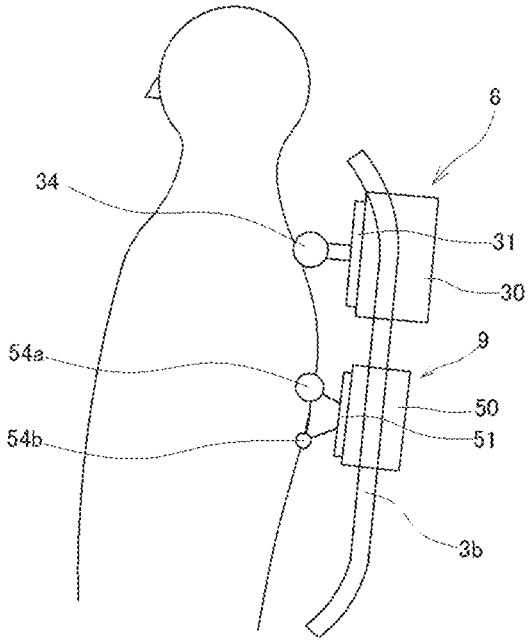

FIGS. 26A and 26B views describing an operation 6. FIG. 26A illustrates a state where the first massage unit 8 is disposed at the shoulder position and the second massage unit 9 is disposed at the waist position, and FIG. 26B illustrates a state where the first massage unit 8 is disposed at the shoulder position and the second massage unit 9 is lifted to the back position.

As illustrated in FIGS. 26A and 26B, it is preferable that the operation 6 is an operation in which the second massage unit 9 is lifted in the height direction in a state where the first massage unit 8 is disposed at the shoulder position and includes an operation of the treatment members 34 driven by the massage motor 43. When the second massage unit 9 is lifted, the upper half of the body rises. Therefore, the shoulders strongly come into contact with the treatment members 34 of the first massage mechanism 31. In this case, when the treatment members 34 of the first massage mechanism 31 are performing the massaging operation or the patting operation, the massaging effect is enhanced.

Operation 7

Figure 27A:
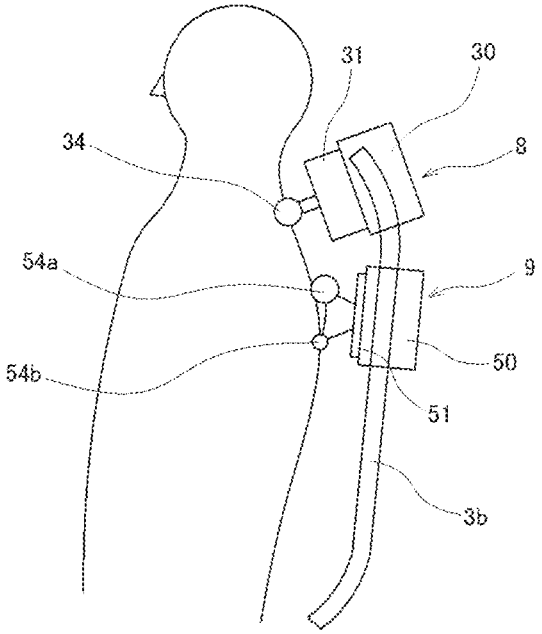
FIGS. 27A and 27B are views describing an operation 7.
Figure 27B:
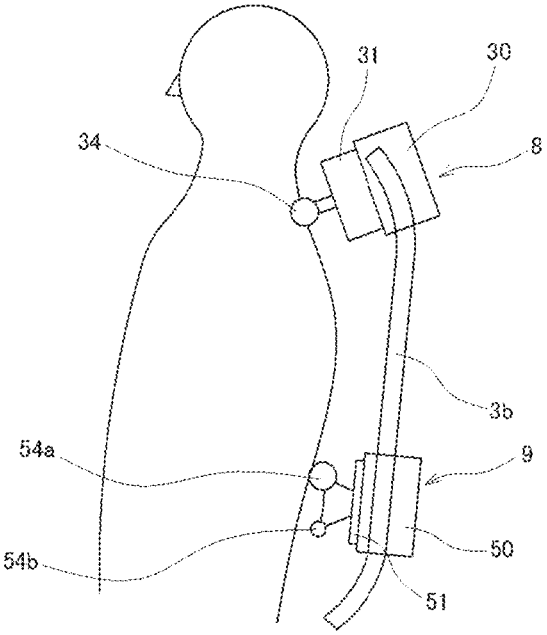

FIGS. 27A and 27B are views describing an operation 7. FIG. 27A illustrates a state where the first massage mechanism 31 advances so as to sandwich the neck and the second massage mechanism 51 is disposed at the shoulder position, and FIG. 27B illustrates a state where the first massage mechanism 31 advances so as to sandwich the neck and the second massage mechanism 51 is lowered to the waist position.

The operation 7 is an operation in which the other massage mechanism is lifted or lowered in the height direction in a state where the treatment target portion is sandwiched by the pair of treatment members of one massage mechanism. In the examples illustrated in FIGS. 27A and 27B, in a state where the first massage mechanism 31 advances and the pair of treatment members 34 approaches each other so as to sandwich the neck, the second massage unit 9 is lowered. When the second massage unit 9 is lowered, the upper half of the body is pulled downward. Therefore, since the neck is sandwiched by the treatment members 34 of the first massage mechanism 31, it is possible to acquire a stretching effect of stretching the neck. In addition, in a state where the neck is sandwiched by the first massage mechanism, when the second massage unit 9 repetitively performs lifting and lowering, it is possible to acquire a bodily feeling as if in a state where a masseur fixes the neck while placing one hand thereon, the masseur rubs or stretches the treatment target portion with the other hand.

In the operation 7, the position at which each of the massage units 8 and 9 is disposed is not particularly limited. In addition, the massage mechanism sandwiching the treatment target portion and the massage mechanism to be lifted or lowered can be suitably selected. For example, the first massage unit 8 may be lifted or lowered at the back position in a state where the second massage unit 9 is disposed at the waist position and the waist is sandwiched by the pair of treatment members 54.

Operation 8

Figure 28A:
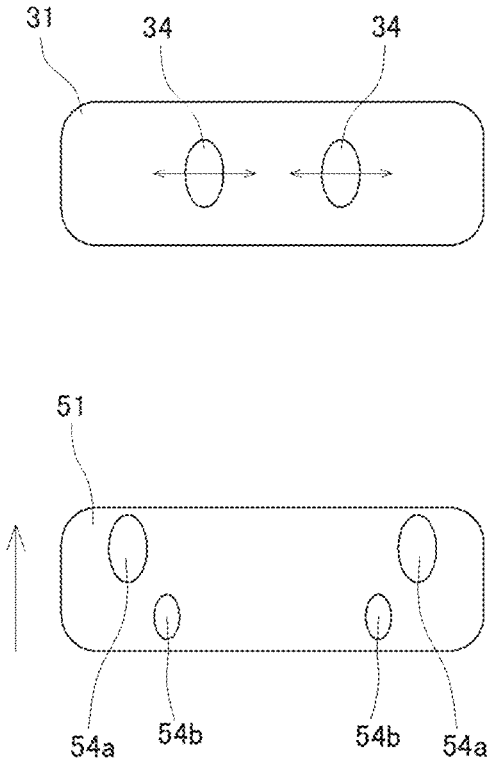
FIGS. 28A and 28B are views describing an operation 8.
Figure 28B:
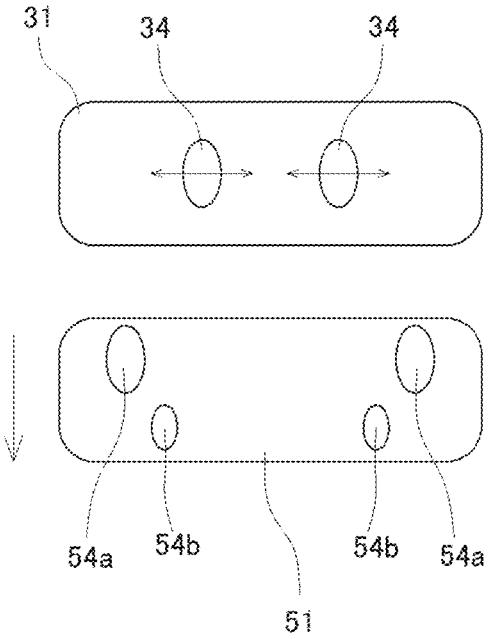

FIGS. 28A and 28B are views describing an operation 8. FIG. 28A illustrates a state where the first massage mechanism 31 performs the massaging operation and the second massage mechanism 51 is in a lifting process, and FIG. 28B illustrates a state where the first massage mechanism 31 performs the massaging operation and the second massage mechanism 51 is in a lowering process. The operation 8 is an operation in which one massage mechanism performs the massaging operation or the patting operation and the other massage mechanism is lifted or lowered. Hereinafter, based on FIGS. 28A and 28B, a case where the first massage mechanism 31 serving as the one massage mechanism performs the massaging operation and the second massage mechanism 51 serving as the other massage mechanism is lifted or lowered will be exemplified.

As illustrated in FIG. 28A, when the second massage mechanism 51 is lifted and approaches the first massage mechanism 31, muscles of the treatment target portion are biased to the first massage mechanism 31 side, and the biased muscles can be kneaded by the pair of treatment members 34 of the first massage mechanism 31. Meanwhile, as illustrated in FIG. 28B, when the second massage mechanism 51 is lowered and is separated from the first massage mechanism 31, the muscles of the treatment target portion is pulled, and the pulled muscles can be kneaded by the pair of treatment members 34 of the first massage mechanism 31. Besides, blood circulation can be promoted by rubbing the treatment target portion through lifting or lowering of the second massage mechanism 51, and the first massage mechanism 31 performs the massaging operation with respect to the treatment target portion in which blood circulation is improved. Thus, the massaging effect is further enhanced. In the operation 8, the first massage mechanism 31 may be lifted or lowered, and the second massage mechanism 51 may perform the massaging operation or the patting operation.

Operation 9

Figure 29:
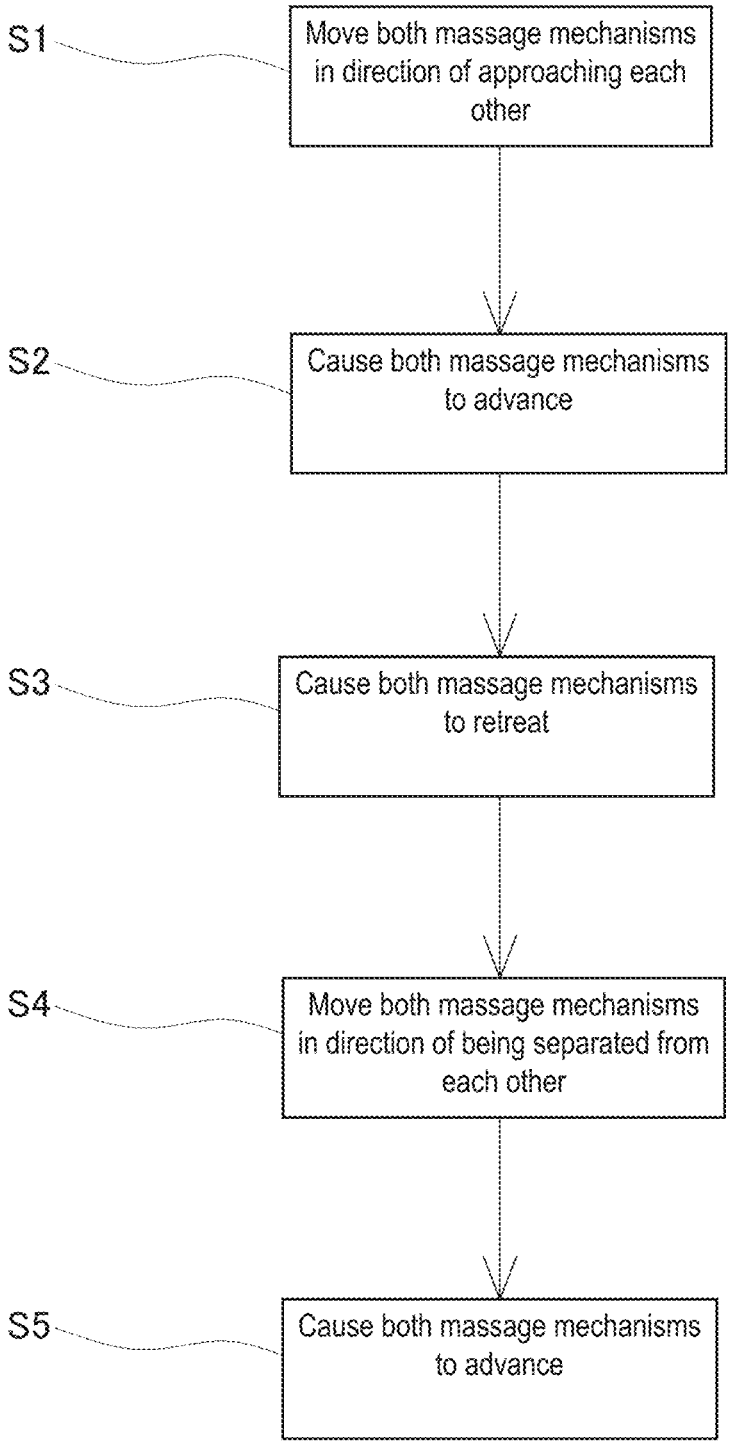
FIG. 29 is a flow chart of an operation 9 and an operation 10.

FIG. 29 is a flow chart of an operation 9 and an operation 10.

The operation 9 is an operation in which an operation of moving the first massage mechanism 31 and the second massage mechanism 51 in a direction of approaching each other along the height direction, and an operation of causing the treatment members 34 and 54 of the first and second massage mechanisms 31 and 51 to advance with respect to the treatment target portion are synchronized with each other. As illustrated in FIG. 29, first, each of the massage units 8 and 9 moves in the direction of approaching each other (Step S1). This operation in Step S1 is continuously performed until the relative positions of the massage units 8 and 9 are in the approach state or the pre-approach state. After Step S1 is completed, or concurrently with Step S1, the treatment members 34 and 54 of the first and second massage mechanisms 31 and 51 advance (Step S2). In such an operation, the back muscles can be stretched by the massage mechanisms 31 and 51 moving along the height direction, and the upper half of the body can be bent backward due to advancing of the treatment members 34 and 54. Thus, the massaging effect is enhanced. After Step S2 is completed, the treatment members 34 and 54 of the first and second massage mechanisms 31 and 51 retreat (Step S3). In Step S1, it is preferable that the first and second massage mechanisms 31 and 51 approach each other while having the waist position as a target position. In this case, the effect of bending the upper half of the body backward is enhanced.

Operation 10

The operation 10 is an operation in which an operation of moving the first massage mechanism 31 and the second massage mechanism 51 in a direction of being separated from each other along the height direction, and an operation of causing the treatment members 34 and 54 of the first and second massage mechanisms 31 and 51 to advance with respect to the treatment target portion are synchronized with each other. Hereinafter, as illustrated in FIG. 29, a case where the operation 10 is performed subsequently to the operation 9 will be exemplified.

Subsequently to Step S3 in the operation 9, the first and second massage units 8 and 9 in the approach state or the pre-approach state move in the direction of being separated from each other (Step S4). This operation in Step S4 is continuously performed until the first massage unit 8 is at the neck position and the second massage unit 9 is at the lower limit position in the lifting/lowering range. Concurrently with Step S4, the treatment members 34 and 54 of the first and second massage mechanisms 31 and 51 advance (Step S5). In such an operation, while the upper half of the body is bent backward due to advancing of the treatment members 34 and 54, the upper half of the body can be stretched through a separation operation performed along the height direction of the massage mechanisms 31 and 51. Thus, the massaging effect is enhanced.

Operation 11

Figure 34:
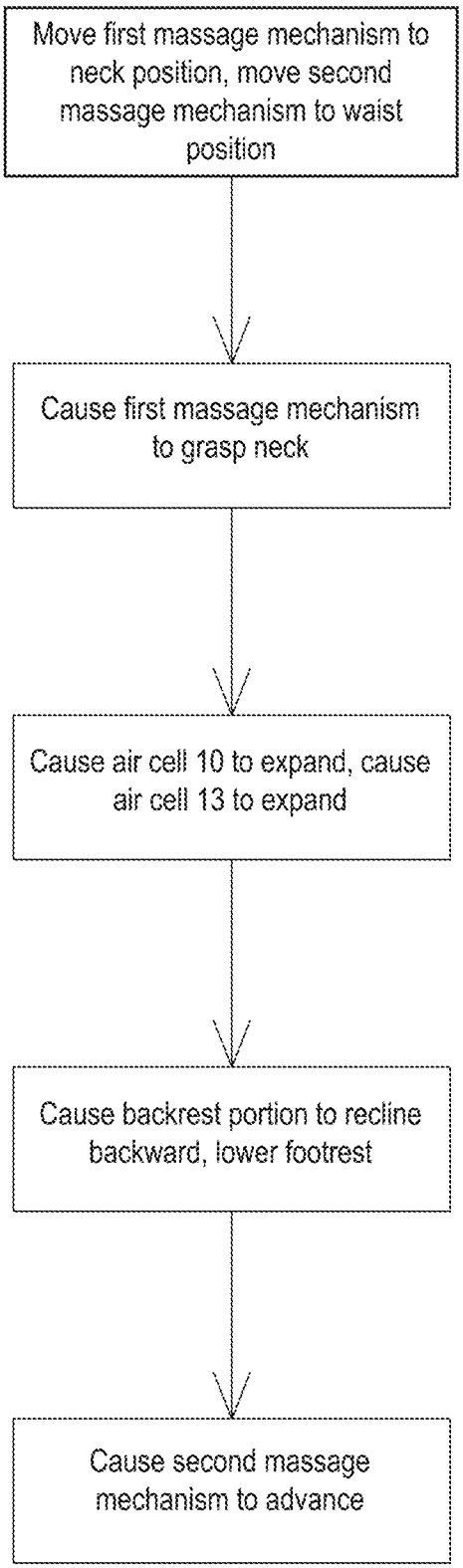
FIG. 34 is a flow chart of an operation 11.

FIG. 34 is a flow chart of an operation 11. The operation 11 is an operation of stretching the body of the user. In the operation 11, an operation of grasping the neck by causing the treatment members 34 of the first massage mechanism 31 driven by the lifting/lowering motor 35 to be positioned at the neck and causing the pair of treatment members 34 driven by the massage motor 43 to approach each other, an operation of pressing the waist by causing the treatment members 54 of the second massage mechanism 51 driven by the lifting/lowering motor 55 to be positioned at the waist and causing the second massage mechanism 51 driven by the advancing/retreating drive portion 16 to advance, an operation of holding the upper half of the body in the backrest portion 3 by using the air cells 10 serving as second press-holding means provided in the backrest portion 3, an operation of holding the lower limbs in the footrest 4 by using the air cells 13 serving as first press-holding means in the footrest 4, an operation of reclining the backrest portion 3 driven by the actuator 21 backward, and an operation of lowering the footrest 4 driven by the actuator 22 are synchronized with each other.

In the operation 11, it is enough when at least the operation of grasping the neck, the operation of pressing the waist, and the operation of reclining the backrest portion 3 backward are synchronized with each other. According to such an operation, in a state where the neck is held and the upper half of the body is restrained from being erroneously positioned with respect to the backrest portion 3 when the backrest portion 3 is reclined, the second massage mechanism 51 presses up the waist. Thus, the upper half of the body can be effectively bent backward and a high stretching effect can be expected.

In addition, when an operation of holding the upper arms or the shoulders by using the air cells 10 is added, since the upper arms or the shoulders are held, the upper half of the body is further restrained from being erroneously positioned with respect to the backrest portion 3 when the backrest portion 3 is reclined. Thus, a higher stretching effect can be expected. In addition, the operation of holding the lower limbs and the operation of lowering the footrest 4 are added, in a state where the neck and the lower limbs are held, the backrest portion 3 and the footrest 4 operate. Thus, it is possible to expect a higher stretching effect in which the whole body can be pulled. In addition, while being synchronized with reclining of the backrest portion 3, when the first massage mechanism 31 in a state of advancing retreats due to driving of the advancing/retreating drive portion 15, the neck is drawn downward. Thus, a higher stretching effect can be expected. The "synchronized" state in the operation 11 is acceptable as long as the operations are concurrently performed regardless of the order. Moreover, the state includes a case where the second massage mechanism 51 advances after reclining of the backrest portion 3 or lowering of the footrest 4 is completed.

Figure 35:
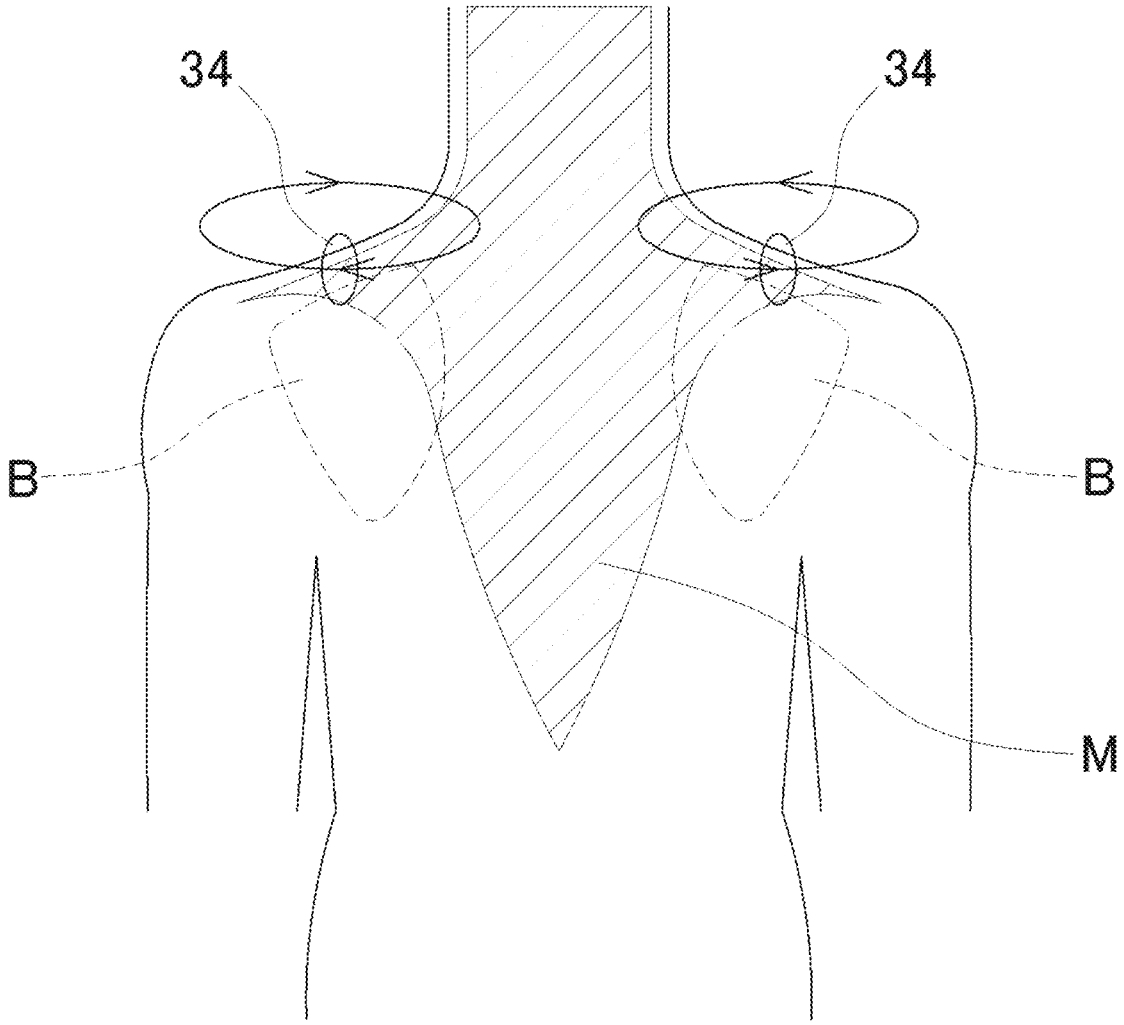
FIG. 35 is a view describing an operation A.
Figure 36:
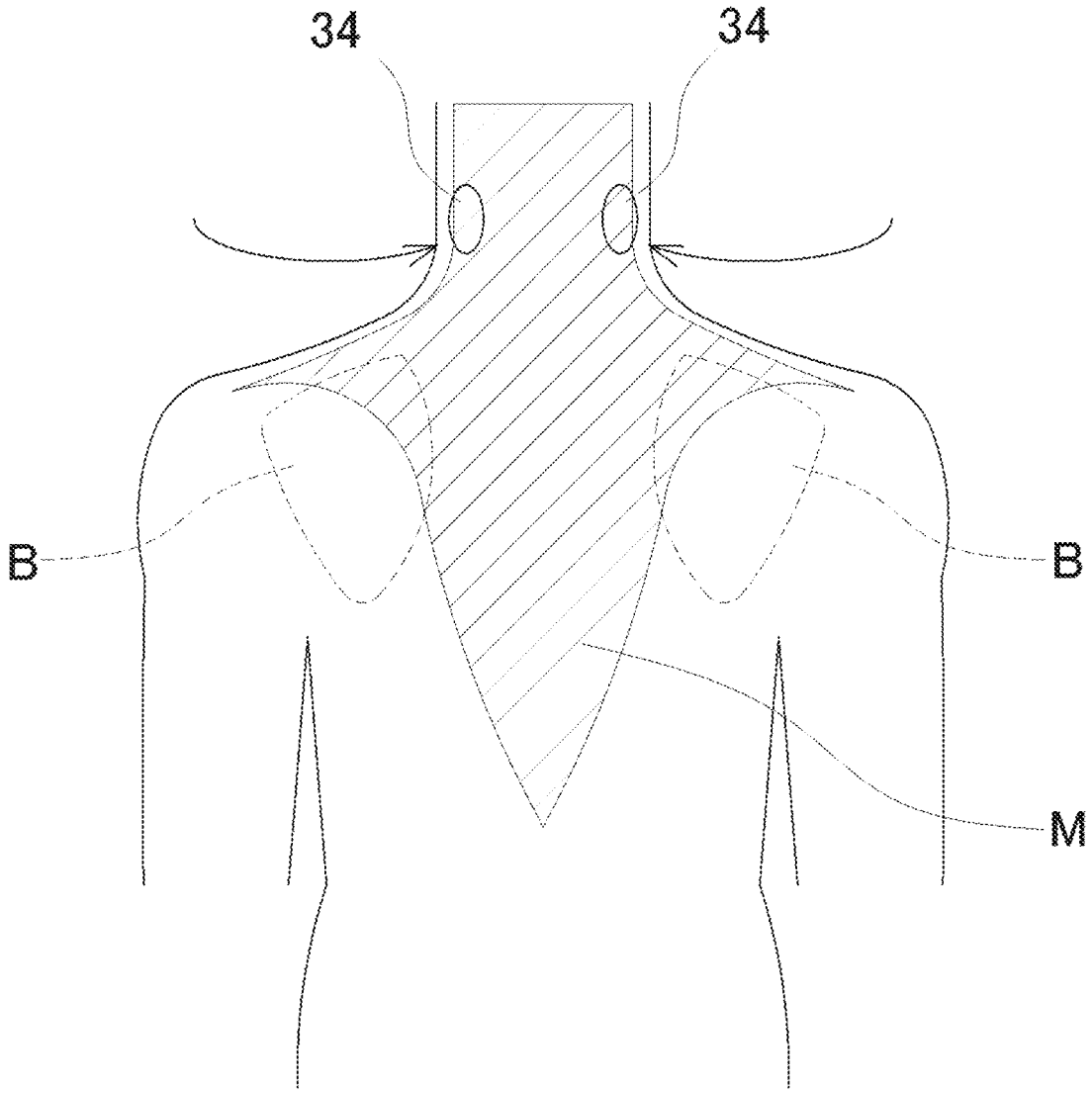
FIG. 36 is a view describing an operation B.
Figure 37:
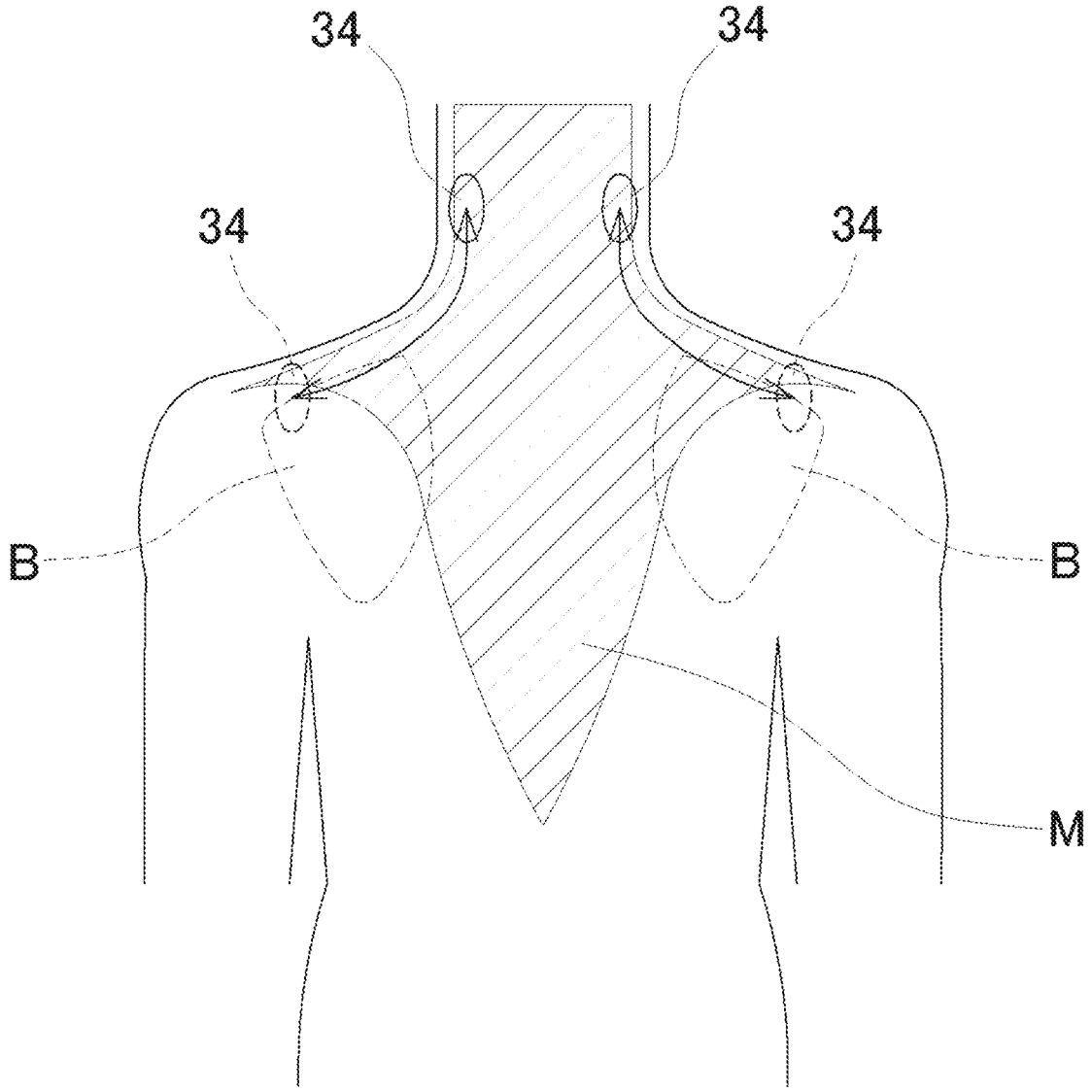
FIG. 37 is a view describing an operation C.
Figure 38:
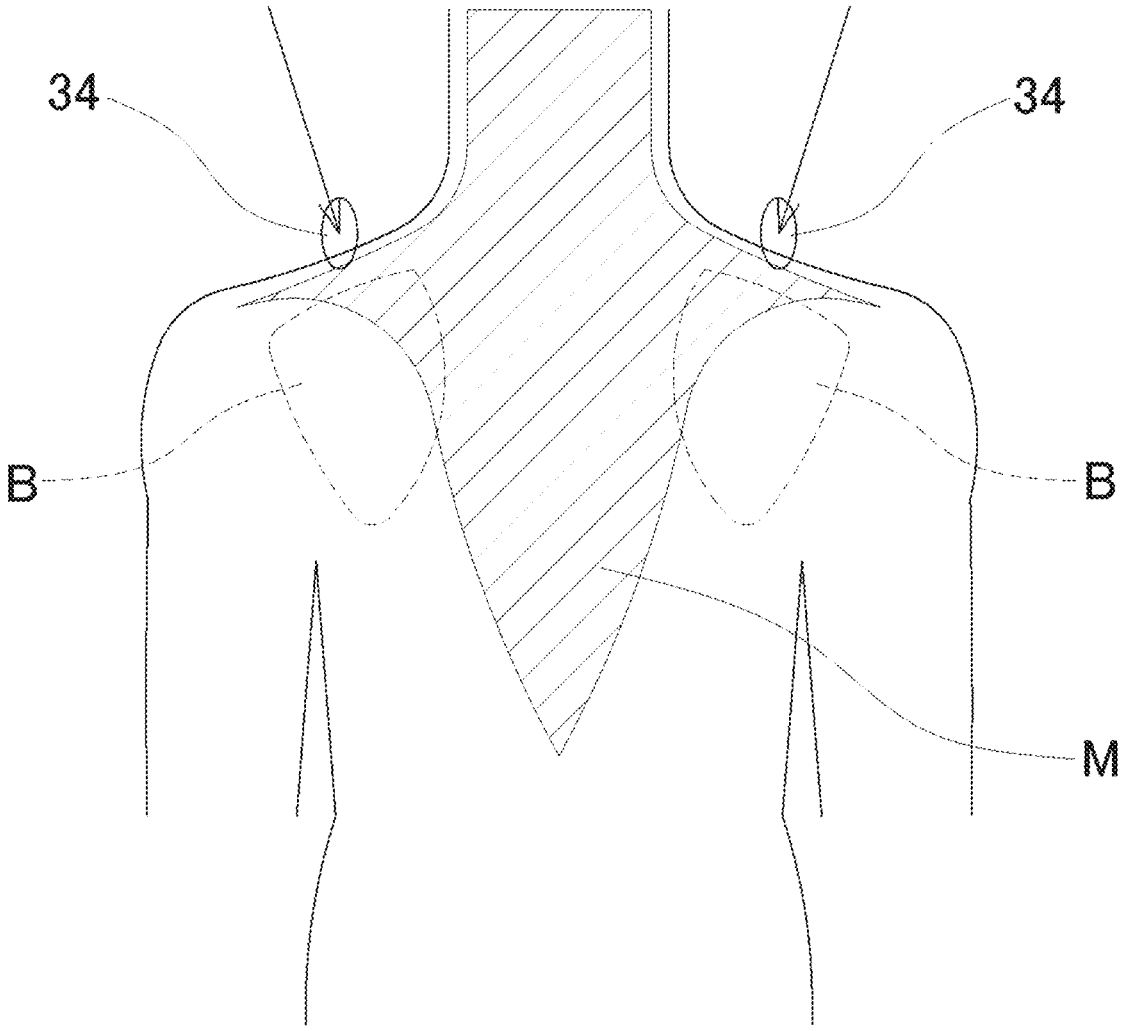
FIG. 38 is a view describing an operation D.
Figure 39:
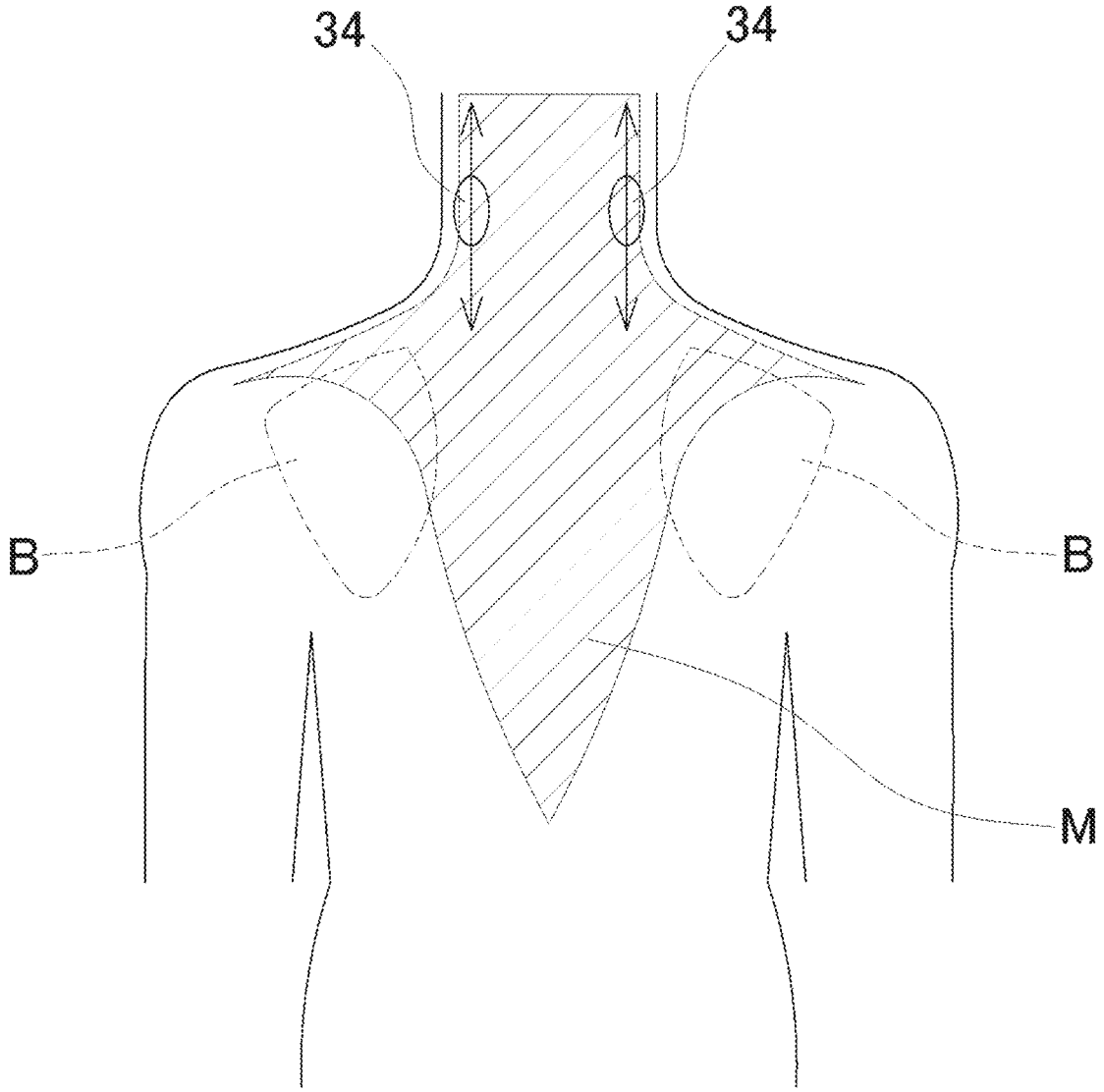
FIG. 39 is a view describing an operation E.
Figure 40:
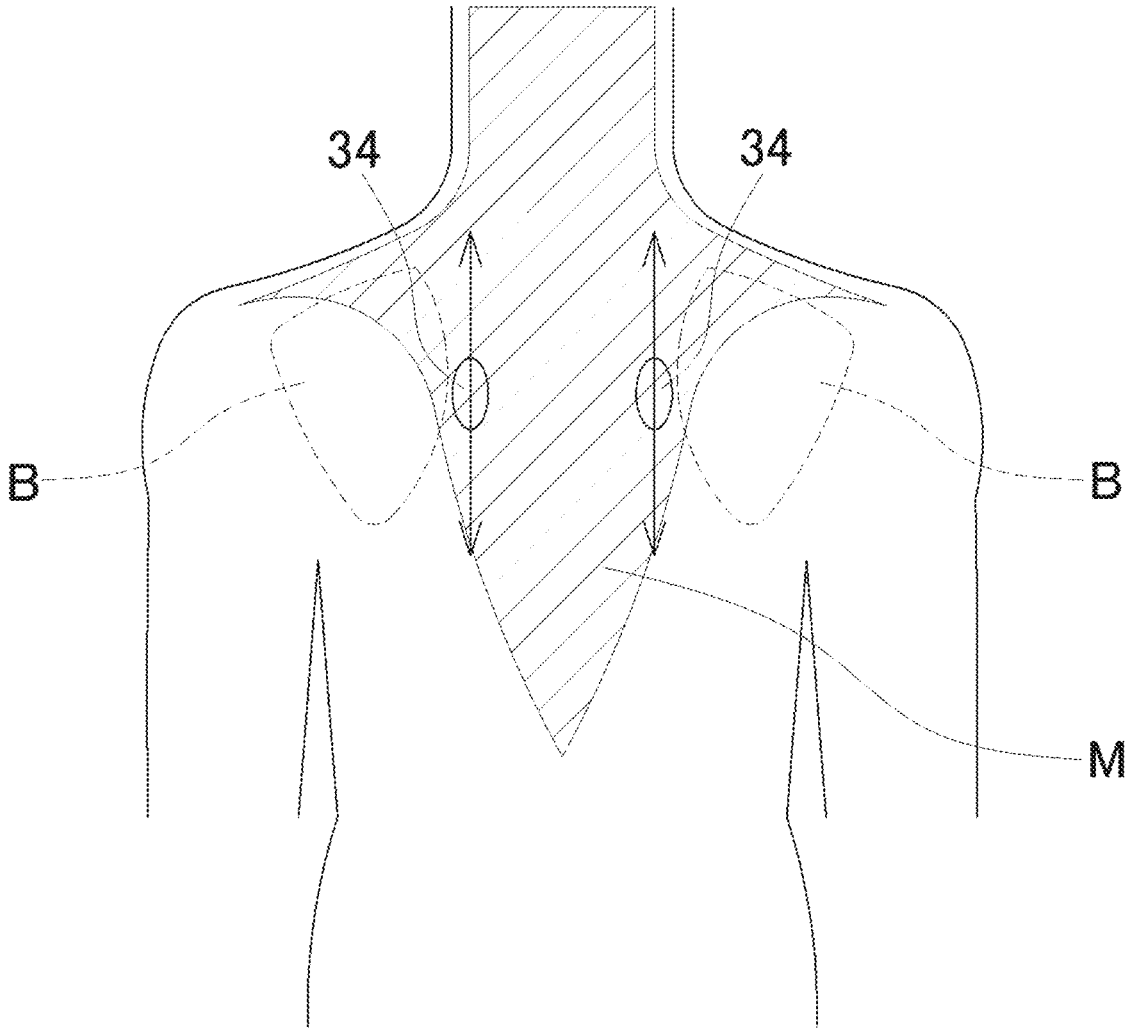
FIG. 40 is a view describing an operation F.
Figure 41:
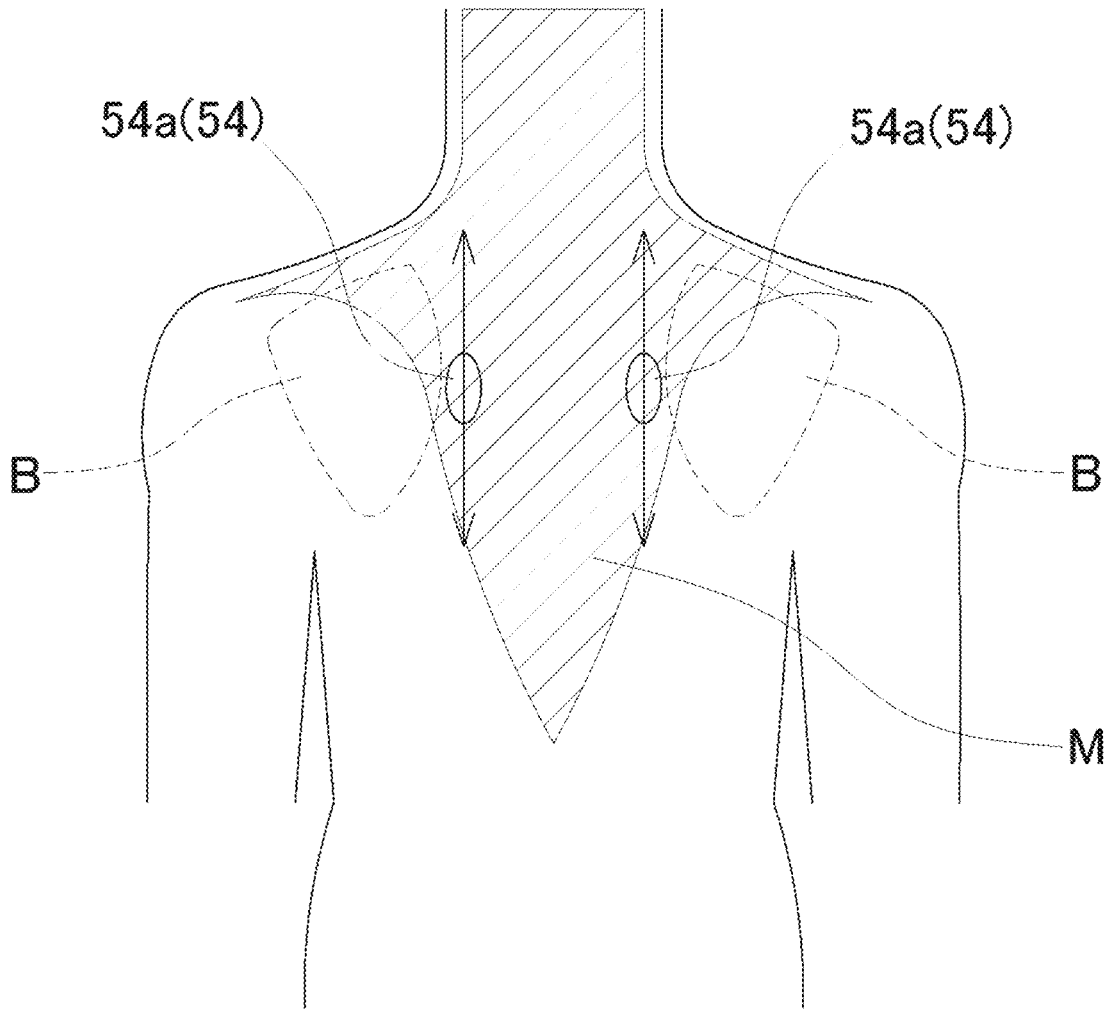
Figure 42:
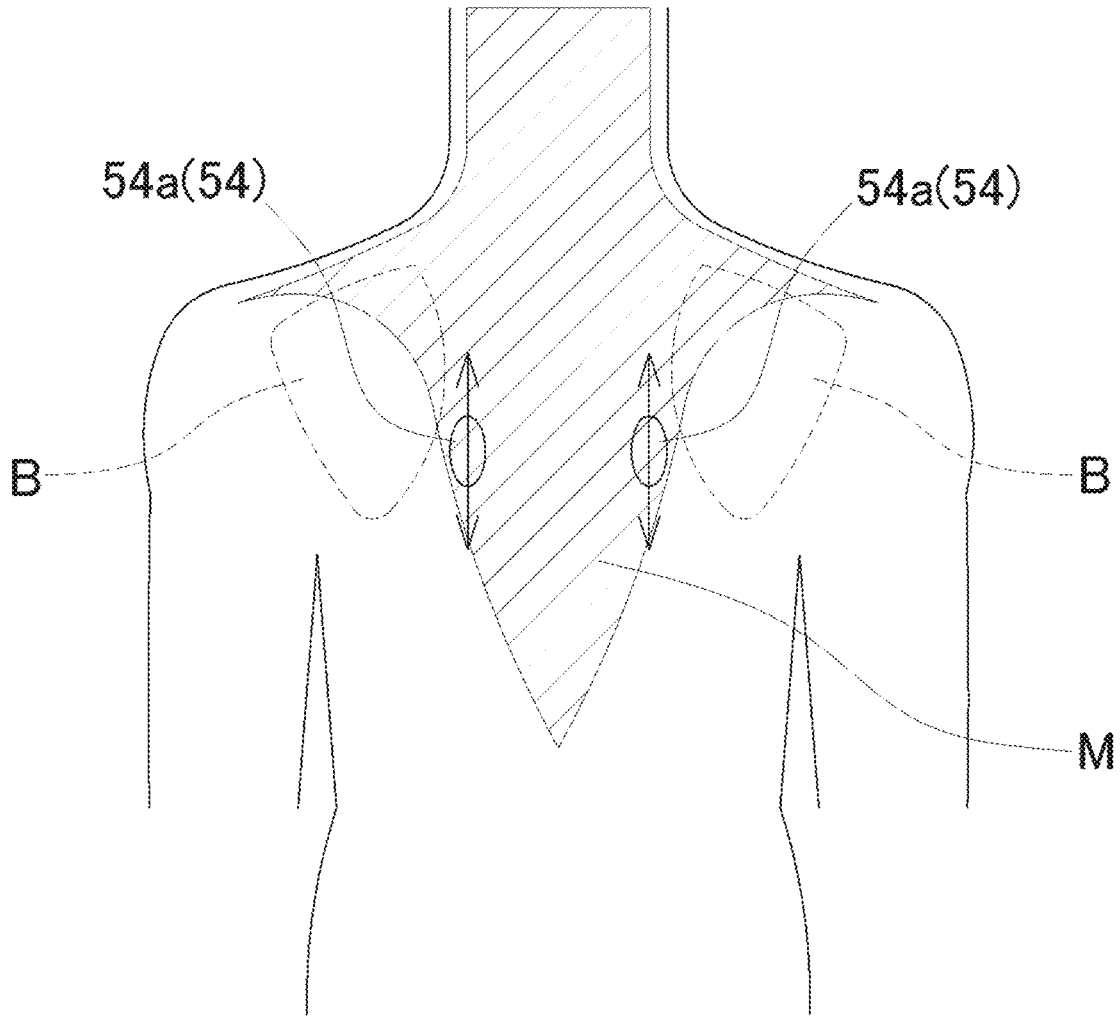
FIG. 42 is a view describing an operation b.
Figure 43:
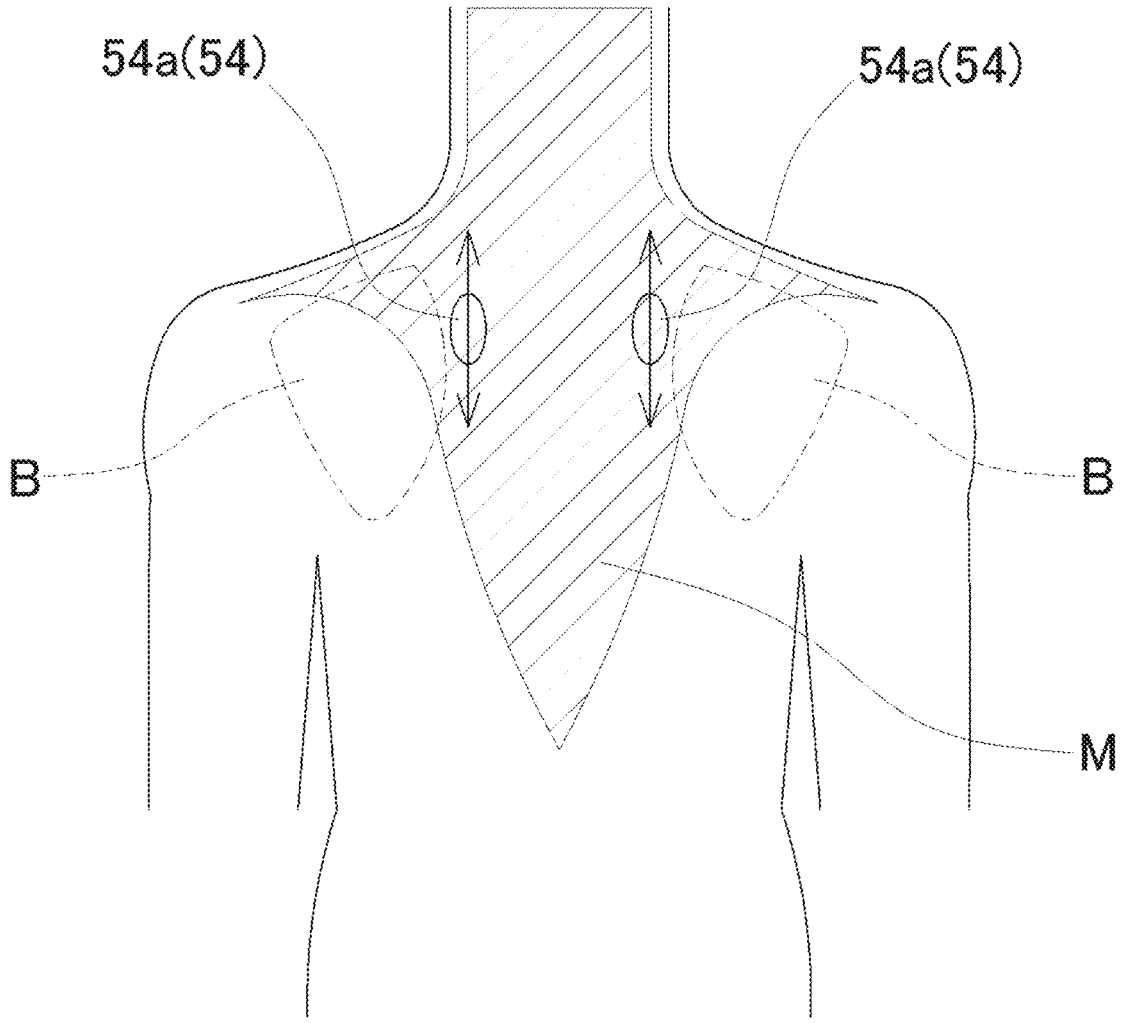
FIG. 43 is a view describing an operation c.
Figure 44:
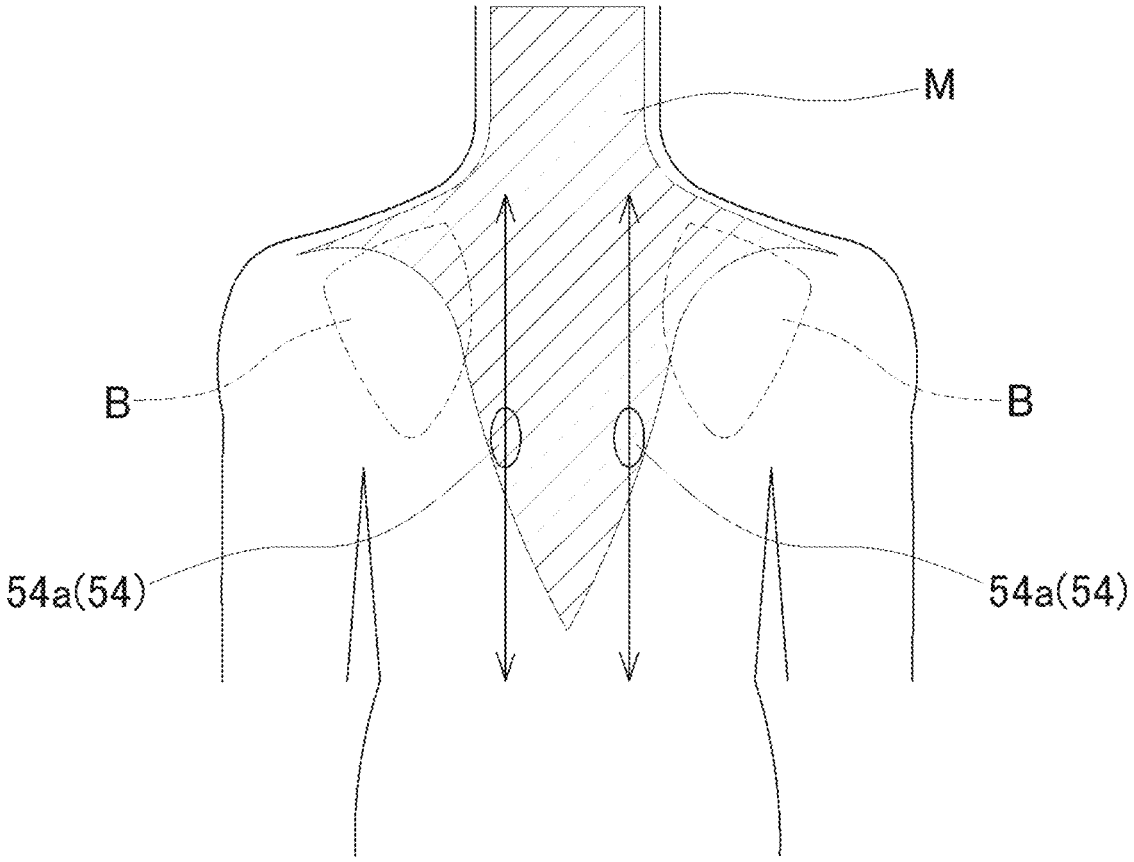
FIG. 44 is a view describing an operation d.
Figure 45:
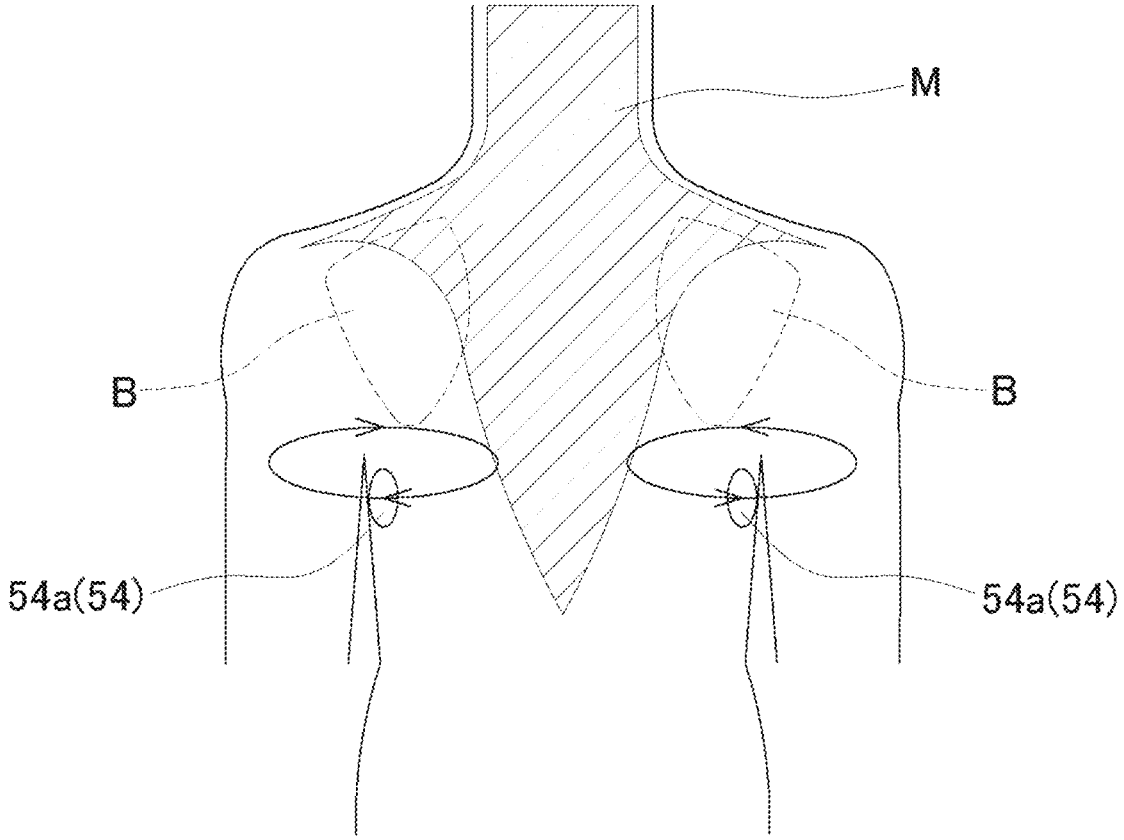
FIG. 45 is a view describing an operation e.
Figure 46:
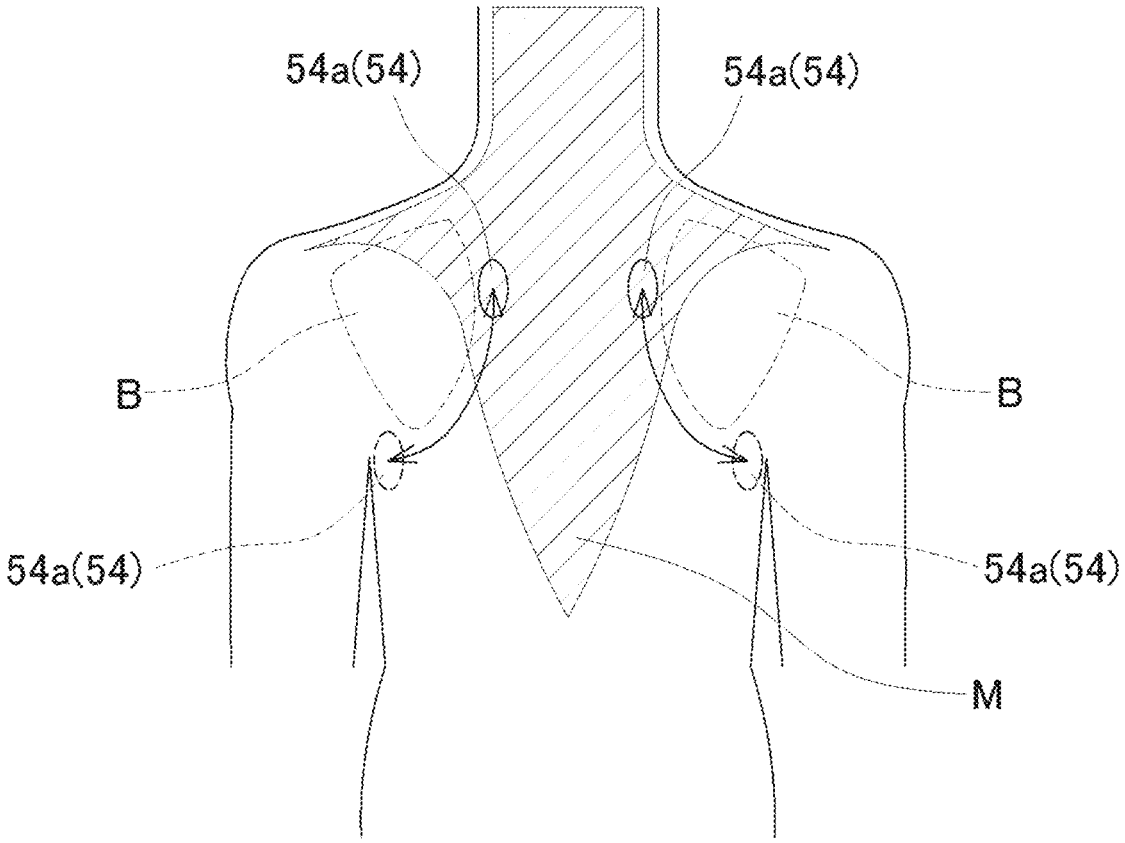
FIG. 46 is a view describing an operation f.
Figure 47:
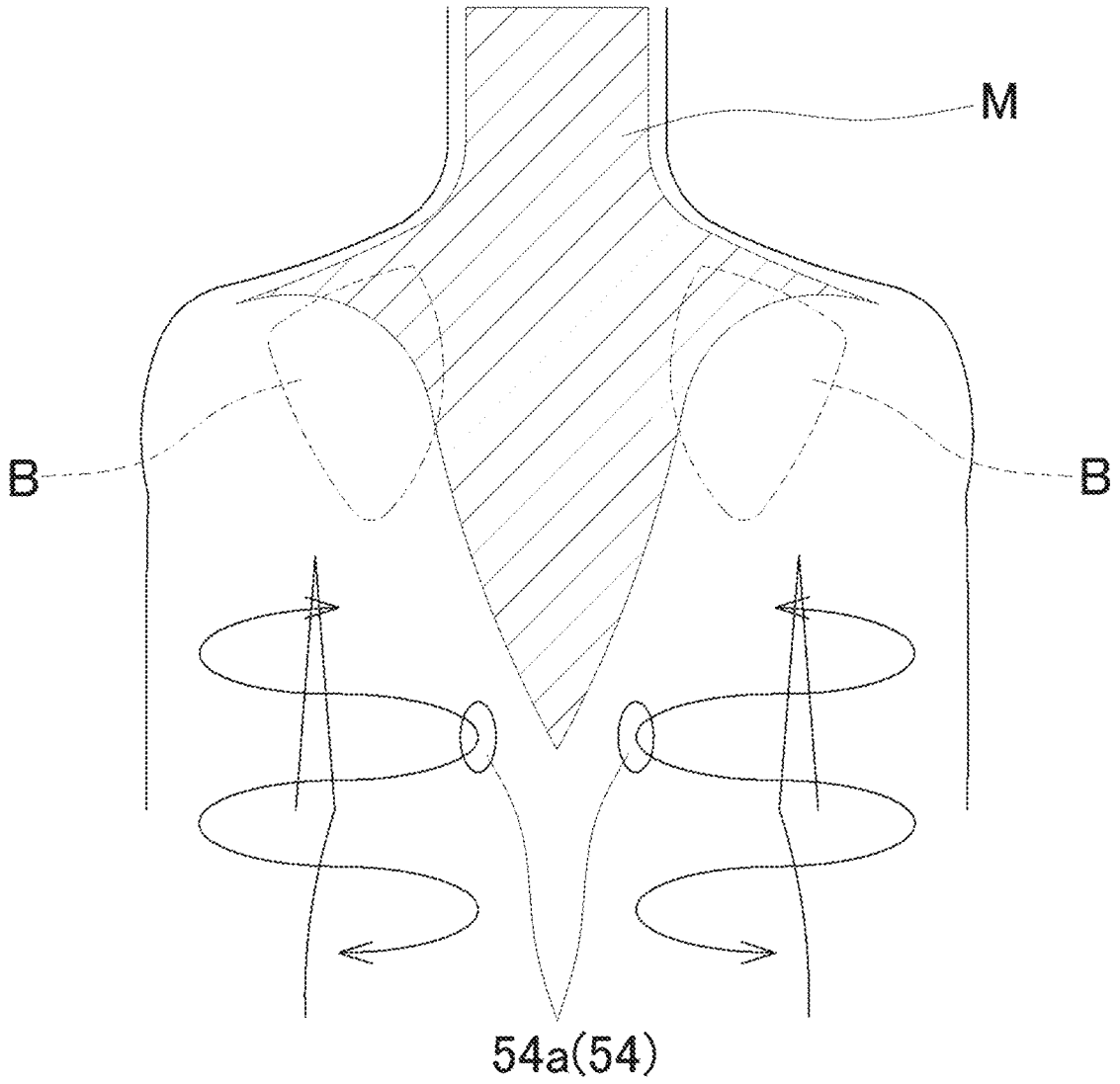
FIG. 47 is a view describing an operation g.
Figure 48:
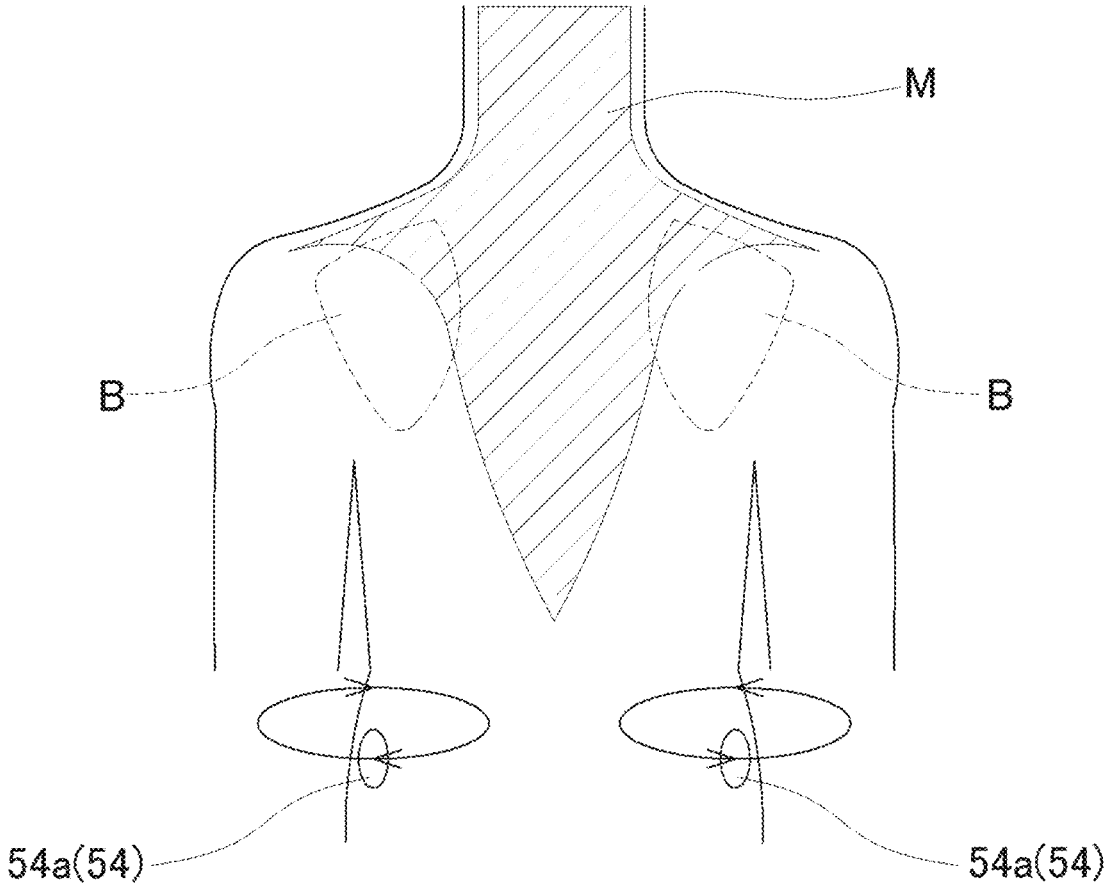
FIG. 48 is a view describing an operation h.
Figure 49:
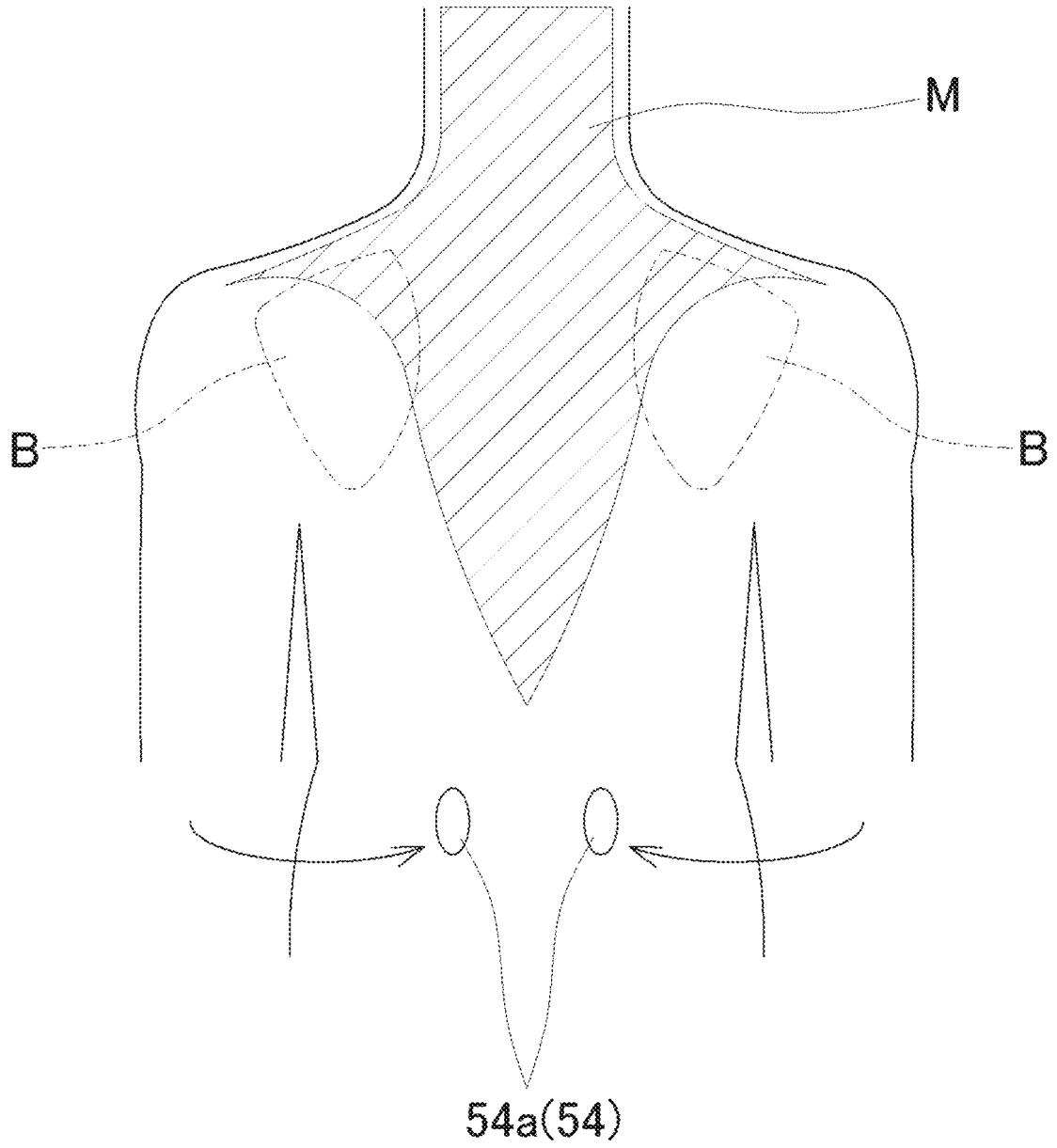
FIG. 49 is a view describing an operation i.
Figure 50:
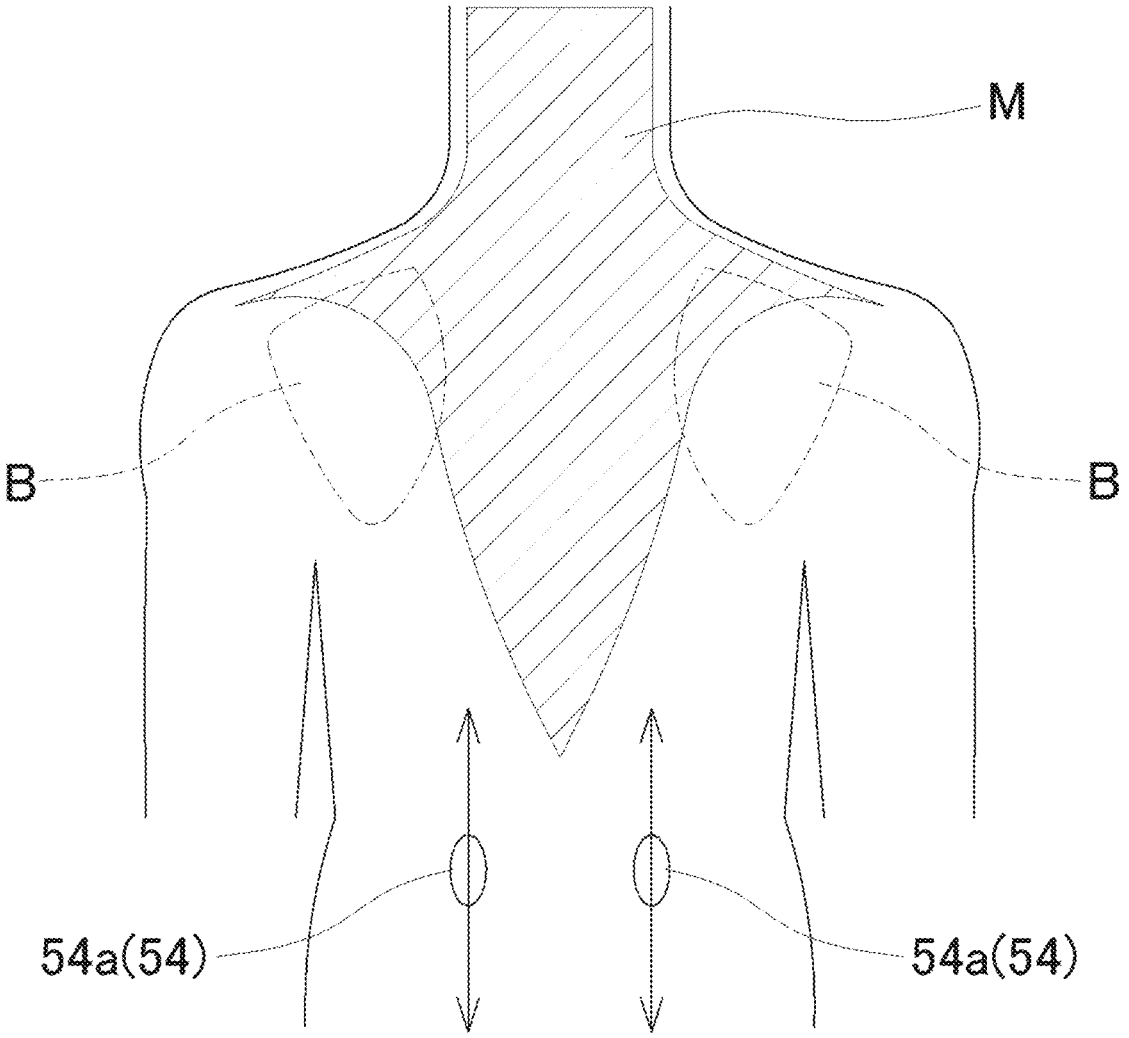
FIG. 50 is a view describing an operation j.

Hereinafter, individual operations the first massage mechanism 31 and the second massage mechanism 51 will be described. FIG. 35 is a view describing an operation A. FIG. 36 is a view describing an operation B. FIG. 37 is a view describing an operation C. FIG. 38 is a view describing an operation D. FIG. 39 is a view describing an operation E. FIG. 40 is a view describing an operation F. FIG. 41 is a view describing an operation a. FIG. 42 is a view describing an operation b. FIG. 43 is a view describing an operation c. FIG. 44 is a view describing an operation d. FIG. 45 is a view describing an operation e. FIG. 46 is a view describing an operation f. FIG. 47 is a view describing an operation g. FIG. 48 is a view describing an operation h. FIG. 49 is a view describing an operation i. FIG. 50 is a view describing an operation j.

The operations A to F are operations of the first massage mechanism 31. The operations "a" to "j" are operations of the second massage mechanism 51. The operations A to F of the first massage mechanism 31 and the operations "a" to "j" of the second massage mechanism 51 can be arbitrarily combined together. That is, in the present embodiment, there are sixty combinations for the operations of the first massage mechanism 31 and the second massage mechanism 51. A muscle such as a trapezius muscle M over a wide range can be collectively massaged by combining the operations A to F and a to j of the plurality of massage mechanisms 31 and 51 provided in the backrest portion 3 along the height direction. Besides, a site separated in the height direction can be simultaneously massaged as well. In the operations "a" to "j", in order to make the description easy to understand, the treatment members 54 are illustrated while omitting the lower treatment members 54*b*.

In the operations A to F, a position to be massaged by the first massage mechanism 31 is determined based on the positional information of each site detected or calculated by the particular-site detecting sensor. Meanwhile, in the operations "a" to "j", a position to be massaged by the second massage mechanism 51 is determined based on the positional information of each site detected based on the particular-site detecting sensor included in the first massage unit 8 or the second massage unit 9, or the positional information stored in the control means 23 in advance.

Operation A

As illustrated in FIG. 35, the operation A is an operation in which the massage motor 43 is driven at the shoulder position and the pair of treatment members 34 of the first massage mechanism 31 approaches each other and is separated from each other so as to perform the massaging operation. In the operation A, the treatment members 34 may act on any of the upper portion or the back portion of the shoulders. In a case of acting on the back portion of the shoulders, a side upper than scapulas B is preferable. In addition, in a case of acting on the scapulas B as the back portion of the shoulders, in order to prevent the user from feeling an excessive pain, it is preferable to perform the massaging operation in a state where the advancing/retreating air cell 15 contracts and the first massage mechanism 31 retreats.

Operation B

As illustrated in FIG. 36, the operation B is the operation of grasping the neck by driving the massage motor 43 at the neck position and causing the pair of treatment members 34 of the first massage mechanism 31 to approach each other. In this operation, the massage motor 43 stops for a predetermined period of time in a state where the pair of treatment members 34 approaches each other.

Operation C

As illustrated in FIG. 37, the operation C is an operation of rubbing the neck across the shoulders by using the treatment members 34 of the first massage mechanism 31. Specifically, at the neck position, the pair of treatment members 34 is in a state of approaching each other, and the lifting/lowering motor 35 and the massage motor 43 are driven. Then, while the first massage mechanism 31 is lowered, the pair of treatment members 34 is separated from each other (operation C-1). Otherwise, at the shoulder position, the pair of treatment members 34 is in a state of being separated from each other, and the lifting/lowering motor 35 and the massage motor 43 are driven. Then, while the first massage mechanism 31 is lifted, the pair of treatment members 34 approaches each other (operation C-2). The operation C-1 and the operation C-2 may be alternately repeated.

Operation D

As illustrated in FIG. 38, the operation D is an operation in which the pair of treatment members 34 performs a finger pressure therapy from above for the shoulders by driving the lifting/lowering motor 35 at a position upper than the shoulder position and lowering the first massage mechanism 31. In this operation, it is preferable to perform the operation in a state where the pair of treatment members 34 is separated from each other. In addition, it is preferable that a predetermined amount of air is supplied to the advancing/retreating air cell 15 and the operation is performed in a state where the treatment members 34 advance.

Operation E

As illustrated in FIG. 39, the operation E is an operation in which the pair of treatment members 34 rubs the neck by driving the lifting/lowering motor 35 at the neck position and lifting and lowering the first massage mechanism 31.

Operation F

As illustrated in FIG. 40, the operation F is an operation in which the treatment members 34 of the first massage mechanism 31 rub the shoulders or the back between the scapulas B on the right and the left. Specifically, in a state where the pair of arms 40 is substantially parallel to each other in a front view at the shoulders or the back position, the treatment members 34 are prevented from being in contact with the scapulas B. Then, the lifting/lowering motor 55 is driven, and the first massage mechanism 31 is lifted and lowered. The separation distance between the pair of treatment members 34 in the operation F may be longer than the separation distance between the pair of treatment members 34 in the operation E.

Operation a

As illustrated in FIG. 41, the operation a is an operation in which the treatment members 54 of the second massage mechanism 51 rub the back between the scapulas B on the right and the left. In this operation, the range of rubbing the back in the vertical direction includes positions corresponding to the upper end and the lower end of the scapulas B. Specifically, in a state where the pair of arms 60 is substantially parallel to each other in a front view at scapular positions, the treatment members 54*a* and 54*b* are prevented from being in contact with the scapulas B. Then, the lifting/lowering motor 55 is driven, and the second massage mechanism 51 is lifted or lowered. That is, the operation a is an operation of rubbing a wide range between the entire scapulas on the right and the left.

Operation b

As illustrated in FIG. 42, the operation b is an operation in which the treatment members 54 of the second massage mechanism 51 rub the back between the scapulas B on the right and the left. In this operation, the range of rubbing the back in the vertical direction includes a side lower than the center of the scapulas B and does not include a position corresponding to the upper end. Specifically, in a state where the pair of arms 60 is substantially parallel to each other in a front view at the scapular positions, the treatment members 54*a* and 54*b* are prevented from being in contact with the scapulas B. Then, the lifting/lowering motor 55 is driven, and the second massage mechanism 51 is lifted or lowered. That is, the operation b is an operation of rubbing a part around a lower side between the scapulas B on the right and the left.

Operation c

As illustrated in FIG. 43, the operation c is an operation in which the treatment members 54 of the second massage mechanism 51 rub the back between the scapulas B on the right and the left. In this operation, the range of rubbing the back in the vertical direction includes a side upper than the center of the scapulas B and does not include a position corresponding to the lower end. Specifically, the pair of arms 60 is substantially parallel to each other in a front view at the scapular position, and the treatment members 54*a* and 54*b* are prevented from being in contact with the scapulas B. Then, the lifting/lowering motor 55 is driven, and the second massage mechanism 51 is lifted or lowered. That is, the operation c is an operation of rubbing a part around an upper side between the scapulas B on the right and the left.

Operation d

As illustrated in FIG. 44, the operation d is an operation in which the treatment members 54 of the second massage mechanism 51 rub a range from the waist to the back. Specifically, the pair of arms 60 is substantially parallel to each other in a front view, and the treatment members 54*a* and 54*b* are prevented from being in contact with the scapulas B. Then, the lifting/lowering motor 55 is driven, and the second massage mechanism 51 is lifted or lowered. The lower limit of the lifting/lowering range of the second massage mechanism 51 may be determined based on a limit sensor (not illustrated) provided in the lower portion of the backrest portion 3. Due to the structure of the second massage mechanism 51, since the upper treatment members 54*a* act stronger than the lower treatment members 54*b*, without causing the arms 60 to be substantially parallel to each other in a front view, in a state where the pair of upper treatment members 54*a* approaches each other closer than the pair of lower treatment members 54*b*, each of the operations "a" to "d" may be performed while the upper treatment members 54*a* are prevented from being in contact with the scapulas B.

Operation e

As illustrated in FIG. 45, the operation e is an operation in which the treatment members 54 of the second massage mechanism 51 performs the massaging operation for the edge of the lower portion of the scapulas B. Specifically, the treatment members 54 (for example, the upper treatment members 54*a*) are positioned slightly below the lower end of the scapulas B, and the massage motor 63 is driven, thereby performing the massaging operation in which the pair of treatment members 54 of the second massage mechanism 51 approaches each other and is separated from each other.

Operation f

As illustrated in FIG. 46, the operation f is an operation in which the treatment members 54 of the second massage mechanism 51 rub the edge of the scapulas B on the inner side. Specifically, between the scapulas B on the right and the left, the pair of treatment members 54 (for example, the upper treatment members 54*a*) is in a state of approaching each other, and the lifting/lowering motor 55 and the massage motor 63 are driven. Then, while the second massage mechanism 51 is lowered, the pair of treatment members 54 (for example, the upper treatment members 54*a*) is separated from each other (operation f-1). Otherwise, between the scapulas B on the right and the left, the pair of treatment members 54 (for example, the upper treatment members 54*a*) is in a state of being separated from each other, and the lifting/lowering motor 55 and the massage motor 63 are driven. Then, while the second massage mechanism 51 is lifted, the pair of treatment members 54 (for example, 54*a*) approaches each other (operation f-2). The operation f-1 and the operation f-2 may be alternately repeated.

Operation g

As illustrated in FIG. 47, the operation g is an operation in which the treatment members 54 of the second massage mechanism 51 rub and knead the back and/or the waist. Specifically, the lifting/lowering motor 55 and the massage motor 63 are driven, and while the second massage mechanism 51 is lifted and lowered, the pair of treatment members 54 approaches each other and is separated from each other. In this operation, the range of lifting and lowering the second massage mechanism 51 may cover a part from the waist to the back or may cover only the back or the waist.

Operation h

As illustrated in FIG. 48, the operation h is an operation in which the treatment members 54 of the second massage mechanism 51 knead the back portion of the hips (part which comes into contact with the backrest portion 3). Specifically, the massage motor 63 is driven, and the pair of treatment members 54 of the second massage mechanism 51 approaches each other and is separated from each other at a hip position. The hip position may be determined based on the limit sensor (not illustrated) provided in the lower portion of the backrest portion 3.

Operation i

As illustrated in FIG. 49, the operation i is an operation in which the treatment members 54 of the second massage mechanism 51 performs a finger pressure therapy for the back portion of the hips (part which comes into contact with the backrest portion 3). Specifically, the massage motor 63 is driven, and the pair of treatment members 54 of the second massage mechanism 51 (for example, the upper treatment members 54*a*) approaches each other at the hip position. In the state thereof, the massage motor 63 stops for a predetermined period of time. The hip position may be determined based on the limit sensor (not illustrated) provided in the lower portion of the backrest portion 3).

Operation j

As illustrated in FIG. 50, the operation j is an operation in which the treatment members 54 of the second massage mechanism 51 rub the back portion of the waist and/or the hips (part which comes into contact with the backrest portion 3). Specifically, the lifting/lowering motor 55 is driven, and the second massage mechanism 51 is lifted or lowered. In this operation, the range of lifting and lowering the second massage mechanism 51 may cover a part from the waist to the hips or may cover only the waist or the hips.

Configuration of Massage Unit According to Another Embodiment

Figure 30:
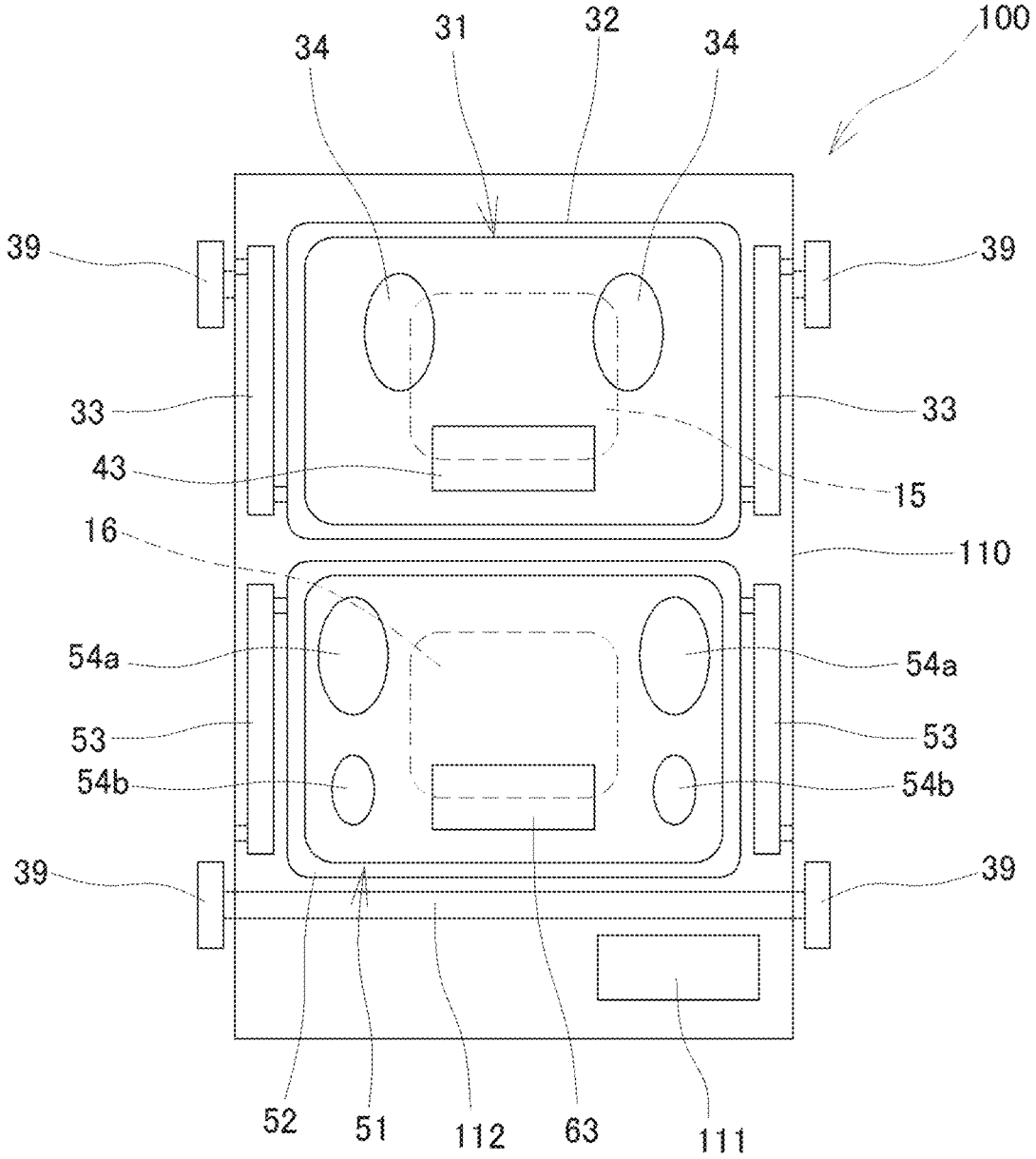
FIG. 30 is a front view of a massage unit according to another embodiment.

Hereinafter, a massage unit 100 according to another embodiment will be described. FIG. 30 is a front view of the massage unit 100 according to another embodiment. In the massage unit 100, the massage mechanism 31 and the second massage mechanism 51 described above are collectively provided in a single main body frame 110. That is, the configurations of the massage mechanisms 31 and 51 and the support frames 32 and 52 respectively supporting the massage mechanisms 31 and 51 are the same as those described above. Hereinafter, the same reference signs are applied and description thereof will be omitted.

As illustrated in FIG. 30, the massage unit 100 includes the first massage mechanism 31 disposed on a relatively upper side and the second massage mechanism 51 disposed on a relatively lower side and is provided in the backrest portion 3. Mainly, the massage unit 100 is configured to include the main body frame 110 which is supported by the guide mechanisms 3*b* so as to be able to be lifted and lowered, the first massage mechanism 31 and the second massage mechanism 51, the support frames 32 and 52 which respectively support the massage mechanisms 31 and 51, the advancing/retreating drive portions 15 and 16 which respectively cause the massage mechanisms 31 and 51 to advance and retreat with respect to the treatment target portion, and the links 33 and 53 which interlock the main body frame 110 and the support frames 32 and 52 with each other and oscillate in the forward/backward direction.

The massage unit 100 includes a lifting/lowering motor 111, a lifting/lowering shaft 112, and the pinions 39 which are attached to both ends of the lifting/lowering shaft 112. When the lifting/lowering motor 111 is driven, the lifting/lowering shaft 112 rotates and the massage unit 100 is lifted and lowered along the height direction. The treatment members 34 are driven by the massage motor 43 so as to be able to perform the massaging operation or the patting operation. The treatment members 54 are driven by the massage motor 63 so as to be able to perform the massaging operation.

Configuration of Massage Mechanism According to Another Embodiment

Figure 31:
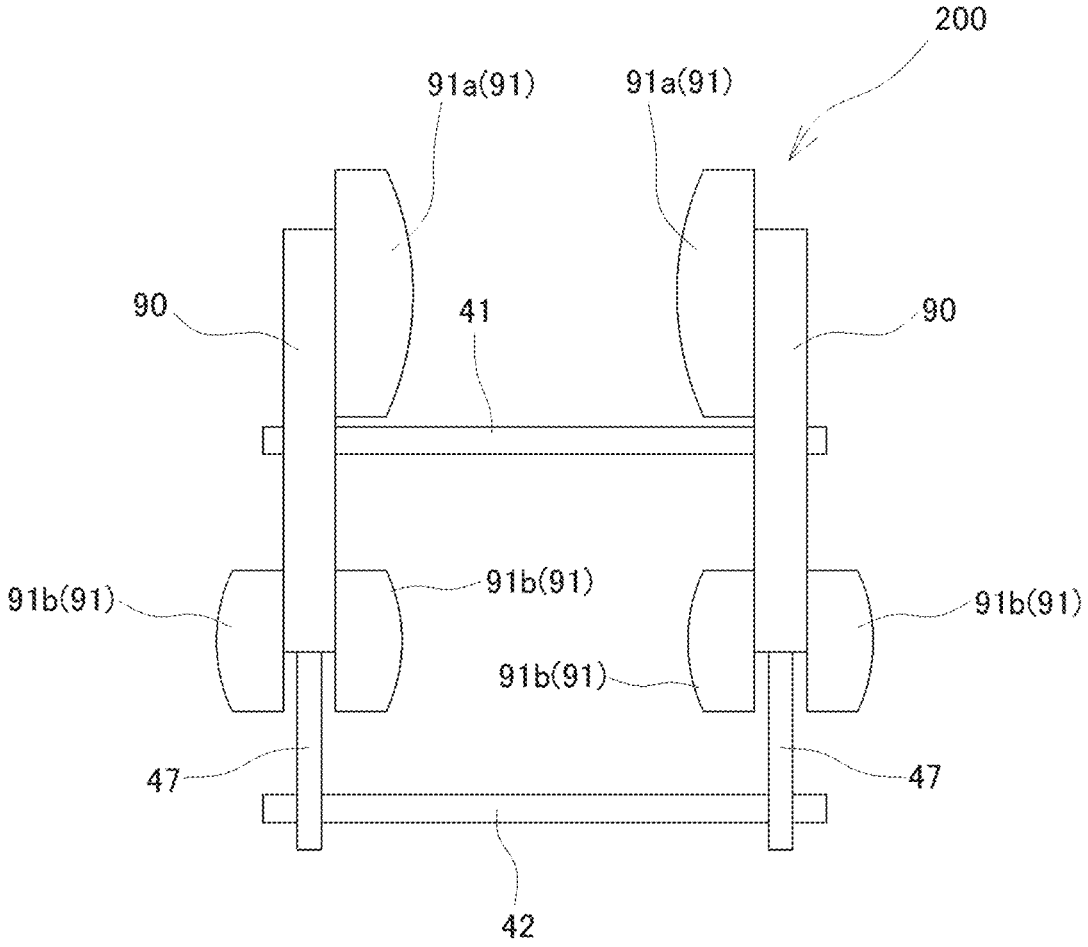
FIG. 31 is a front view of a massage mechanism according to another embodiment.

Hereinafter, a massage mechanism 200 according to another embodiment will be described. FIG. 31 is a front view of the massage mechanism 200 according to another embodiment.

The point essentially different from the first massage mechanism 31 described above is that treatment members 91 are provided at upper portions and lower portions of arms 90 in the massage mechanism 200, and the treatment members 91 on the lower side are provided on the right and the left interposing each of the arms 90 therebetween. Other configurations are the same as those of the first massage mechanism 31. Hereinafter, the same reference signs are applied and description thereof will be omitted.

The massage mechanism 200 includes the arms 90 making a pair on the right and the left to which the treatment members 91 are attached. The arms 90 are interlocked with the kneading shaft 41 and the patting shaft 42. The treatment members 91 include an upper treatment member 91*a* provided on the upper side of each of the arms 90, and lower treatment members 91*b* provided on the lower side of each of the arms 90. In addition, the lower treatment members 91*b* are provided while interposing each of the arms 90 therebetween and making a pair on the right and the left. Each of the lower treatment members 91*b* is configured to have a small diameter compared to the upper treatment member 91*a*. The lower treatment members 91*b* simulate the thumbs of a masseur, and the upper treatment members 91*a* simulate other fingers of the masseur excluding the thumbs. When the massage motor 43 is driven, the massaging operation in which the pair of treatment members 91 on the right and the left approaches each other and is separated from each other and the patting operation in which the pair of treatment members 91 on the right and the left alternately advances and retreats can be performed. In a case where the massage mechanism 200 is applied to the massage machine 1 described above, it is preferable to provide the massage mechanism 200 instead of the first massage mechanism 31. That is, in the backrest portion 3, the massage mechanism 200 is disposed on a relatively upper side, and the second massage mechanism 51 is disposed on a relatively lower side. Each of the massage mechanisms 51 and 200 can be independently lifted and lowered along the height direction.

It is effective that the massage mechanism 200 performs the massaging operation in the vicinity of the neck and the shoulder position. That is, the neck and the shoulders can be simultaneously kneaded by the upper treatment members 91*a* and the lower treatment members 91*b*. Moreover, in an approaching process of the pair of lower treatment members 91*b*, the lower treatment members 91*b* on the inner sides effectively act on the shoulders, and in a separation process of the pair of lower treatment members 91*b*, the lower treatment members 91*b* on the outer sides effectively act on the shoulders. From a view point of exhibiting the effects, there is no need to provide a plurality of massage mechanisms 200 along the height direction. A single massage mechanism 200 may be provided in the backrest portion 3 so as to be able to be lifted and lowered along the height direction. In addition, the lower treatment members 91*b* may be provided in only one of the arms 90 on the inner side and the outer side.

Configuration of Link According to another Embodiment

Figure 32A:
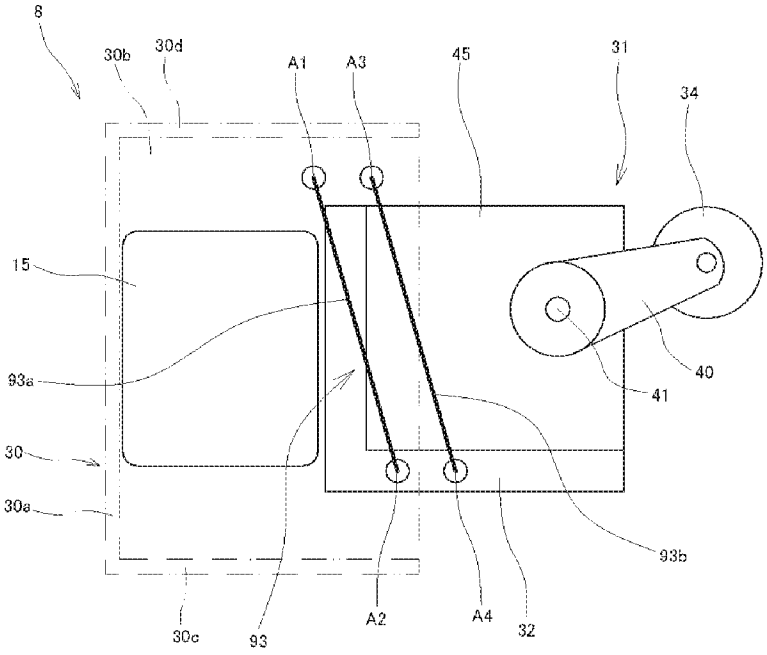
FIGS. 32A and 32B are views describing a link according to another embodiment.
Figure 32B:
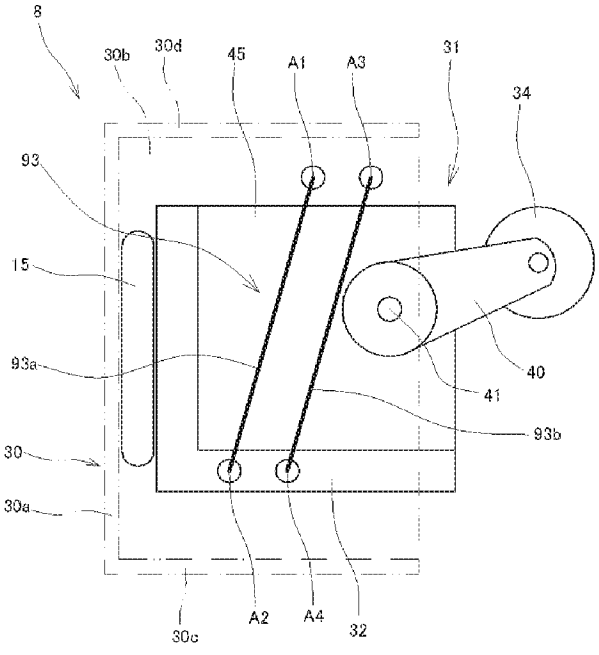

Hereinafter, links 93 according to another embodiment will be described by exemplifying a case of being applied to the first massage unit 8. However, the links 93 can also be applied to the second massage unit 9. FIGS. 32A and 32B are views describing the links 93 according to another embodiment. FIG. 32A illustrates a state where the massage mechanism 31 retreats, and FIG. 32B illustrates a state where the massage mechanism 31 advances. Hereinafter, the same reference signs are applied to the members corresponding to the members of the first massage unit 8 including the links 33 described above, and description thereof will be omitted.

As illustrated in FIGS. 32A and 32B, the links 93 which interlock the main body frame 30 and the support frame 32 with each other and oscillate in the forward/backward direction are provided on the sides of the support frame 32. The links 93 are disposed on the sides of the support frame 32 because the thickness of the massage unit 8 in the forward/backward direction can be restrained compared to a case where the links 93 are disposed behind the support frame 32. The links 93 are provided so as to be parallel to each other in the forward/backward direction. Each of the links 93 includes a first link portion 93*a* disposed on a relatively back side and a second link portion 93*b* disposed on a relatively front side. That is, each of the links 93 configures a four joint link mechanism. In addition, being different from the links 33, the first link portion 93*a* and the second link portion 93*b* have the same length, and each of the links 93 configures a parallel link mechanism. Therefore, the first massage mechanism 31 can advance and retreat in parallel and stable manners.

As described above, the first massage unit 8 includes the main body frame 30, the massage mechanism 31 which includes the treatment members 34, the support frame 32 which supports the massage mechanism 31, the advancing/retreating drive portion 15 which causes the massage mechanism 31 to advance and retreat with respect to the treatment target portion, and the links 93 which interlock the main body frame 30 and the support frame 32 with each other and oscillate in the forward/backward direction. In the links 93, in a state where the massage mechanism 31 retreats to the backmost side, interlocking portions A1 and A3 with respect to the main body frame 30 are positioned in front of interlocking portions A2 and A4 with respect to the support frame 32.

Configuration of Sensor According to Another Embodiment

Figure 33:
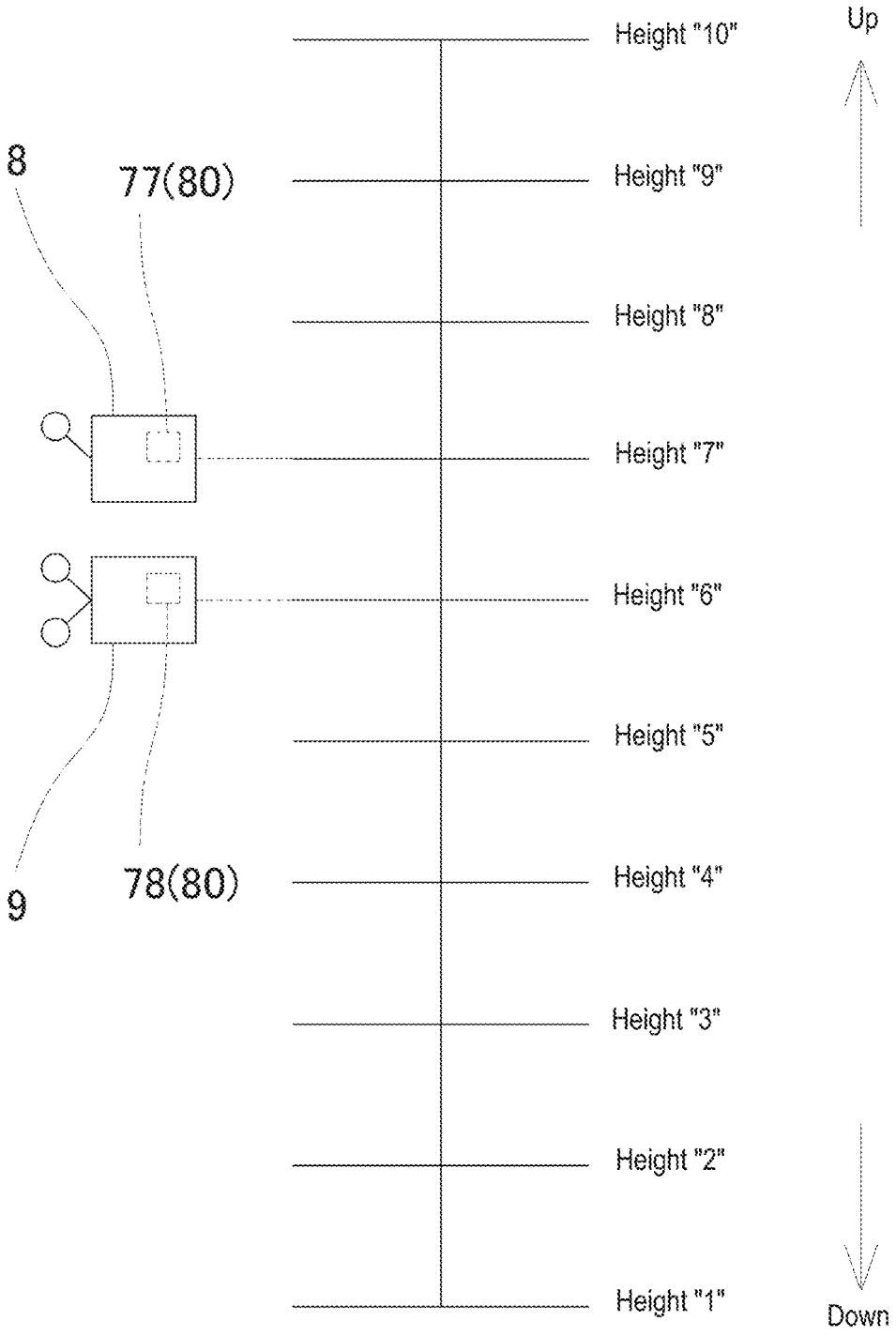
FIG. 33 is a view describing a sensor according to another embodiment.

Hereinafter, in regard to a sensor 80 which detects the relative positions of the first massage unit 8 and the second massage unit 9, another embodiment will be described based on FIG. 33. FIG. 33 is a view describing the sensor 80 according to another embodiment.

The sensor 80 is configured to include a third sensor portion (lifting/lowering sensor 77) which detects the vertical position of the first massage unit 8, and a fourth sensor portion (lifting/lowering sensor 78) which detects the vertical position of the second massage unit 9. Based on a differential value (in FIG. 33, differential value "1") between a detection value (in FIG. 33, height "7") indicating the vertical position (height) of the first massage unit 8 detected by the lifting/lowering sensor 77, and a detection value (in FIG. 33, height "6") indicating the vertical position (height) of the second massage unit 9 detected by the lifting/lowering sensor 78, the relative positions of the first and second massage units 8 and 9 are detected. That is, as the differential value is small, the gap between both the massage units 8 and 9 is narrow, and as the differential value is great, the gap between both the massage units 8 and 9 is wide. For example, the relative positions having the differential value of "1" may be set as the approach state, and the relative positions having the differential value of "2" may be set as the pre-approach state.

As described above, when the lifting/lowering sensor 77 detects how many rotations the lifting/lowering shaft 36 makes from the upper limit position, the vertical position of the first massage unit 8 is detected. When the lifting/lowering sensor 78 detects how many rotations the lifting/lowering shaft 56 makes from the lower limit position, the vertical position of the second massage unit 9 is detected. In the present embodiment, the differential value indicating the gap between both the massage units 8 and 9 can be detected through nine stages. Therefore, compared to a case where the sensor 70 is adopted, the detection range for the relative positions of the first and second massage units 8 and 9 is widened.

In addition, the massage machine of the present invention is not limited to the illustrated forms and may be differently formed within the scope of the invention.

For example, the number of treatment members is not restricted. Similar to the second massage mechanism 51, there may be a plurality of treatment members 34 of the first massage mechanism 31 in the vertical direction. In addition, in the embodiment described above, there is the pair of arms on the right and the left supporting the treatment members. However, there may be a plurality of pairs of arms on the right and the left interposing the centerline of the body therebetween, or there may be provided a plurality of treatment members in the lateral direction with respect to one arm. In addition, the number of massage units to be provided along the height direction is not restricted, and there may be three massage units or more.

In addition, from the view point of the operations 1 to 8 described above, a plurality of massage units 8 and 9 may be provided in the height direction, the operation ranges W1 and W2 in the lateral direction in the massaging operations, the vertical dimensions H1 and H2 of the trajectories of the massaging operations, and the separation distances D1 and D2 between the pairs of treatment members when being closest to each other in the massaging operation may be the same in the first massage mechanism 31 and the second massage mechanism 51.

In addition, the guide mechanisms 3*b* may also be provided in the seat portion 2, or the seat portion 2 and the footrest 4. At least any one of the first and second massage units 8 and 9 may be movable from the backrest portion 3 to the seat portion 2 or the footrest 4 along the height direction.

In addition, the sensor 70 which detects the approach state or the pre-approach state as the relative positions for both the massage units 8 and 9 may be a contact-type sensor adopting a volume switch and the like. For example, instead of the magnet holders 73 and 74, a volume switch may be provided at the tip of a spring biased in an extending direction. Moreover, when the volume switch is additionally provided on the bottom wall 30*c* of the first massage unit 8 or the top wall 50*d* of the second massage unit 9, "the pre-approach state" can be detected by pressing the volume switch provided at the tip of the spring, and "the approach state" can be detected by pressing the volume switch provided at the bottom wall 30*c* or the top wall 50*d* against biasing force of the spring.

First, the present invention can be applied to a massage machine in which a bodily feeling of massage is improved. Second, the present invention can be applied to a massage machine in which an effective massaging operation can be performed depending on a treatment site. Third, the present invention can be applied to a massage machine in which a plurality of massage units can maintain appropriate relative positions.

What is claimed is:

1. A massage machine comprising:

a first massage mechanism that is disposed on a relatively upper side of the massage machine and a second massage mechanism that is disposed on a relatively lower side of the massage machine, as the massage mechanisms; and control means that controls operations of the massage mechanisms;

wherein each of the massage mechanisms comprising:

a pair of left and right treatment members and a kneading shaft that supports the pair of left and right treatment members via inclined shafts at ends of the kneading shaft, a distance between the pair of left and right treatment members of the first massage mechanism being in closest positions and a distance between the pair of left and right treatment members of the second massage mechanism being in closest positions are different, a distance between one of the ends of the kneading shaft of the first massage mechanism and one of the pairs left and right treatment members supported by the one of the ends of the first massage mechanism and a distance between one of the ends of the kneading shaft of the second massage mechanism and one of the left and right treatment members supported by the one of the ends of the second massage mechanism are different, and an inclination angle of one of the inclined shafts at one of the ends of the kneading shaft of the first massage mechanism and an inclination angle of one of the other inclined shafts at one of the ends of the kneading shaft of the second massage mechanism are different;

wherein the massage mechanisms are able to perform massaging operations when the treatment members operate in at least a lateral direction so as to approach each other and be separated from each other according to the rotation of the kneading shafts of the first and the second massage mechanisms;

wherein the first and second massage mechanisms are able to perform massaging operations when the first and second pairs of the treatment members operate in first and second trajectories having at least lateral and vertical directional components respectively according to rotation of the kneading shafts of the first and the second massage mechanisms;

wherein the first and second trajectories are in an arc-like or a loop-like shape; and wherein the first massage mechanism and the second massage mechanism are set such that the lateral directional components and vertical directional components of the first and second trajectories respectively are different.

2. The massage machine according to claim 1, wherein the first and second massage mechanisms are able to be lifted and lowered in the height direction, and wherein when positions of the first and second massage mechanisms in the height direction vary, the same treatment target portion is able to be massaged by the first or second massage mechanism.

3. The massage machine according to claim 1, wherein the control means controls the massaging operations performed by the treatment members and lifting/lowering of the first and second massage mechanisms, and wherein when the massaging operations and the lifting/lowering are synchronized with each other through controlling of the control means, the vertical dimensions of the trajectories of the massaging operations in the treatment members are changeable.

4. The massage machine according to claim 1, wherein the first and second massage mechanisms cause the treatment members to perform the massaging operations at speeds different from each other.

* * * * *